US008596240B2

(12) United States Patent
Mavinahally et al.

(10) Patent No.: US 8,596,240 B2
(45) Date of Patent: Dec. 3, 2013

(54) INTEGRALLY CAST BLOCK AND GASEOUS FUEL INJECTED GENERATOR ENGINE

(76) Inventors: Nagesh Mavinahally, Northridge, CA (US); Jay Veerathappa, Northridge, CA (US); Pushpa Nagesh Mavinahally, Northridge, CA (US)

( * ) Notice: Subject to any disclaimer, the term of this patent is extended or adjusted under 35 U.S.C. 154(b) by 226 days.

(21) Appl. No.: 12/890,627

(22) Filed: Sep. 25, 2010

(65) Prior Publication Data

US 2011/0073064 A1 Mar. 31, 2011

Related U.S. Application Data

(60) Provisional application No. 61/252,685, filed on Oct. 18, 2009, provisional application No. 61/277,476, filed on Sep. 26, 2009.

(51) Int. Cl.
*F02F 7/00* (2006.01)
*F02B 75/32* (2006.01)
*F02N 15/00* (2006.01)

(52) U.S. Cl.
USPC ..... 123/195 R; 123/196 R; 123/179.25; 123/197.4; 74/50; 74/595; 464/134; 464/135

(58) Field of Classification Search
USPC ..... 123/50 R, 195 R, 294, 319, 179.29, 123/179.25; 184/5, 6.3; 74/50, 595; 464/134, 135
See application file for complete search history.

(56) References Cited

U.S. PATENT DOCUMENTS

| | | | | | |
|---|---|---|---|---|---|
| 4,406,460 | A * | 9/1983 | Slayton | 277/401 |
| 4,513,702 | A * | 4/1985 | Koga et al. | 123/193.5 |
| 4,986,228 | A * | 1/1991 | Tharman | 123/179.16 |
| 5,072,699 | A * | 12/1991 | Pien | 123/65 VC |
| 5,207,120 | A * | 5/1993 | Arnold et al. | 74/595 |
| 5,495,833 | A * | 3/1996 | Ishizaka et al. | 123/179.25 |
| 6,021,766 | A * | 2/2000 | Maeda et al. | 123/573 |
| 6,047,678 | A * | 4/2000 | Kurihara et al. | 123/196 R |
| 6,397,795 | B2 * | 6/2002 | Hare | 123/65 PE |
| 6,612,275 | B2 * | 9/2003 | Immel et al. | 123/90.31 |
| 6,644,263 | B2 * | 11/2003 | Hare | 123/196 R |
| 7,055,485 | B1 * | 6/2006 | Davis et al. | 123/195 R |

* cited by examiner

*Primary Examiner* — Lindsay Low
*Assistant Examiner* — Kevin Lathers
(74) *Attorney, Agent, or Firm* — Steven J. Rosen

(57) ABSTRACT

An integrally cast four-stroke engine mono-block (10) includes integrally cast cylinder block (20), cylinder head (40), and portion of a crankcase (30) including crankcase 10 outboard and inboard walls (89, 90). At least parts of outer and inner bearing bosses (21*a*, 21*b*) are integrally cast with the cylinder block (20) with the inner bearing boss (21*b*) integrally cast in the inboard wall (90). At least one cored out longitudinally extending open valve 15 train chamber (88) is disposed between the outboard wall (89) and the cast cylinder block (20).

38 Claims, 40 Drawing Sheets

INTEGRALLY CAST BLOCK AND GASEOUS FUEL INJECTED GENERATOR ENGINE

RELATED APPLICATIONS

The present application claims the benefit of priority of the following applications: U.S. provisional application No. 61/252,685, titled "INTEGRALLY CAST BLOCK AND GASEOUS FUEL INJECTED GENERATOR ENGINE" and filed Oct. 18, 2009; U.S. provisional application No. 61/277,476, titled "INTEGRALLY CAST BLOCK AND LUBRICATING SYSTEM FOR FOUR CYCLE ENGINES" and filed Sep. 26, 2009; and International Application Number PCT/US09/53088, titled "INTEGRALLY CAST BLOCK AND UPPER CRANKCASE" and filed Aug. 14, 2009, each of which is hereby incorporated herein by reference for all purposes.

BACKGROUND

Field

Various embodiments relate to internal combustion four-stroke engines and, more particularly, to integrally cast blocks containing cylinders, crankcase portions, and gaseous fuel system.

Conventional four-stroke engines have certain disadvantages because there are numerous parts as compared to two-stroke engines. The additional parts, for example include, valve trains consisting of intake and exhaust valves, followers in the case of push tube trains for transmitting motion from cam lobes to rockers, just rockers in the case of overhead cam and belt or chain drives for overhead cam types. Also included are cam gear or pulley as the case may be, valve springs and retainers, cam shafts, and cam covers in some cases. Also, the method of assembling the main components varies depending on how the cylinder, crankcase, crankcase cover, piston rod and crankshaft assemblies are made.

It is known in the prior art that four-stroke engines have cylinder blocks (with or without a separate cylinder head) and crankcases as the case may be with or without crankcase covers. For example, cylinders manufactured by MTD Southwest has a cylinder head integral with the cylinder and has a separate crankcase which has main bearings to support the crankshaft and a separate volute attached to the crankcase. The volute also has bosses for an ignition module. Another example is a Honda engine which has a cylinder block including a cylinder, where the upper half of the crankcase is integral with the cylinder block and a lower half of the crankcase which, when assembled together, support the main bearings. In this case, there is no separate crankcase cover and the belt drive for the overhead valve system is a wet type, where the upper and lower half of the crankcases together form a reservoir for the lubricating oil and the belt is completely enclosed. The enclosure is integral with the upper half of the crankcase. A similar design is used for a push tube type of valve train. Reference may be made to U.S. Pat. Nos. 6,539,904, 6,672,273, 6,427,672, 6,508,224, 6,705,263 (belt drive), and 6,021,766 (push tube). US patent describes a four-stroke engine with mist lubrication where the crankshaft is fully supported on both sides. It has an oil reservoir on one side of the crankshaft and also a flywheel and a starter on the same side, while the opposite side has clutch and power take off shaft (29). The disadvantage is that the over all length of the engine is longer and heavier. Secondly the full crank engine requires expensive bearings and a full shaft that is heavier and expensive.

Some Honda full crank engines have the crankcases split at an angle to the crankshaft as disclosed in U.S. Pat. Nos. 6,250,273 and 6,644,290. The front half of the crankcase is integral with the cylinder block and has bearing boss to support the front half of the crankshaft and the rear half of the crankcase has another bearing boss to support the outboard side of the crankshaft. The cam gear or the pulley for transmitting the motion to the overhead valves is in the outboard side. One disadvantage is that the U.S. Pat. No. 6,250,273 discloses the need for a cam side cover 14 to hold the cam shaft and gear, as such the prior art requires additional parts, fasteners, and gaskets. In both U.S. Pat. Nos. 6,250,273 and 6,644,290, the crankshaft requires the outboard bearing support 132 to structurally support the crankshaft and cannot be built without support 132. In comparison, the presently disclosed engine has two bearing supports on the same side and does not need additional bearing support on the outboard side.

Another example of engines with push tubes are disclosed in U.S. Pat. Nos. 6,213,079, 7,243,632, and 6,119,648. Some engines use gears to transmit rotation from crankshaft to the overhead cam shaft, which is running at half the crankshaft speed as disclosed in U.S. Pat. Nos. 6,152,098 and 6,612,275. In most cases where the engine has a two piece block, the top or front half and lower or outboard half of the crankcase, the valve train is on the outboard side.

In the case of upper and lower halves of crankcases (or left and right halves as in Kioritz U.S. Pat. No. 6,119,648, the disadvantages are that the upper and lower halves are first assembled together and then the bearing bores are machined. They are taken apart for the final assembly. They are not interchangeable. A sealing gasket is used to seal the two halves. As such, the cost of such a system is higher than the one proposed in the design disclosed herein. Simpler designs as disclosed in U.S. Pat. Nos. 7,559,299 and 2,218,332 include mono-block two-stroke engine designs. However, the two-stroke engines do not have valve train or valves and therefore are simpler to manufacture. Secondly the passages provided are for transfer passages connecting the crankcase chamber directly to the bottom of the cylinder to the combustion chamber have function to communicate between the crankcase chamber and combustion chamber and do not have valve train the passages and cannot be constructed to have the valve train in the transfer passage. U.S. Pat. No. 4,513,702, discloses a valve train having a cam shaft perpendicular to the crankshaft axis necessitating dual cams, one each for intake and the exhaust valve, as such a single cam lobe as disclosed in this invention cannot be fitted into the design disclosed in U.S. Pat. No. 4,513,702. Also, the opening is inclined and overhead cam shaft cannot be driven by a belt.

In the U.S. Pat. No. 6,736,796, the crankcase ventilation system is achieved by providing radial and axial passages in the crankshaft that communicate the crankcase chamber to the intake system. The crankshaft is a load bearing shaft and made of hard steel, as such expensive to drill the passages. Secondly, the passage is always open in the crankcase chamber and likely that the oil can get inside the passage when the engine is stored in different attitudes and the oil eventually may get into the intake system or leak in the air-filter.

In most engines, fuel is mixed with air using a simple carburetor. However, the disadvantages of the carburetor systems are that it needs a manual choke and does not compensate for variation in ambient and operating temperatures. Thus the fuel consumption is higher and hence brake specific emission is higher. There are more advanced electronic fuel systems commonly used in automobiles and some small engines. Prior arts, for example U.S. Pat. Nos. 7,331,315, 7,536,983 and PCT US2007/074982 describe electronic fuel injection system for small two-stroke engines, and they have fuel pumps that depend on engine pulses for pumping the fuel at a certain pressure, thus becomes unreliable as they entirely depend on crankcase pulses. Some engines use electrical or mechanical pumps for delivery fuel at a higher pressure to the injector. Secondly they all use gasoline as fuel. In the prior art U.S. Pat. No. 6,609,509 the fuel used is LPG (liquefied petroleum gas), however, the system is more of a carburetor type than electronically controlled injection system. In the U.S. Pat. No. 7,424,886, the engine described has an LPG tank attached to the engine or the frame and the engine shaft is attached to a generator. The engine described has a carburetor 24, which is likely to leak fuel when the fuel supply line is ON and the engine is not running.

Thus, engine designers are constantly trying to design engines that have less parts, are simpler, and less expensive to manufacture and electronically controlled fuel system.

SUMMARY

An integrally cast four-stroke engine mono-block (10) includes integrally cast cylinder block (20), cylinder head (40), and portion of a crankcase (30) including crankcase outboard and inboard walls (89, 90). At least parts of outer and inner bearing bosses (21*a*, 21*b*) are integrally cast with the cylinder block (20) with the inner bearing boss (21*b*) integrally cast in the inboard wall (90). At least one cored out longitudinally extending open valve train chamber (88) is disposed between the outboard wall (89) and the cast cylinder block (20).

An alternative embodiment of the integrally cast four-stroke engine mono-block (10) includes integrally cast cylinder block (20), cylinder head (40), and portion of a crankcase (30) including crankcase outboard and inboard walls (89, 90) and at least parts of an outer bearing boss (21*a*) and/or an inner bearing boss (21*b*) integrally cast in the outboard and inboard walls (89, 90) respectively with the cast cylinder block (20). At least one cored out longitudinally extending open valve train chamber (88) is disposed between the outboard wall (89) and the cast cylinder block (20).

The integrally cast four-stroke engine mono-block may further include one or more cored out train passages in the valve train chamber (88) such as push tube passages (88*e*) or a belt drive passage (1288*e*). The mono-block may further include an outer ignition boss (1012) integrally cast with the block (10). A portion of an outboard bearing boss (731) such as an upper half (733*b*) of the outboard bearing boss (731) may be integrally cast with the block (10). The mono-block (10) may include a crankcase inboard wall (90) integral with the block (10) and at least portions of outer and inner bearing bosses (21*a*, 21*b*) in the outboard and inboard walls (89, 90) respectively.

Another alternative embodiment of the integrally cast four-stroke engine mono-block (10) includes integrally cast cylinder block (20), cylinder head (40), and portion of a crankcase (30) including crankcase outboard and inboard walls (89, 90) and an outboard wall extension (730). An outboard bearing boss (731) is disposed in the outboard wall extension (730) and first and second bearing bores (723*a*, 723*b* in the outboard and inboard walls (89, 90) respectively. At least one cored out longitudinally extending open valve train chamber (88) is disposed between the outboard wall (89) and the cast cylinder block (20).

An integrally cast four-stroke engine L-head mono-block (10) includes integrally cast cylinder block (20), L-head (1440), and portion of a crankcase (30) including crankcase outboard and inboard walls (89, 90). At least parts of an outer bearing boss (21*a*) and/or an inner bearing boss (21*b*) are integrally cast in the outboard and inboard walls (89, 90) respectively with the cast cylinder block (20). At least one cored out longitudinally extending open valve train chamber (88) is disposed between the outboard wall (89) and the cast cylinder block (20) and the L-head (1440) covers the valve train chamber (88) and a cylinder bore (12) disposed within the cylinder block (20) and spaced apart from inboard wall (90).

An internal combustion four-stroke engine includes a cylinder block (20) integrally cast with a portion of a crankcase (30) including crankcase outer and inner walls extending downwardly from the cylinder block (20) and integrally cast with a cylinder head (40) extending downwardly from the cylinder block (20). The engine further includes inner and outer bearing bosses (21*a*, 21*b*) in the crankcase outer and inner walls respectively, an outboard wall (89) integral with the cast cylinder block (20), at least one cored out longitudinally extending open valve train chamber (88) disposed between the outboard wall (89) and the cast cylinder block (20), a half crankshaft (22) disposed through inner and outer bearings (41, 28) supported within the inner and outer bearing bosses (21*a*, 21*b*) respectively, and a valve train (2) extending through the valve train chamber (88) operably connecting and for transmitting motion from the crankshaft (22) to intake and exhaust valves (98, 99).

The engine may further include a counter-weight (32) mounted on the crankshaft (22) inboard of the inner bearing (41) and the valve train (2) may include push tubes (300) disposed in the valve train chamber (688) and operably associated and ridingly engaged with channels (609) in cam lobes (608) mounted on the half crankshaft (22) between the inner and outer bearings (41, 28).

An internal combustion four-stroke engine L-head engine includes an integrally cast four-stroke engine L-head mono-block (10) including a cylinder block (20) integrally cast with an L-head (1440) and at least portions of a crankcase (30) including crankcase outboard and inboard walls (89, 90). At least parts of an outer bearing boss (21*a*) and/or an inner bearing boss (21*b*) are integrally cast in the outboard and inboard walls (89, 90) respectively with the cast cylinder block (20) and at least one cored out longitudinally extending open valve train chamber (88) is disposed between the outboard wall (89) and the cast cylinder block (20). The L-head (1440) covers the valve train chamber (88) and a cylinder bore (12) is disposed within the cylinder block (20) and spaced apart from inboard wall (90). A half crankshaft (22) is disposed through inner and outer bearings (41, 28) supported within the inner and outer bearing bosses (21*a*, 21*b*) respectively and a valve train (2) extends through the valve train chamber (88) operably connecting and for transmitting motion from the crankshaft (22) to intake and exhaust valves (98, 99). The engine may further include an L-head valve chamber (107) in the valve train chamber (880) and an intake valve assembly (120) for intake and an exhaust valve assembly (120*b*) for exhaust in the L-head valve chamber (107). A passage (502) may be incorporated to connect a carburetor (500) and the crankcase chamber (48) through a connecting passage (127) in the intake valve assembly (120). A one-way valve (128) may be disposed in the passage (502) to prevent flow back through the carburetor (500) into ambient and first and second intake passages (126*a*, 126*b*) connecting the carburetor (500) to the combustion chamber (51) in the cylinder bore (12) through the intake valve assembly (120).

First and second intake passages (126*a*, 126*b*) may be used to connect a carburetor (500) to a combustion chamber (51) in the cylinder bore (12) through the intake valve assembly (120) and a carburetor valve (584) of carburetor (500) having first and second valves (584*a*, 584*b*) may be incorporated to regulate mass flow into the first and second intake passages (126*a*, 126*b*) respectively.

In an alternate fuel mixing system, the conventional carburetor 500 may be replaced by a dual (or a single) intake electronic LPG fuel (9101) injection throttle body 9400, where the first and second intake passages (126*a*, 126*b*) are respectively connected to the secondary intake passage (9480) and primary intake passage (9180) in the throttle body (9102) to connect to a combustion chamber (51) in the cylinder bore (12) through the intake valve assembly (120) and a carburetor valve (9584) of EFI throttle body (9400) having first and second valves (9432, 9162) may be incorporated to regulate mass flow into the first and second intake passages (126*a*, 126*b*) respectively. The EFI throttle body (9400) may have an electronically controlled LPG fuel injector (9138), either in the throttle body 9102 or in the intake passage (126*b*). The single intake electronic fuel injection throttle body (9100) may have a single intake passage (9180), when the over head valve engine (1) and the L head engine (1500) have a single intake passage (126). The pressurized LPG fuel (9101) is supplied from an external pressure regulator (2917), that may be integral to the cylinder block (20). The LPG fuel (9101) is contained in a fuel tank (2007). The timing and amount of fuel (9101) injection is controlled by an ECU (9136), based on the received input signals, such as crank angle position from a crank angle position sensor (9412) through a wire harness 9114, the speed is measured through the same sensor or from the ignition pulses received by the ignition module (9404), intake temperature as measured by the sensor (9146), possibly cylinder block (20) temperature, and throttle position from the sensor 9142.

At least some of the engines (including L head engine) may further include a crankcase cover (1312) covering a crankcase chamber (48) within the crankcase (30) and separating the crankcase chamber (48) and from an oil sump (1348) between the crankcase cover (1312) and the sump wall (1344). A tube (1320) extending between the crankcase chamber (48) and the oil sump (1348) protrudes from the crankcase cover (1312) into the oil sump (1348). Alternatively a pocket wall (1314) surrounding a pocket (1316) protrudes into the oil sump (1348). One or more oil passages (1328) in one or more standoff tubes (1324) may incorporated to protrude from the crankcase cover (1312) into the oil sump (1348). The bottom end of the pocket wall (1314) may be closed but have a small orifice, as described in U.S. Pat. No. 2,959,164.

The internal combustion engine may include a crankcase cover (44) covering a crankcase chamber (48) within the crankcase (30) and a fuel tank (2007) operable for holding liquefied petroleum gas or another compressed gaseous fuel for use in the engine and partially disposed in a recess (45) in the crankcase cover (44). The tank (2007) is spaced slightly apart from and conforms to the recess (45). An injecting tube (101) may be disposed in an intake passage (126) disposed between the carburetor (500) and the crankcase chamber (48). A crankcase cover (44) covering a crankcase chamber (48) within the crankcase (30) may be constructed to accommodate a fuel tank (2007) for holding liquefied petroleum gas or another compressed gaseous fuel for use in the engine. The tank is partially disposed in a recess (45) in the crankcase cover (44) and spaced slightly apart from and conforms to the recess (45).

At least some of the half crank engines may further have an outboard shaft 222 loosely connected to the crank pin (736) through an yoke (1450). The outboard shaft (222) has at least one oil slinger (1234*b*) to splash oil (1340) and generate mist of oil. The out board oil reservoir cover (9310) attached to the crankcase cover (44) and it also encloses the oil slinger (1234*b*). The outboard shaft (222) has an axial passage (808*b*) and a radial passage (809*a*) connecting the oil reservoir (1250) and the crankcase chamber (44). The radial passage (809*b*) has opening (809) that is intermittently opened and closed by a cut out (9042) in the bush bearing (9041). The crankcase chamber (44) has an oil drain port (999*b*) through which the condensed oil drains into an intermediate chamber (9348)and back into the oil reservoir (1250) through an oil return passage (9350). The oil drain port (999*b*) has a non-return valve (999) to intermittently open and close the oil drain port (999*b*). The crankshaft (22) and the counter weight (32) have an axial passage (808*a*) and a radial passage (808*c*) to connect the crankcase chamber (44) to an oil recovery chamber (107*b*), through a oil breather tube (911) and has a check valve (914) at the end of the tube (911). Similar connecting passage may be provided through the cam shaft (298), which as a passage (83). The oil recover chamber is typically part of the air cleaner box (not shown). The oil condensed in the oil recovery chamber (107B) is drawn back into the crankcase chamber (48) through an oil return port (824) in the cylinder bore (12) and the port (824) is intermittently opened and closed by the piston (756). The oil return tube (826) connects the oil recovery chamber (107*b*) to the oil return port (824). The dry crankcase charge collected in the oil recover chamber (107*b*) is inducted into the engine through the breather tube (827). The starter assembly (not shown) and the clutch assembly (not shown) are on the outboard side of the engine coupled to the outboard shaft (22).

The outboard shaft (222) may further have an extension shaft (222*b*) passing through the oil reservoir cover (9310). The extension shaft (222*b*) may further have a starter slot (222*d*) for coupling an external starter.

Further there can be an oil pump (1505) in the oil reservoir (1250). The oil pump (1505) is driven by the outboard shaft (222*b*) has an oil inlet tube (1507) and an outlet tube (1509). The oil pump (1505) injects oil into the crankcase chamber (48).

Further, half crank engine 1800 may have an outboard manual starter (1820) consisting of a starter shaft (222*c*) having a yoke with a 'U' slot (1541) which loosely engages the crankpin 736. Therefore, the outboard shaft does not bear any load coming from the piston due to combustion of fuel-air mixture. The centerline (2927*b*) of the countershaft (222*c*) need not be in line with the center line (2827) of the crankshaft (22). The yoke (1540) is rigidly fixed to one of the end of the starter shaft (222*c*) inside of the crankcase chamber (48), while the other end has the starter cup (1852). The starter shaft (222*c*) is straddle mounted by a bearing (728*b*) on the inboard side and a sealed bearing (928*d*) closer to the starter cup (1852). An oil seal (928*c*) is installed on out board side of the bearing (728*b*) and has space (809) between the oil seal (928*b*) and the outboard bearing (928*d*). The opposite end of the 'U' slot (1541) in the yoke (1450) has a radial passage or a separate tube (not shown) (808*d*) that communicates with the axial passage (808*e*). The radial passage (808*f*) is between the oil seal (928*c*) and the outboard sealed bearing (928*d*). The space (809) has communication with the oil separator chamber (707). The condensed oil in the separation chamber (707) is then fed into the combustion chamber during the intake process. The condensed oil in the separation chamber (707) is returned to the crankcase chamber (48) when the piston (756) opens the oil return port (824). The outboard starter (1870) functions in a commonly known manner. The bearings (728*b*) and the outboard bearing (728*d*) are supported on a boss (731*b*) in the crankcase cover (44). The boss (731*b*) is projected inboard into the crankcase chamber (48) providing a cavity (49) around the boss. The cavity (49) is necessary to keep the oil from entering the radial passage (808*d*) in the yoke (1540) when the engine is stored with outboard starter (1870) downward position. The radial passage (808*d*) may have any one of the type of on-off valves (900) (902) (904) that is normal shut off when the engine (1800) is not running. The valve (900 for example) opens when the engine starts to run. In other words, when the outboard starter shaft (222*c*) starts to rotate above 100 RPM. The Valve (900) is shut closed when the engine is shut off. Therefore the oil in the crankcase chamber (48) prevents the oil from leaking from the crankcase chamber (48) when the engine is stored in any attitude. Different types of valve, for example (900), (902), or (904) and many other equivalent types operate by the principle of centrifugal force, where the centrifugal force, as the engine runs, forces the weight away from the center, thus opening the radial passage (808*d*) at the port (913*b*).

Accordingly, various embodiments provide a new mono-block and engine incorporating the mono-block and an improved method of cylinder manufacturing and assembling the four-stroke engines, particularly, four-stroke engines (applicable to two-stroke engine cylinders as well). A single piece cylinder crankcase block for half and full crank allow for the manufacture and assembly of a lower cost engine. A simpler crankcase for dry sump lubrication can also be used as the dry sump engine/mist lubrication allows engines for any attitude operation when used in hand-held applications.

The low cost simpler four-stroke engine is especially suited for hand-held, lawn and garden equipments such as trimmers, blowers, chainsaws, cultivators, lawn mowers, compressor engines, and generator engines. The method manufacturing the cylinder block is simplified.

Conventional four-stroke engines have cam shaft and reduction gear for running the cam lobes at half the crankshaft speed to operate the intake and exhaust valves only once every two rotations of the crankshaft speed. However, in the mono-shaft engine, the cam lobe is either integral with the counter-weight or a separate piece mounted on the crankshaft in a chamber between the bearing bosses.

The mono-block engine reduces the number of parts, particularly, the half-crank engine and simplifies the method of assembling the full crank engine. Further, the engine design disclosed here is applicable to a full crank engine, where in both the outer and inner main bearing bosses are cast in as a single piece, but has a new assembly procedure.

Some four-stroke engines have a breather system for discharging excessive blow-by gases through the cam shaft, particularly, in the case of push tube type valve train system. The cam shaft, in this case, is substantially parallel to the crankshaft and is mounted between the cylinder head and the crankshaft. The breather passage is in the cam shaft and it can be a stationary shaft, where the cam gear and lobe are rotating on the shaft. Further, there can be a breather passage in the crankshaft connecting the chamber to the ambient (instead of breather passage in the crankshaft).

The compact mono-block design as disclosed for an L-head engine provides a significant advantage when an LPG fuel tank is attached to the crankcase cover.

Further, in developing countries and remote areas in the US, the LPG is commonly used as a cooking gaseous fuel. In most cases the LPG fuel is stored in a tank at significantly higher pressure of the order of 50 psi or so. In the US most residents have compressed natural gas as fuel for cooking and are supplied to residents through a pipe line. The following explains an LPG or a gaseous fuel injected portable generator using the residential gaseous fuel commonly used for cooking and heating. The advantage with the gaseous fuel injected engine is that the fuel supply line need not be turned off when the engine is not running, as the leak rate is almost zero in a gaseous fuel injected system compared to a gaseous fuel carburetor. The engine 2000 has generator magneto wheel (2029) mounted on the in board crankshaft 22. The magneto has magnets (2406 on the inside periphery of the magneto wheel (2029). The generator coils (2040) are mounted on a plate (2042), which is stationary and mounted on to the crankcase (30). The fuel supply system (2002) has an LPG fuel tank (2207) supplying gaseous fuel to a gas stove (2060) through a pressure regulator (2919) and a fuel line (2062). The fuel supply line (9126) to the engine throttle body is 'T'd off of the main fuel line (2062). Typically, the engine can be cranked for starting using an electric starter, as described earlier or by hand cranking. The advantages with LPG injected fuel system for a portable generator (2000) are that the fuel system has very minimum maintenance and fuel does not have to be shut off. Secondly, fuel that is already used for cooking can be used for the power generator engine as well. The electric starter can be powered by a battery, which is trickle charged by the generator. The Power generator in a residence is typically used as a electricity backup system for emergency.

BRIEF DESCRIPTION OF THE DRAWINGS

FIG. 9*bb* is a cross-sectional side view illustration of a mono-block having integrally cast cylinder block, crankcase, cylinder head, and bearing boss in the engine illustrated in FIG. 7.

DETAILED DESCRIPTION

Figure 1:
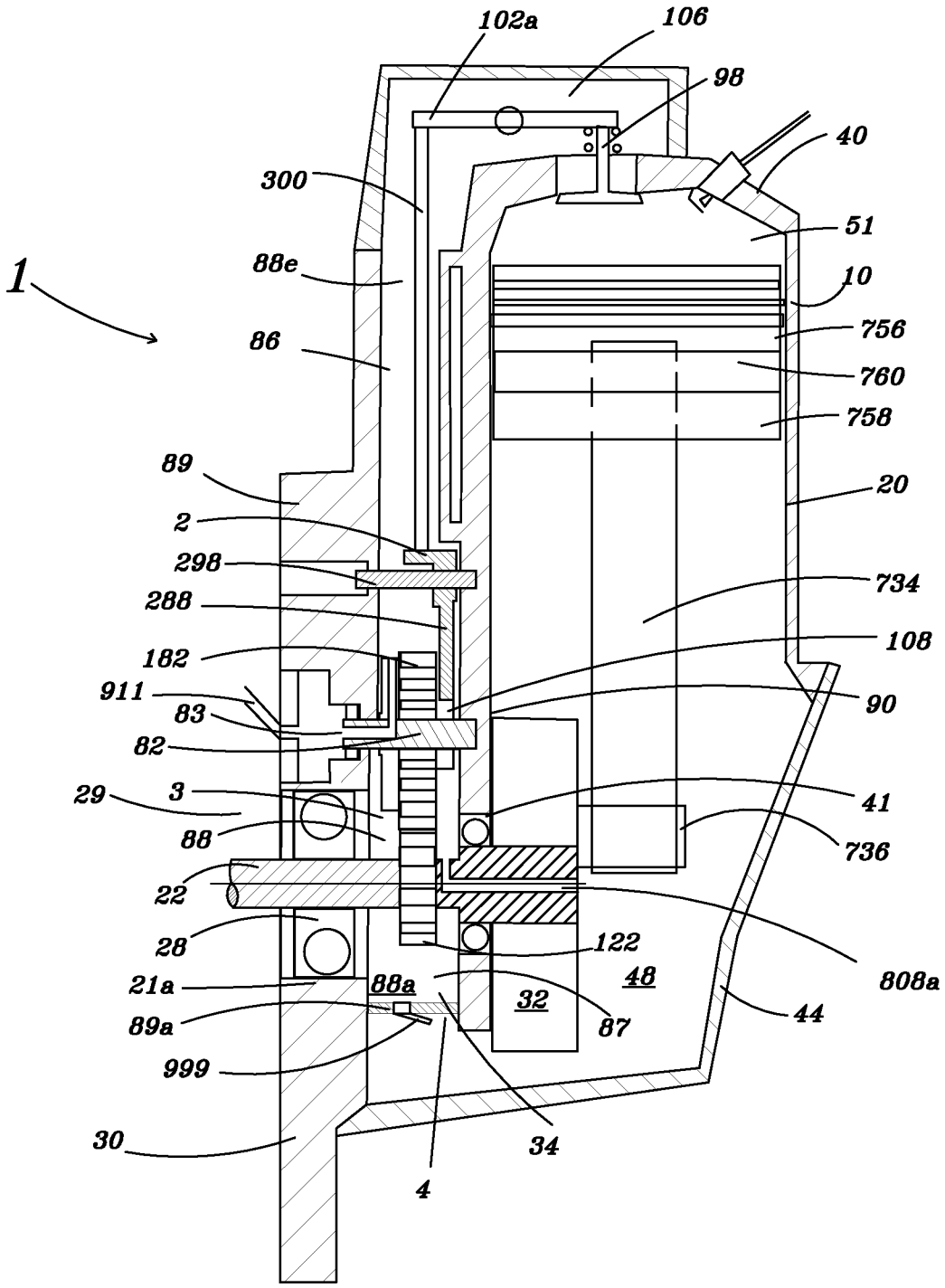
FIG. 1 is a cross-sectional side view illustration of an exemplary embodiment of a half-crank mono-block four-stroke engine with a push tube valve train where the cam chamber is plugged at its bottom.

FIGS. 1, 1*b*, 1*c*, and 1*d* illustrate an exemplary embodiment of a half-crank mono-block four-stroke engine 1 with a push tube valve train 2 and a cam chamber 3 plugged at its cam chamber bottom 4. The engine 1 includes a one half-crank mono-block 10 having a longitudinally extending cylinder block 20 surrounding a cylinder bore 12, a crankcase 30, and cylinder head 40 all integral as a mono-block as further illustrated in FIG. 1*b*. The crankcase 30 includes integrally cast crankcase outboard and inboard walls 89 and 90 which are integrally cast with the cylinder block 20. The crankcase 30 includes outer and inner bearing bosses 21*a* and 21*b* in the crankcase outboard and inboard walls 89 and 90 respectively configured to support a half crankshaft 22. The inner bearing boss 21*b* supports an inner bearing 41 closest to a counter-weight 32 on the crankshaft 22. The counter-weight 32 is inboard of the inner bearing 41. An outer bearing 28 is supported by the outer bearing boss 21*a* on a flywheel side 29 of the outboard wall 89 of the crankcase 30 which includes at least a portion of an outer frame 25 of the crankcase 30. The outer frame 25 is spaced apart from the cylinder block 20. A piston assembly 756 disposed within the cylinder bore 12 includes a generally cylindrical piston 758 and a connecting rod 734 connected to the piston 758 by a piston pin 760. A crank pin 736 operably connects the connecting rod 734 to the counter-weight 32 on the crankshaft 22. In a full crank engine, an outer oil seal may replace the outer bearing.

The outer frame 25 may be designed either for a reverse or forward air flow. Reverse air flow is where the frame has openings around the outer circumference for flow of air from behind the engine and forward air flow has openings in the front housing for flow of air. The combination of forward and reverse air flow has openings in the frame 25 as well as in the front housing for flow of air. A longitudinally extending open valve train chamber 88 disposed in the mono-block 10 between the outboard wall 89 and the cylinder block 20, a lower opening 88*a* at a lower end 87 of the valve train chamber 88 that may be closed with a cover 89*a*, if necessary, or may be open to a crankcase chamber 48. The frame 25 extends down from the outboard wall 89 and at least a portion of the frame 25 is integrally cast with the outboard wall 89. A top end 86 of the valve train chamber 88 located near the cylinder head 40 is open to allow the valve train 2 to transmit motion from crankshaft 22 to an intake valve 98 and to an exhaust valve (not illustrated) which is behind the intake valve 98.

Figure 1B:
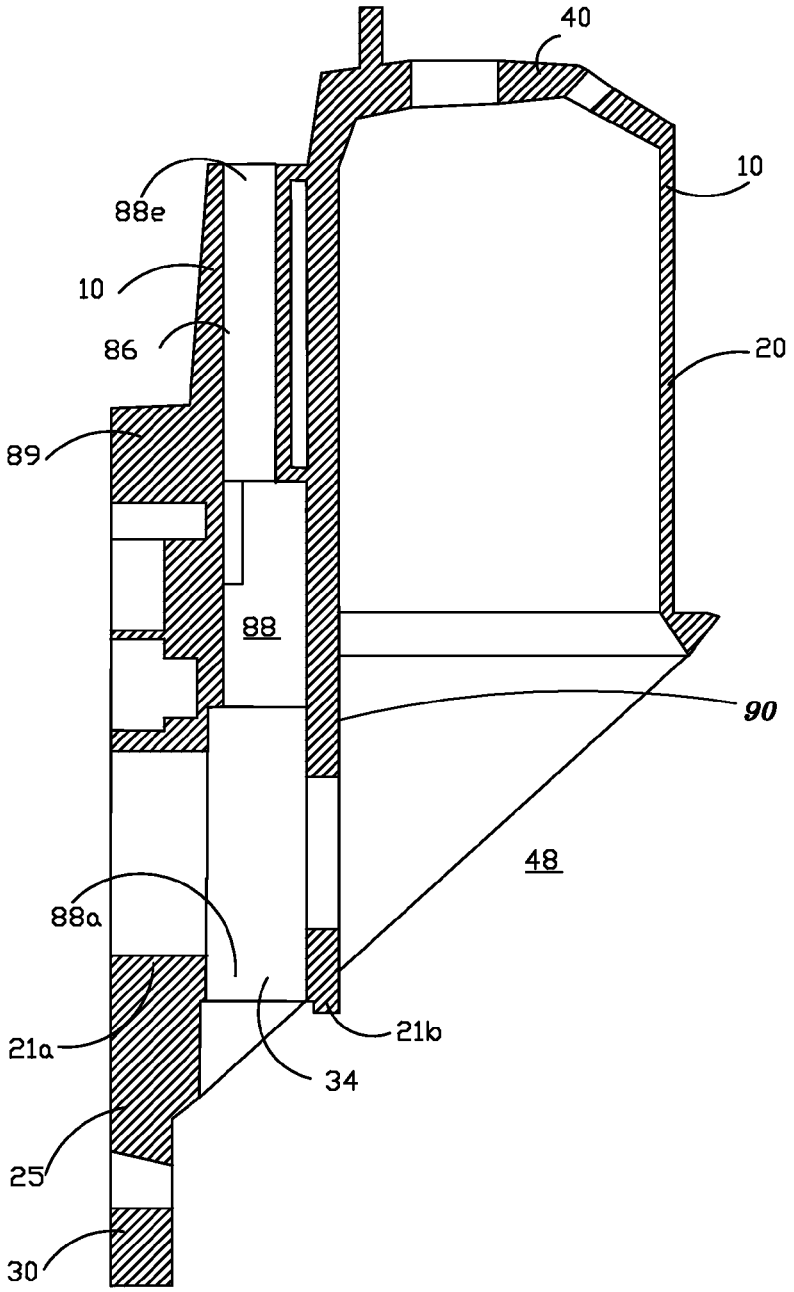
FIG. 1*b* is a cross-sectional side view illustration of a mono-block having integrally cast cylinder block, crankcase, cylinder head, and outer and inner bearing bosses in the engine illustrated in FIG. 1.
Figure 1C:
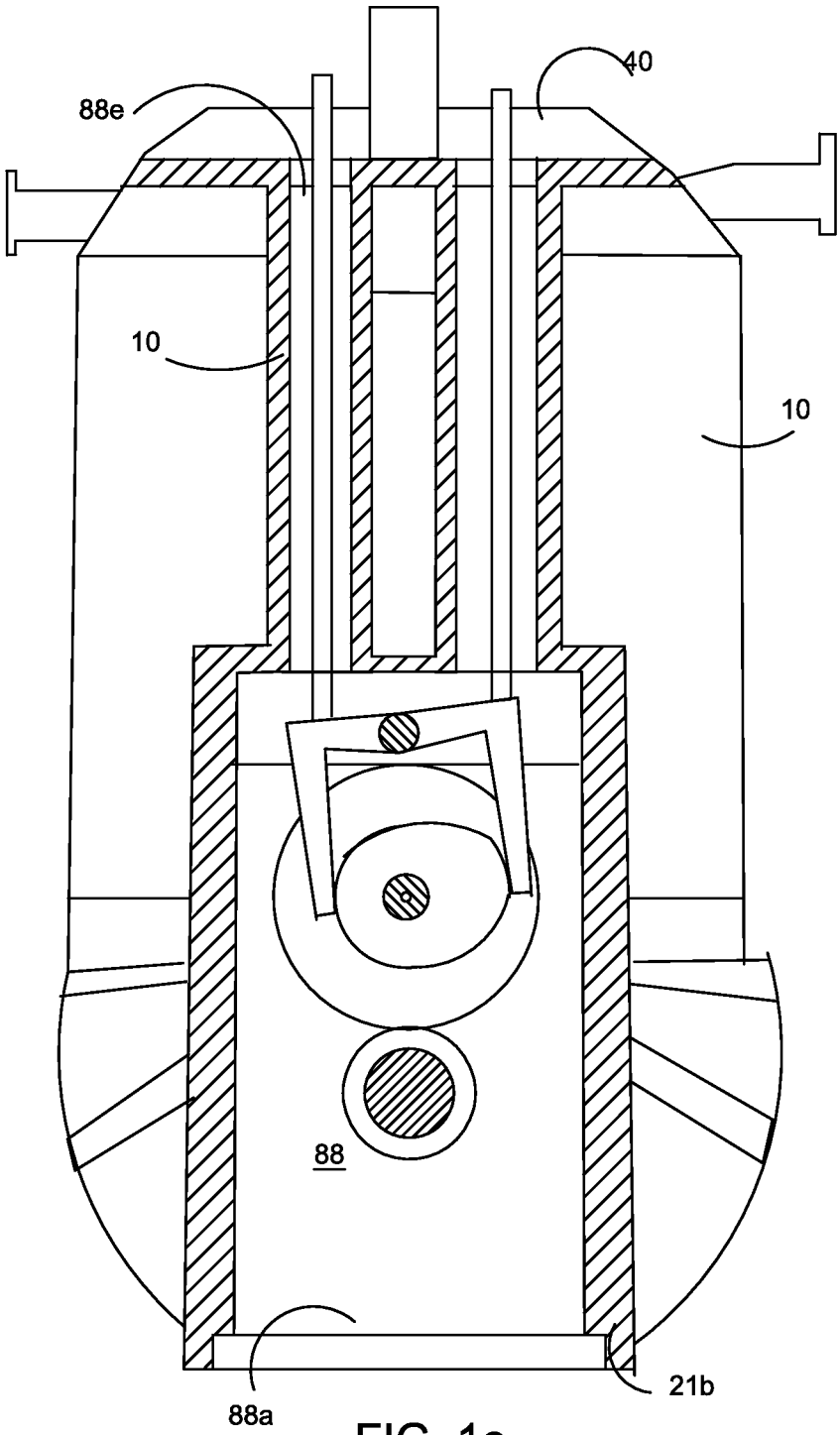
FIG. 1*c* is a cross-sectional front view illustration of the engine illustrated in FIG. 1.
Figure 1D:
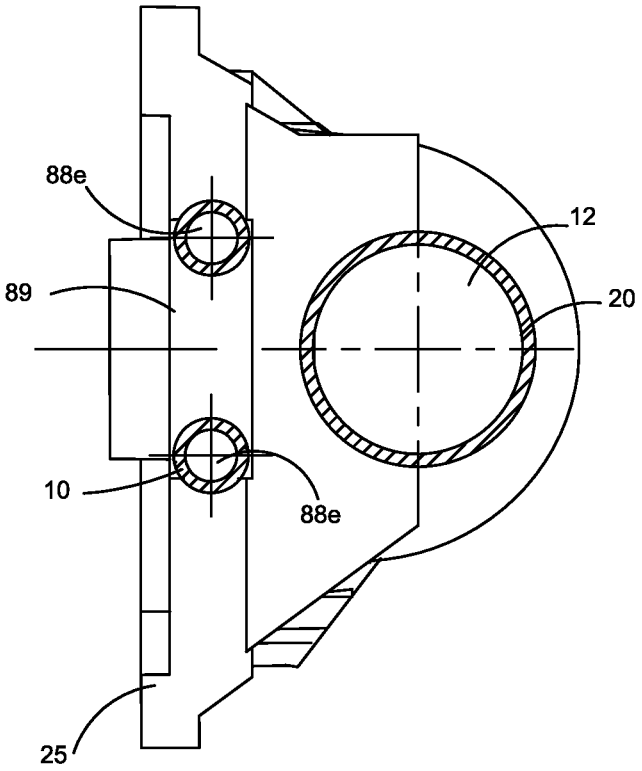
FIG. 1*d* is a cross-sectional top view illustration of the engine illustrated in FIG. 1.

The intake valve 98 and the exhaust valve are in a valve chamber 106 and a spark plug 40*b* mounted in the cylinder head 40 extends into a combustion chamber 51 defining an upper portion of the combustion chamber 51. The valve train 2 includes cam gear 182, cam lobe 108, followers 288, and push tubes 300 (also referred to as push rods). The valve train chamber 88 houses crank gear 122 and cam gear 182 with the followers 288. The valve train chamber 88 is formed, such as by casting, so that there is at least one slot 34 between the outer bearing boss 21*a* and the inner bearing boss 21*b* at the lower end of the valve train chamber 88. The slot 34 illustrated in FIGS. 1 and 1*b* is the lower end 87 of the valve train chamber 88.

The valve train chamber 88 is cored out using a slide in casting tool. The push tubes 300 may be disposed in one or more train passages such as push tube passages 88*e* in the valve train chamber 88. The train passage may also be a belt drive passage 1288*e* illustrated in FIG. 12. It may also be possible to core out part of push tube passages 88*e* and/or the belt drive passage 1288*e* in the valve train chamber 88, together with the entire valve train chamber 88. Thus, the mono-block 10 allows coring out of the valve train chamber 88 or belt drive passage 1288*e* from the crankcase chamber 48 to form a single piece block without any additional cover piece or machining process.

Figure 12:
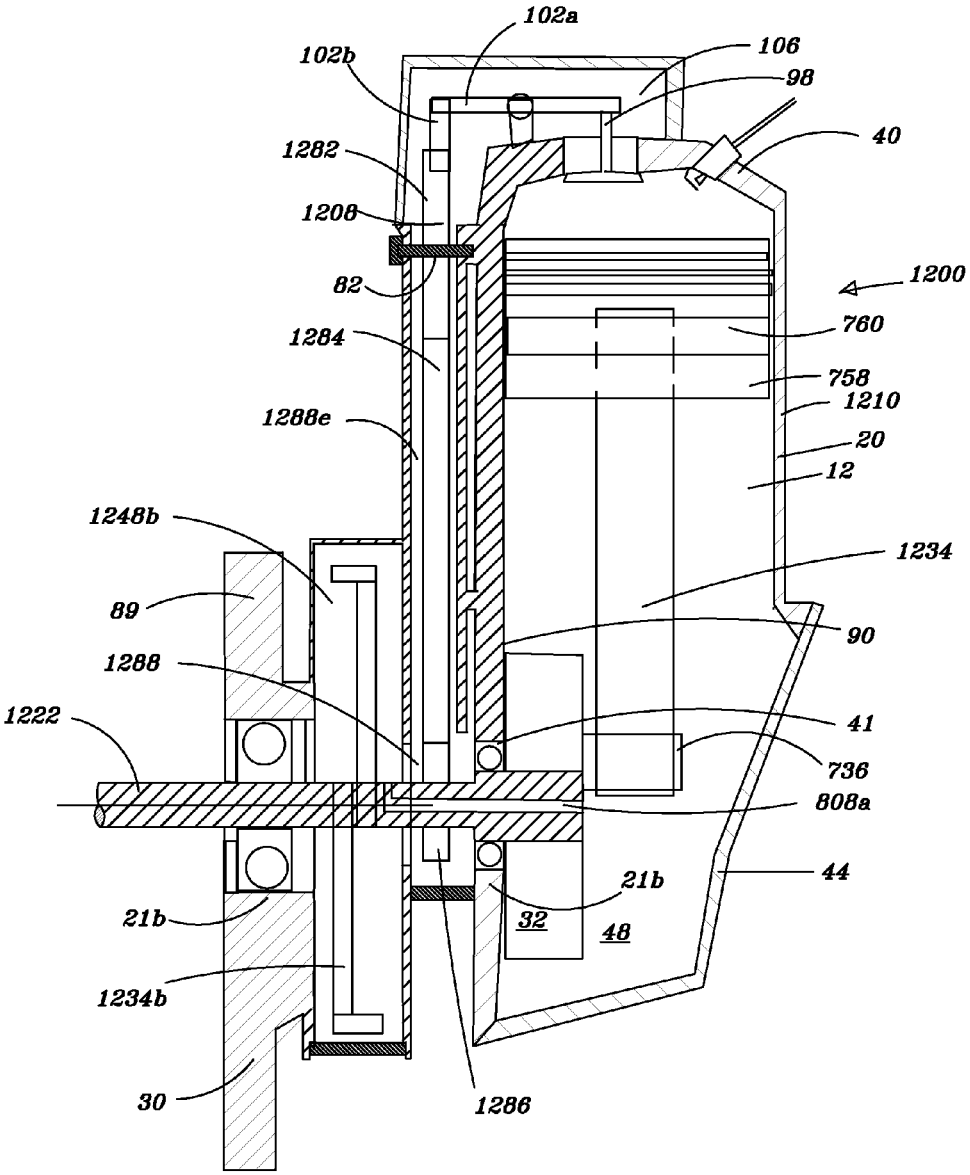
FIG. 12 is a cross-sectional side view illustration of another embodiment of the mono-block four-stroke engine with a belt driven overhead cam and an oil chamber and a slinger.

The top end 86 of the valve train chamber 88 may be open to the overhead valve chamber 106 through the cast in push tube passage (or passages) 88*e* or may be just open for a dry type belt drive as illustrated in FIG. 12 or a passage for the wet type belt drive to drive the overhead cam shaft through a cam gear or a pulley as the case may be.

Figure 4:
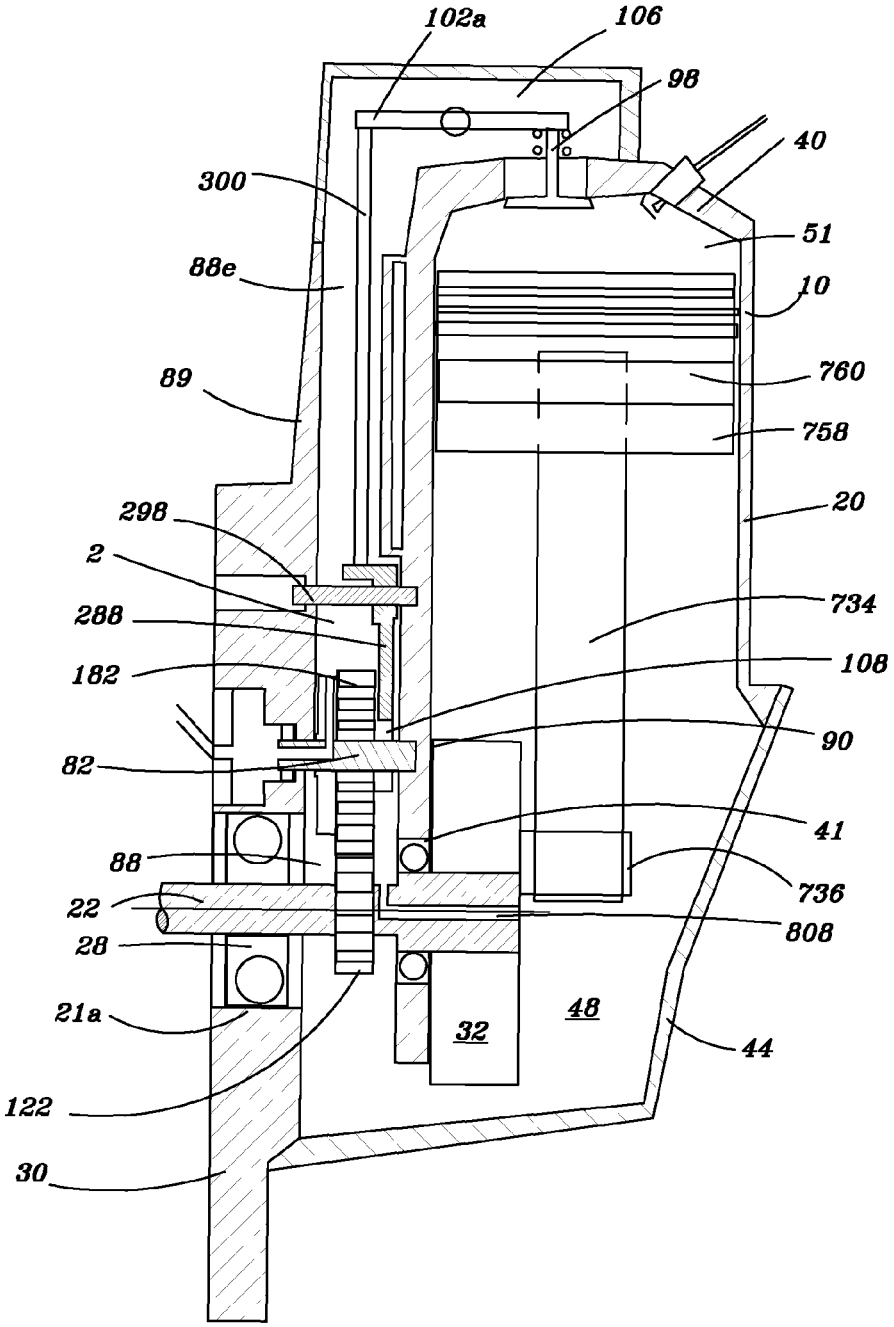
FIG. 4 is a cross-sectional side view illustration of a second exemplary embodiment of a half-crank mono-block four-stroke engine with a push tube valve train where the cam chamber is open at its bottom and the cam chamber and crankcase chamber are in communication through a cut-out passage.
Figure 5:
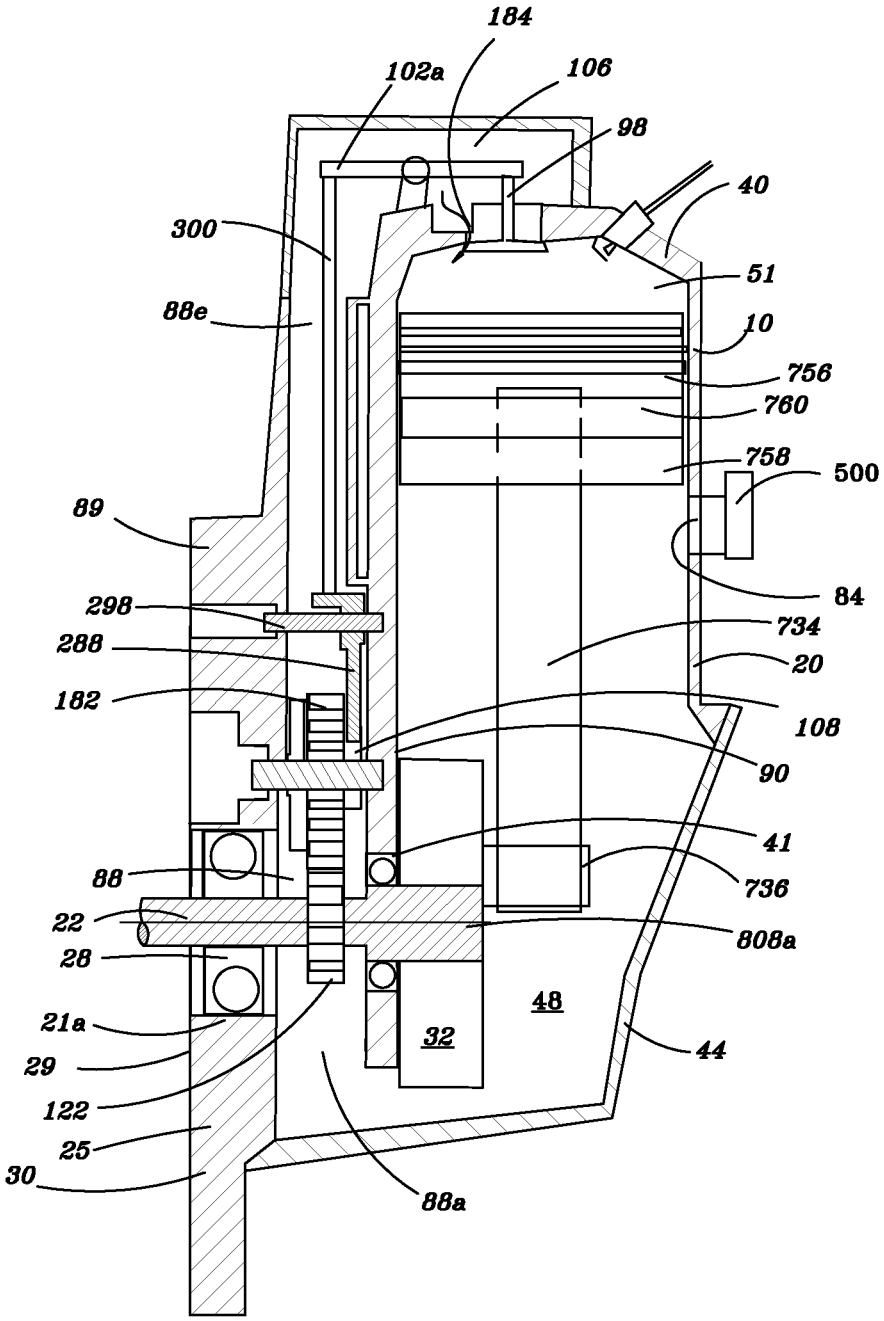
FIG. 5 is a cross-sectional side view illustration of a third exemplary embodiment of a half-crank mono-block four-stroke engine with a carburetor for supplying pre-mixed lubrication and air-fuel mixture.
Figure 5B:
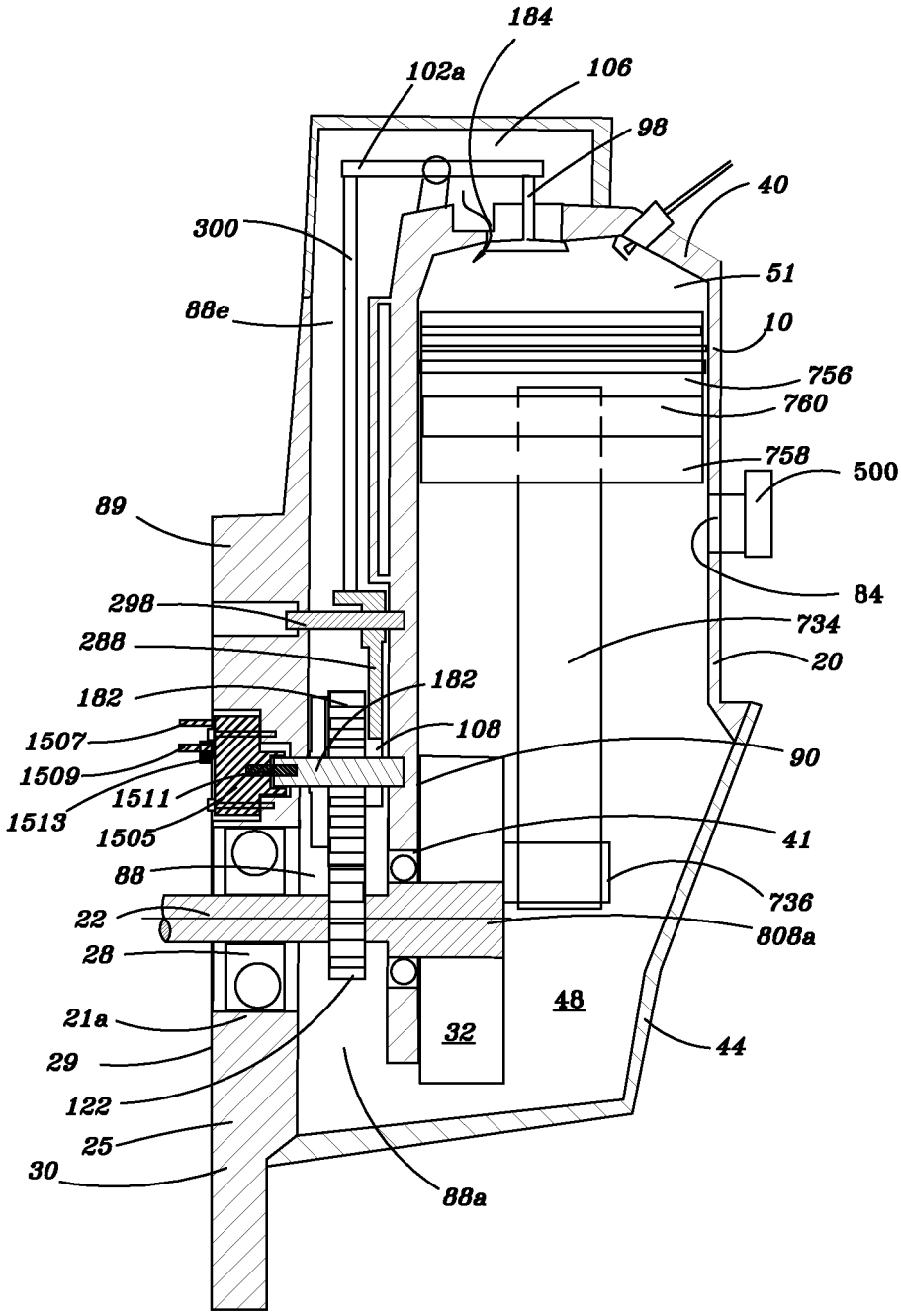
FIG. 5*b* is a cross-sectional side view illustration of another exemplary embodiment of a mono-block four-stroke engine with a cam shaft driven oil pump.

An embodiment of the engine 1 illustrated in FIGS. 4, 5 and 5*b* includes a single continuous valve train chamber 88 extending between the crankcase chamber 48 and the overhead valve chamber 106 (or overhead cam chamber if belt driven). The valve train chamber 88 is a single continuous passage from the crankcase chamber 48 to the valve chamber 106 without any other additional piece attached as a cover to provide an enclosed passage and no separate push tube passages 88*e*. FIG. 5 illustrates how the air-fuel mixture may be supplied into the crankcase chamber 48 through a port 84 in the cylinder block 20 by a carburetor 500. The function of the piston ported intake system is similar to a commonly used two-stroke engine. However, the lube oil mixed charge enters a crankcase chamber 48 and flows into a combustion chamber 51 through an intake valve 98. The intake system may be similar to any standard intake system, such as reed valve or rotary valve system. The mixture enters the valve train chamber 88 through the opening 88*a* from the crankcase chamber 48 and into valve chamber 106 and into the combustion chamber 51 through a passage 184 between the valve chamber and the combustion chamber 51 when the intake valve 98 is opened.

A cam shaft 82 driven oil injection pump 1505 illustrated in FIG. 5*b* is used for injecting oil into a first intake passage 126*a* or crankcase chamber 48. The oil injection pump 1505 is coupled to the cam shaft through a coupler or a gear system 1511. The oil injection pump may use a pressure sensor 1513 to kill the engine when oil pressure in the outlet 1509 falls below a predetermined value to prevent the engine from seizure.

Figure 6:
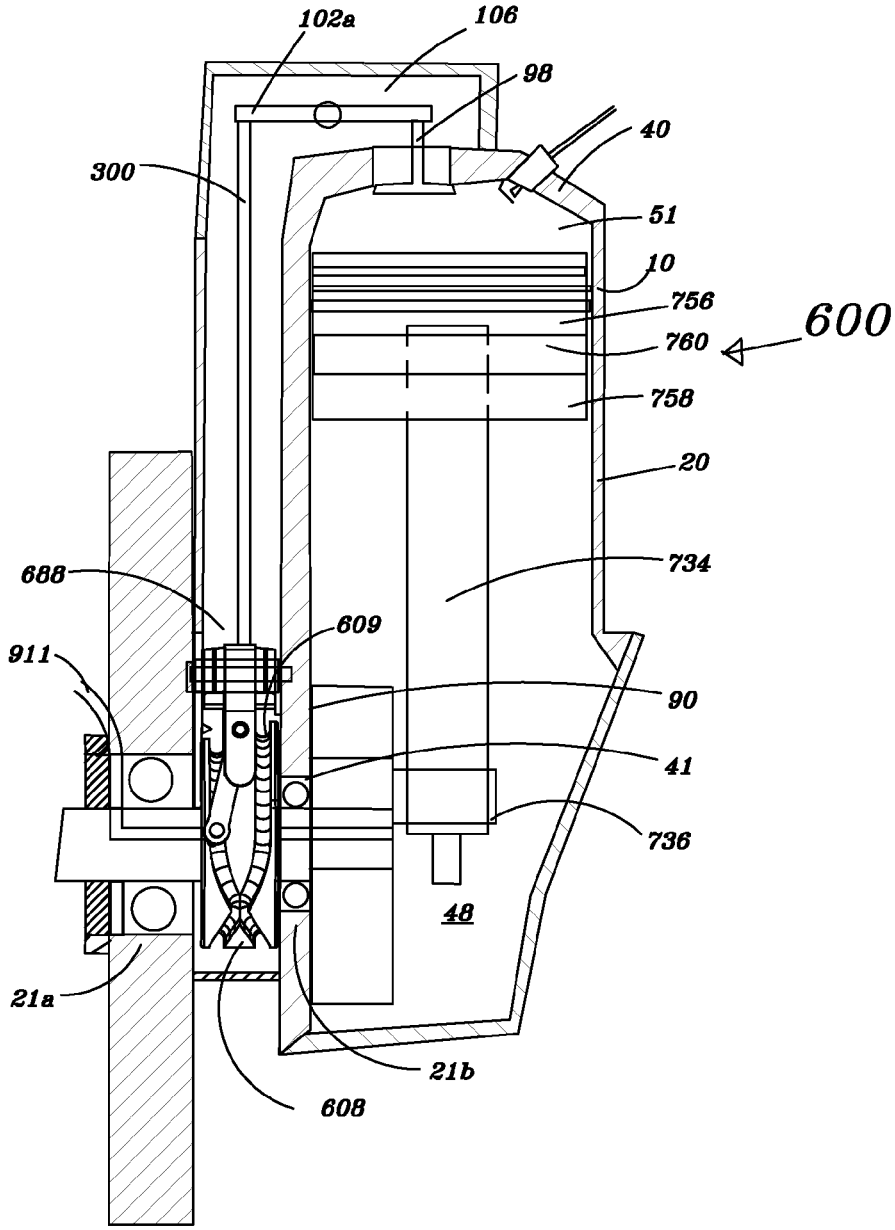
FIG. 6 is a cross-sectional view illustration of another embodiment of the mono-block four-stroke engine with a cam lobe between inner and the outer bearing bosses.

Illustrated in FIG. 6 is an alternative embodiment of the engine 600 that is similar in construction to the engine 1 in FIG. 1, except the engine 600 has cam lobes 608 mounted on the cam shaft and channels 609 in the cam lobes 608 similar to U.S. Pat. No. 7,000,581. The construction and functionality of the engine 600 is similar to the prior art. However, FIG. 6 shows where the cam lobe 608 is between the inner and the outer bearing bosses 21*b*, 21*a* respectively. As shown in FIG. 6, the engine 600 has push tube type valve train. A valve train chamber 688 is similar to valve train chamber 88 in engine 1 where the lower end of the chamber 88 may be open to the crankcase chamber 48 as shown in FIG. 5 or may be closed as shown in FIG. 1. The push tubes 300 are disposed in the valve train chamber 688 and operably associated and ridingly engaged with channels 609 in the cam lobes 608 mounted on the half crankshaft 22 between the inner and outer bearings 41, 28.

Figure 3:
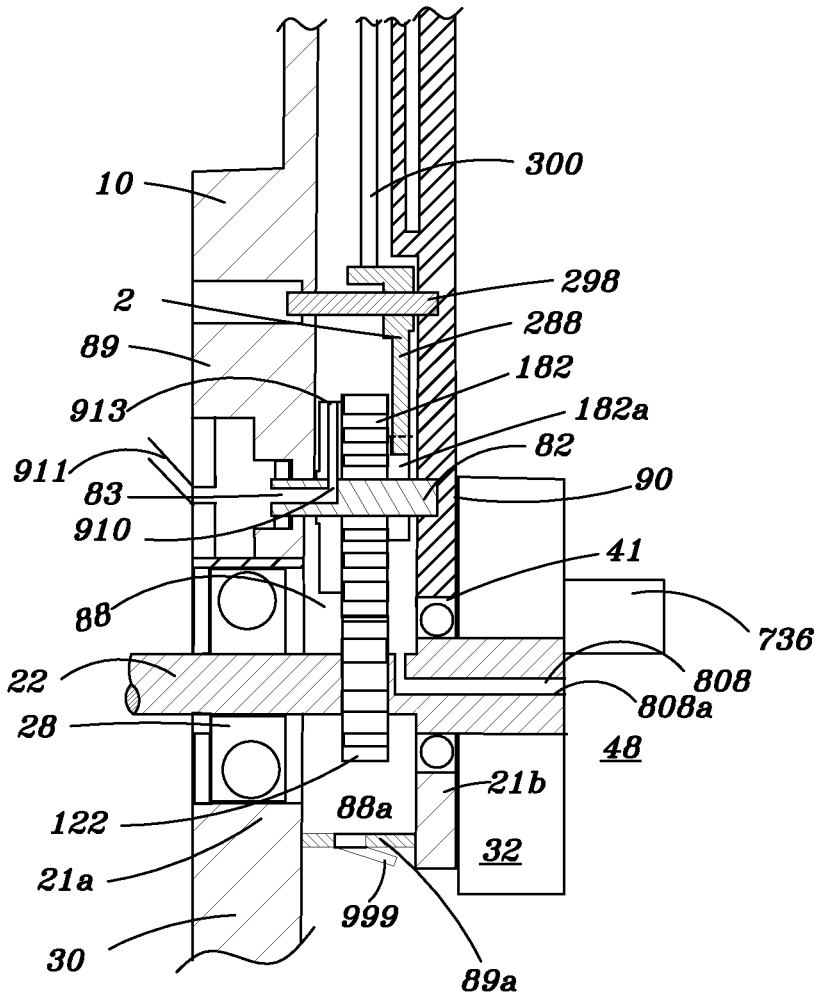
FIG. 3 is an enlarged cross-sectional front view illustration of a cam chamber with a breather passage in a cam shaft of the engine illustrated in FIG. 1.

FIG. 3 illustrates a cam assembly 182*a* including a cam shaft 82 and a cam gear 182. A breather system includes a breather passage 910 through the cam shaft 82 that connects a breather tube 911 to the ambient to a hole 913 to the inside of the engine to relive the crankcase chamber pressure built-up due to blow-by gases. The breather passage 910 and its function are similar to the expired U.S. Pat. No. 6,502,565.

Lubrication of the push tube valve train 2 is achieved by providing an oil passage 808 through the center of the crankshaft 22 that runs axially from the crankcase chamber 48 and then radially to the valve train chamber 88. Unlike breather passages disclosed in U.S. Pat. Nos. 6,039,020 and 6,047,678, the purpose is to supply a small amount of oil from the crankcase chamber into the valve train chamber 88, which in turn lubricates the valve train 2. The lower opening 88*a* is closed and there may be an oil seal in the inner bearing boss 21*b* or the inner bearing 41 could be a sealed bearing that prevents direct flow of oil from crankcase chamber into the valve train chamber 88.

The small amount of oil that gets on the cam gears 182 and the crank gear 122 is splashed to help lubricate the intake valves 98 and rockers 102*a*. Oil condensed in the valve train chamber 88 is returned to the crankcase chamber 48 through a check valve 999 on the cover 89*a*, which opens when the crankcase chamber pressure drops as the piston assembly 756 moves upward. Other types of valves may be used. The opening 88*a* may be used for many purposes such as described above to have a check valve for return of oil from the valve train chamber 88 to crankcase chamber 48, or can be used to have a oil pump as illustrated in FIG. 12*c* or for a rotary valve between the valve train chamber 88 and crankcase chamber 48 or a rotary check valve for supply and or return of lubricating oil when a separate reservoir for oil is used. In conventional engines, oil that escapes through the breather passage is collected in a separation chamber shown) and then returned to the crankcase chamber through a check valve. The oil passage 808 through the crankshaft disclosed herein prevents oil from flowing into the valve train chamber 88 and subsequently into the breather or valve chamber 106 when the engine is stored in almost any attitude because the inlet 808*a* is always above the oil level.

Figure 2:
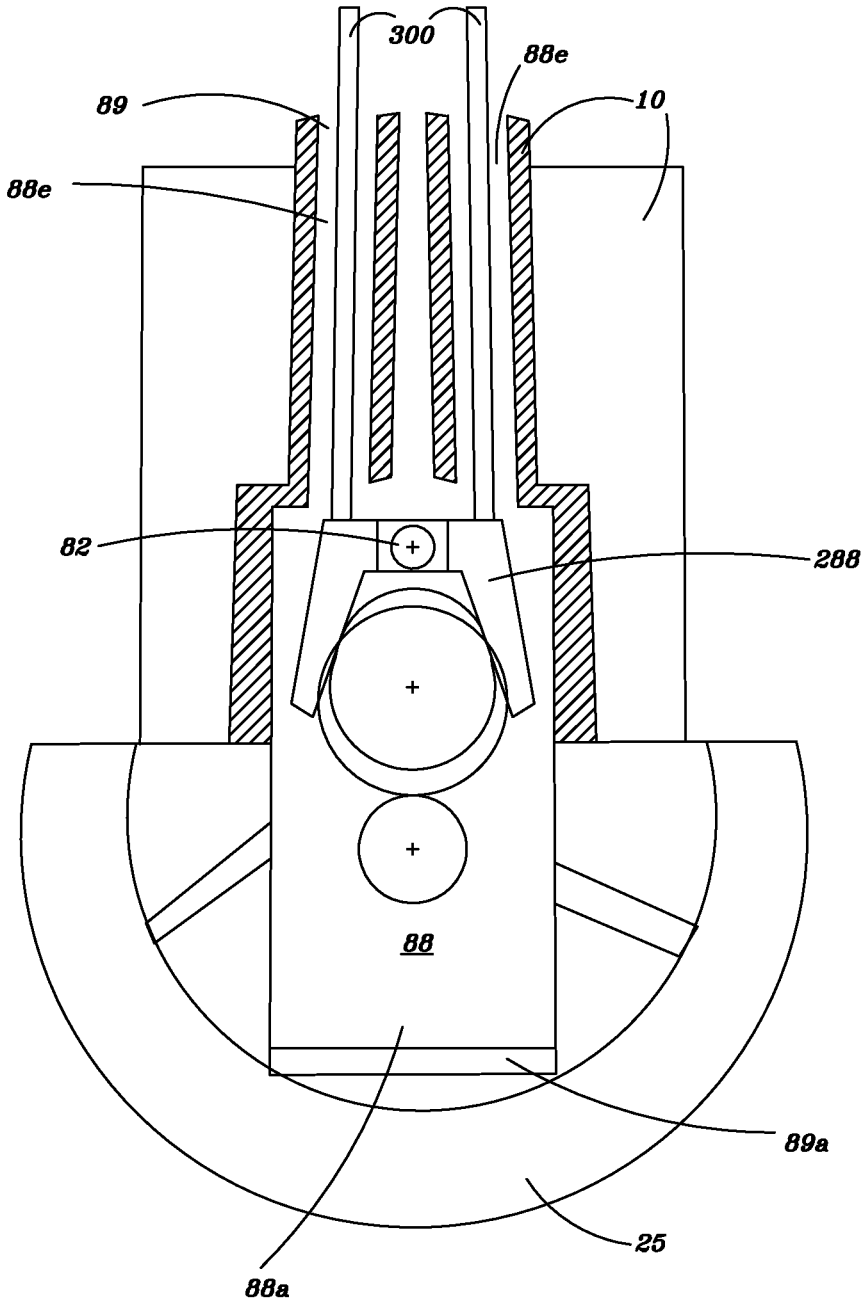
FIG. 2 is a cross-sectional front view illustration of the engine illustrated in FIG. 1.
Figure 7:
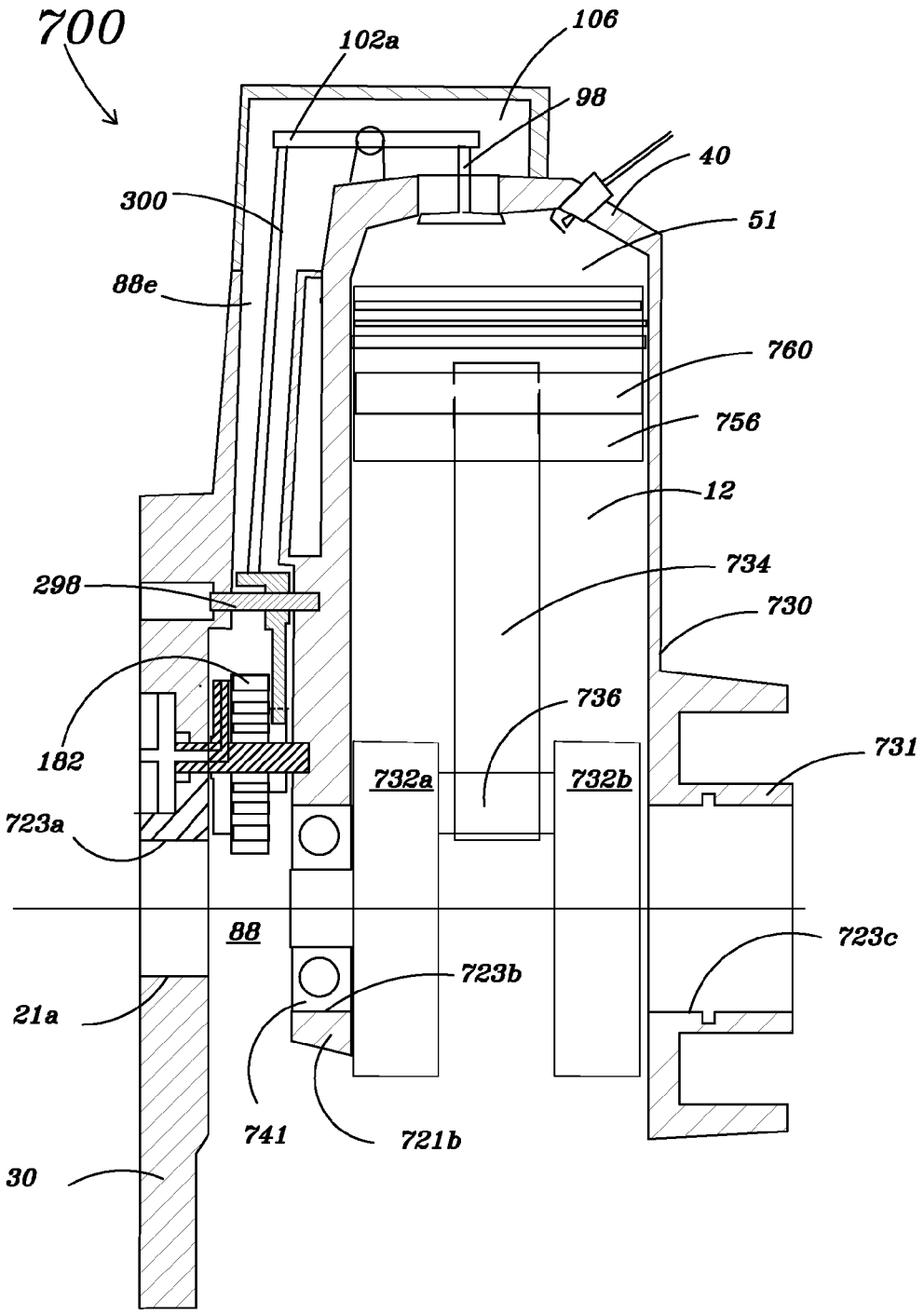
FIG. 7 is a cross-sectional view illustration of another embodiment of the mono-block four-stroke engine with a full crank and a single block to support the full crankshaft.
Figure 8:
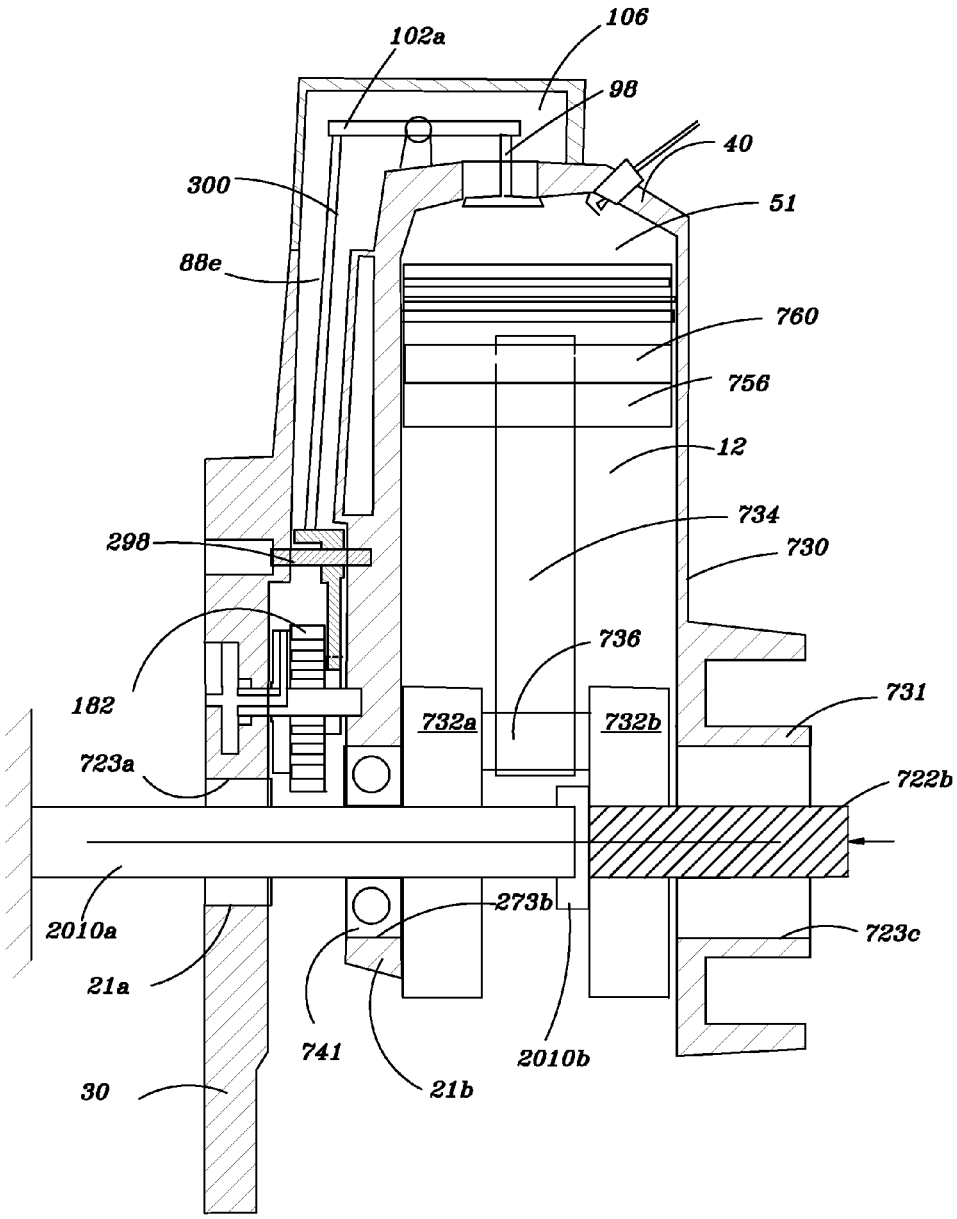
FIG. 8 is a cross-sectional view illustrating an outboard shaft being pressed into a counter-weight in the engine illustrated in FIG. 7.
Figure 9:
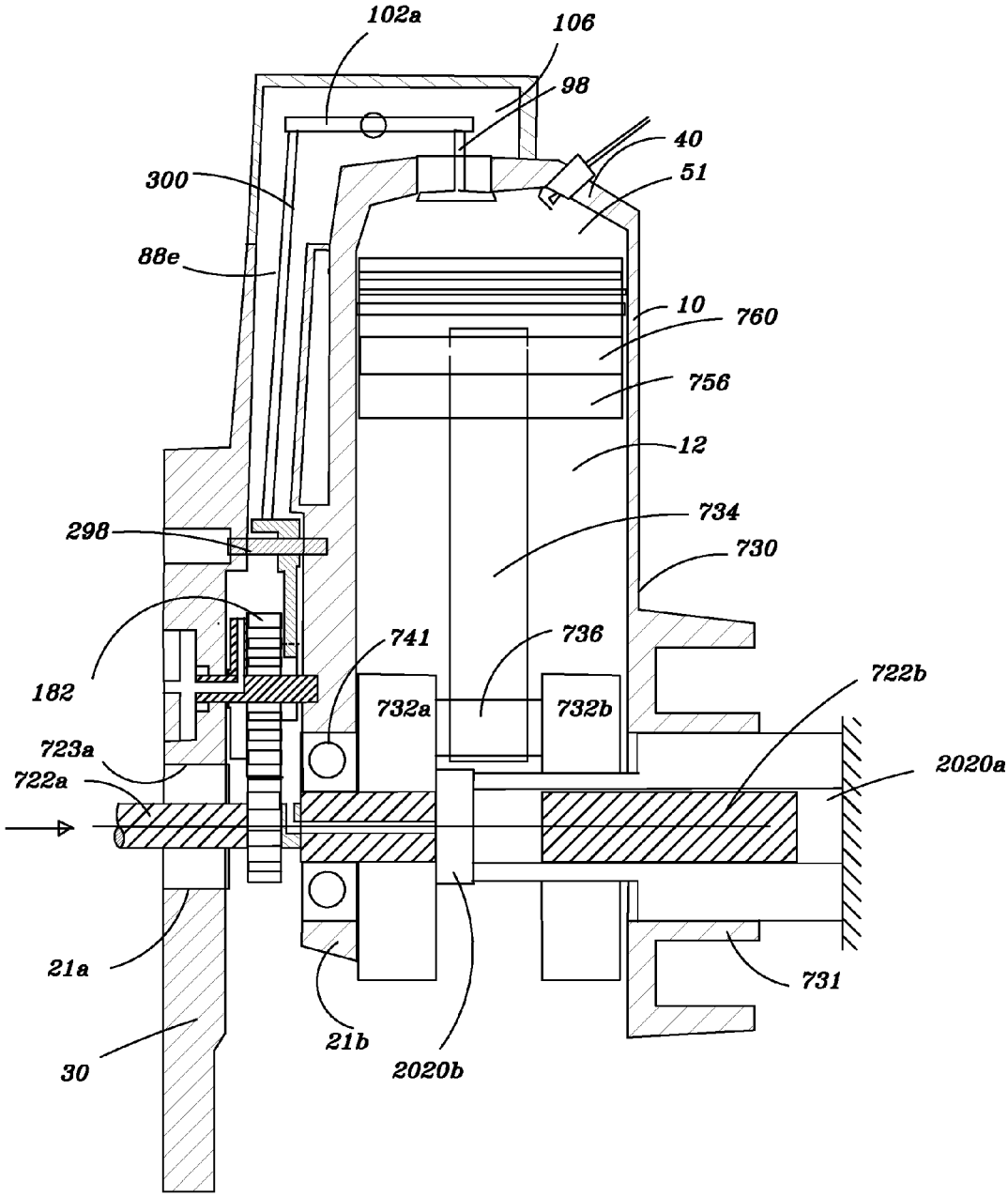
FIG. 9 is a cross-sectional view illustrating main shaft being pressed into the counter-weight in the engine illustrated in FIG. 7.

A full crank engine 700, illustrated in FIGS. 7-9, is similar in construction to engine 1, illustrated in FIGS. 1-3. The full crank engine 700 includes an outboard bearing boss 731 in an outboard crankcase wall extension 730 of the cylinder block 20. The crankcase 30 includes integrally cast crankcase outboard and inboard walls 89 and 90 which include first and second bearing bores 723*a* and 723*b* and are integrally cast with the cylinder block 20. The first and second bearing bores 723*a* and 723*b* and the outboard bearing boss 731 supports a full crankshaft 722 which includes inboard and outboard crankshaft halves 722*a* and 722*b*. In most conventional full crank engines, the crankcase is split into two crankcase halves either vertically in line with the central line of the cylinder bore 12 or at an angle as in U.S. Pat. Nos. 6,439,215 and 6,250,273 or horizontally along the axis of the crankshaft as in U.S. Pat. Nos. 6,332,440, 6,021,766, and 5,947,075. The disadvantage is that the two crankcase halves are first assembled together first in order to machine the bearing bore and then detached for final assembly. Typically, the two crankcase halves stay as pairs. The embodiment of the engine 700 shown in FIGS. 7-9 has a single cylinder block 20 to support the full crankshaft 722. First, second, and third bearing bores 723*a*, 723*b*, and 723*c* may be machined at the same time concentric to each other as well as perpendicular to the cylinder bore 12 and with better quality control. The alignment of the front and rear bearings are also better. Alternatively, an upper half 733*b* of an outboard bearing boss 733*a* may be integral with the cylinder block 20 while a lower half 733*c* of the outboard bearing boss 733*a* may be part of the crankcase cover 744 as illustrated in FIG. 9*c*.

Assembly of the inboard and outboard crankshaft halves 722*a*, 722*b* will be different than the conventional methods. A method of assembling the cam shaft 82, cam gear 182, and the followers 288, as illustrated in FIGS. 1 and 3, includes pressing the cam shaft 82 into the cylinder block 20 through a hole 83. The cam shaft 82 may be free to rotate in the hole 83 in the cylinder block 20 when the cam shaft 82 is pressed into the cam gear 182 and the lobe 108. Alternatively, the cam shaft 82 may have an interference fit within the hole 83 in the cylinder block 20 while the cam gear 182 and the lobe 108 are rotating on the cam shaft 82.

Figure 11:
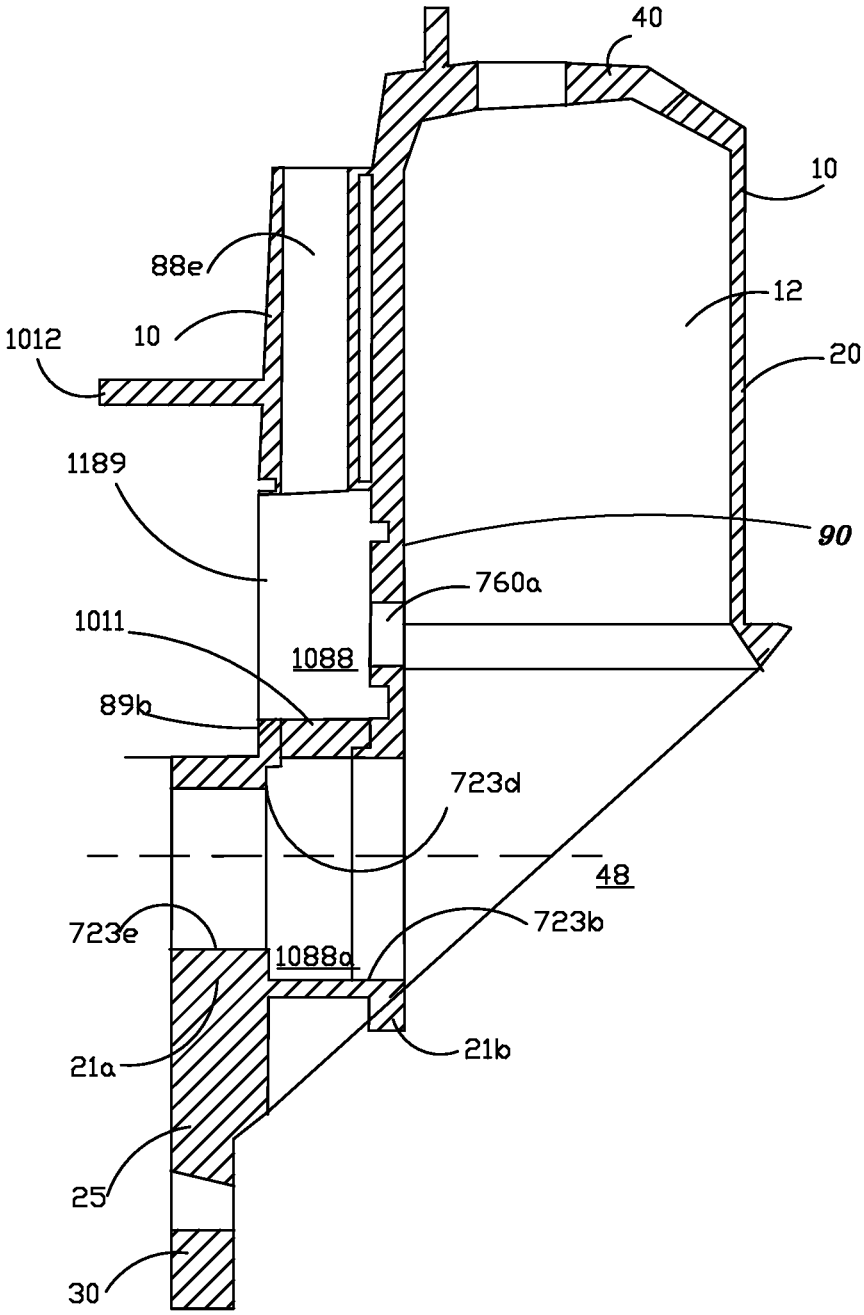
FIG. 11 is a cross-sectional side view illustration of a front part of a cam chamber closed with separate cam cover.

A method of assembling the full crank engine 700 with integral bearing bosses includes assembling first and second counter-weights 732*a*, 732*b*, installing crank pin 736 through the first and second counter-weights 732*a*, 732*b*, connecting rod 734, as illustrated in FIG. 9. The second counter-weight 732*b* may be just a yoke for an outboard starter in case of a simulated full crank. The counter-weight assembly procedure may also include installing the piston pin 760 through the piston assembly 756 and the connecting rod 734 of the piston assembly 756. However, it is also possible to assemble the piston assembly 756 separately to the connecting rod 734 after the crankshaft has been installed. It is done by inserting the piston pin 760 through a hole placed in the cylinder block 20 as done in the case of some Briggs and Stratton engines. Alternatively, as illustrated in FIG. 11, the hole 760*a* in the cylinder block 20 for inserting the piston pin 760 may be located in the valve train chamber 88.

Referring to FIG. 7, step 1 of the method for assembling the full crankshaft 722 includes, with an inner bearing 741 already pressed into the bearing boss 721*b*, inserting the piston assembly 756 and the connecting rod 734 into the cylinder bore 12. Then aligning the first and second counter-weights 732*a* and 732*b* correctly with respect to the bearing bores 723*a*, 723*b*, and 723*c*.

Referring to FIG. 8, step 2 of the method includes pressing the outboard crankshaft halves 722*b* into the counter-weight 732*b* while the counter-weight 732*b* is supported by the tools 2010*a* and 2010*b*. The tool 2010*a* passes loosely through the inner bearing 741.

Referring to FIG. 9, step 3 of the method includes supporting the outboard crankshaft halves 722*b* with a special tool 2020*a* that passes around the outboard crankshaft halves 722*b* and through the bearing bore 723*c* in the outboard bearing boss 733*a*, supporting the first counter-weight 732*a* with a special tools 2020*b*, and pressing the inboard crankshaft halves 722*a* into the counter-weight 32.

Figure 9B:
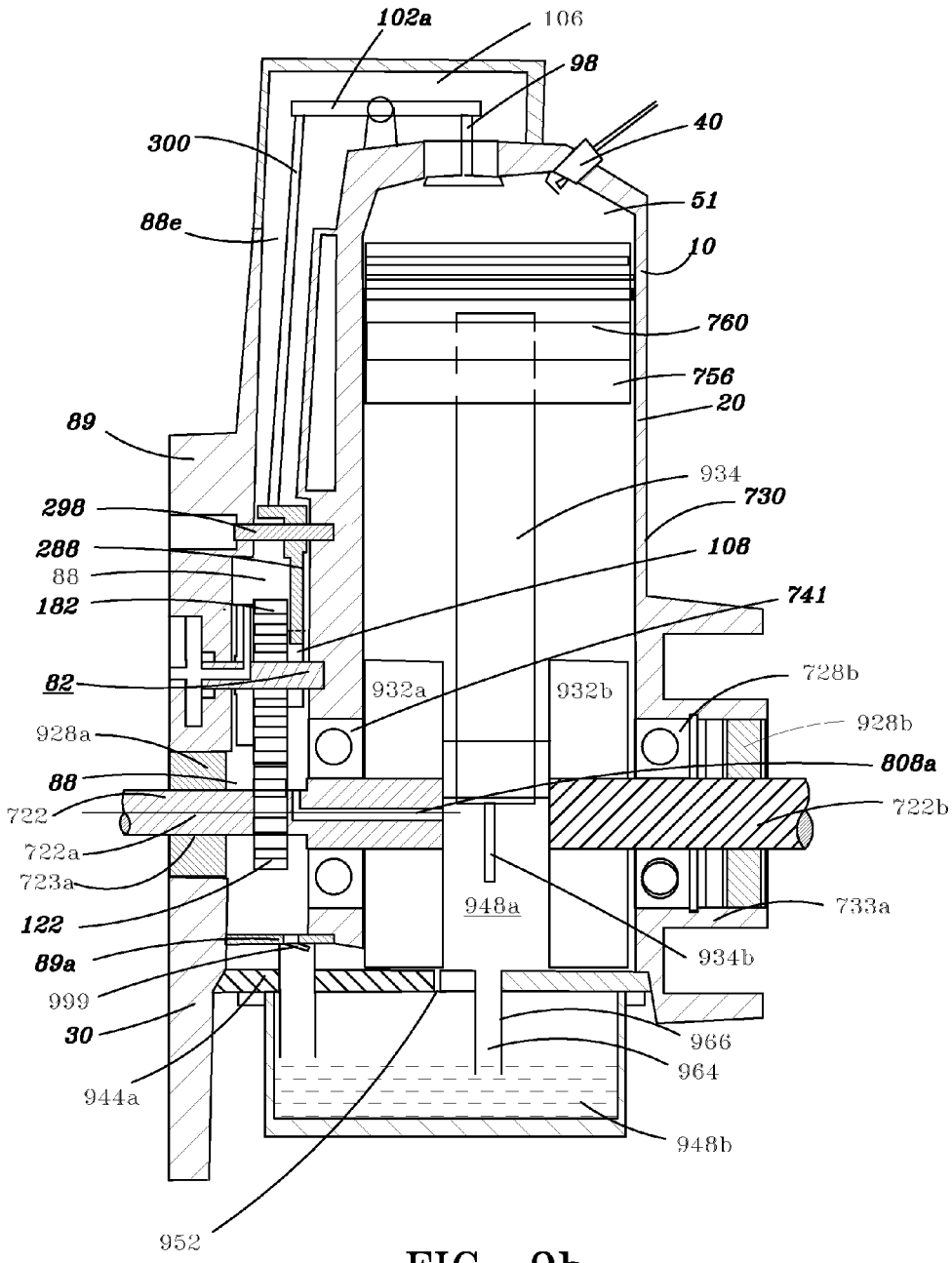
FIG. 9*b* is a cross-sectional view illustration of the engine illustrated in FIG. 9 with an oil chamber attached to a bottom of a crankcase.
Figure 9B:
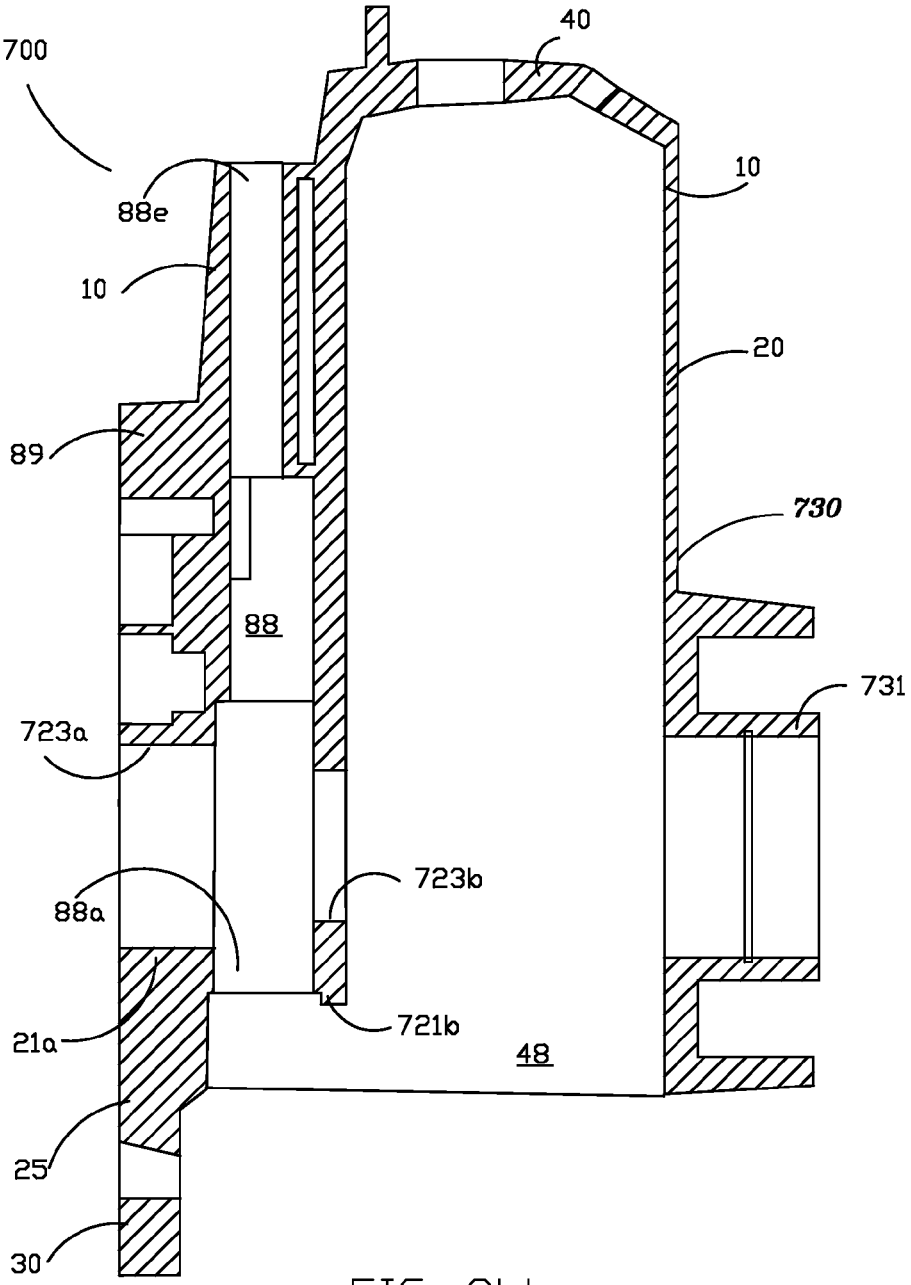
Figure 9C:
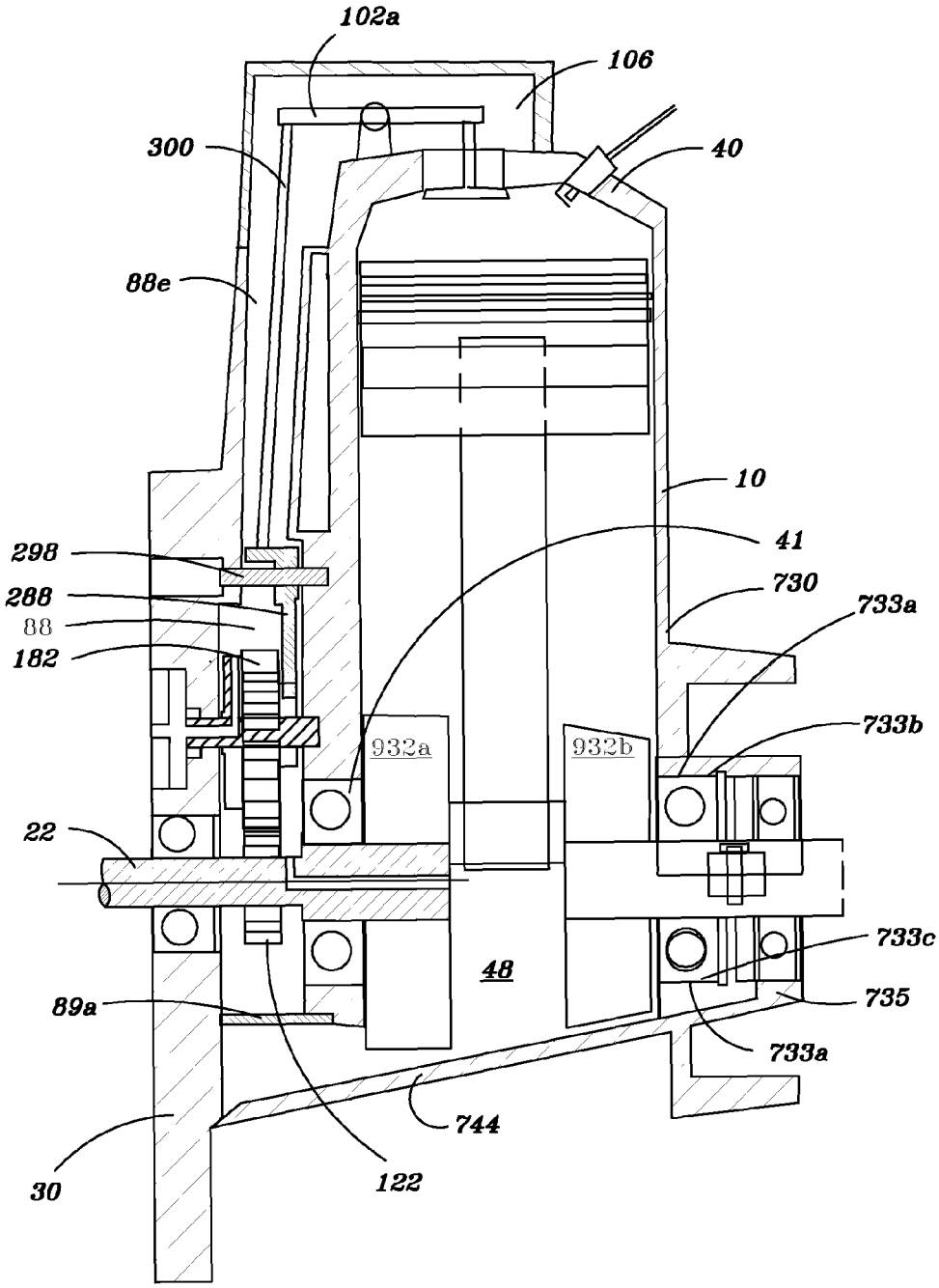
FIG. 9*c* is a cross-sectional side view illustration of another embodiment of the mono-block four-stroke engine with a half-crank and one half of the outboard bearing boss being integral with the cylinder block.

Referring to FIG. 9*b*, step 4 of the method includes pressing first and third oil seals 928*a*, 928*b* into the first and third bearing bores 723*a* and 723*c*.

Step 5 of the method includes inserting the outboard bearing 731 (or bearings for outboard starter) and oil seals 728*b*. The outboard bearing may either slide fit on the outboard crankshaft halves 722*b* and may be secured in place with the circlip.

It should be noted that the oil seal or oil seals may be used in conjunction with the bearings at any bearing bosses 21*a*, 21*b* and 731 as necessary depending on lubrication systems and breather systems.

Referring to FIGS. 9 and 9*b*, installation of the outboard crankshaft halves 722*b* in case of a half-crank with outboard starter is a lot easier because the yoke is not rigidly pressed onto the crank pin 736. In this case, the outboard bearing boss may be just top half integral with the cylinder block, while the lower half is part of the crankcase cover 744 as shown in FIG. 9*c*. However, the outer edge of the boss 735, shown in FIG. 9*c* is still integral with the cylinder block. This helps to improve sealing of crankcase cover 744 with the mono-block 10.

FIG. 9*b* illustrates the assembled engine with a separate oil chamber 948*b* attached to the bottom of the crankcase cover 944*a* with a slot 964 for the slinger 934*b* on the connecting rod 934 to splash the oil. It may be noticed that when the engine is turned upside down, the oil does not poor down into the crankcase chamber 948*a* because of a separation wall 966. However, the bleed passage 952 allows a small amount of oil to drip onto the first and second counter-weights 932*a*, 932*b* so the piston assembly 756 gets lubricated and also some oil goes into the valve train chamber 88 for lubricating the valve train. It is possible to time the opening of the bleed passage 952 with the counter-weight 932*a* so that the bleed passage 952 is open when the piston assembly 756 moves upward causing negative pressure in crankcase chamber 948*a* and close it when the piston is in downward motion causing positive pressure in the crankcase chamber 948*a*. The oil condensed in the valve train chamber 88 and valve chamber 106 is returned to the crankcase chamber 948*a* or possibly directly back into the separate oil chamber 948*b* through a check valve 999 illustrated in FIG. 9*b*. It is also possible to drain the oil from the valve chamber 106 into the oil chamber through an additional return passage and check valve, particularly, when the engine is run upside down.

Figure 10:
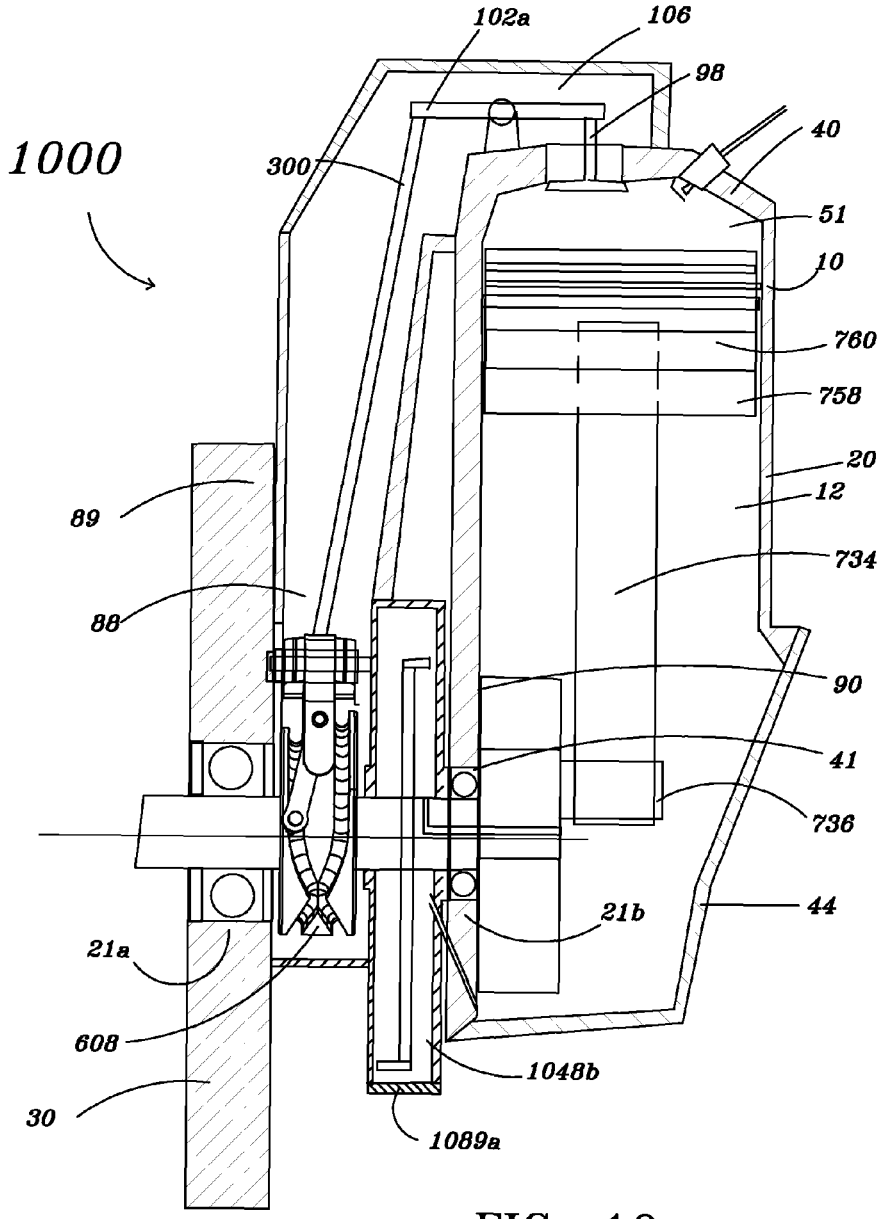
FIG. 10 is a cross-sectional side view illustration of another embodiment of the mono-block four-stroke engine with a separate oil chamber with an oil slinger attached to the crankshaft.

In another embodiment of the engine, illustrated in FIG. 10, the oil chamber 1048*b* may be a separate chamber similar to the dry sump lubrication system described in Honda's U.S. Pat. Nos. 5,947,075 and 6,021,766, etc. The disadvantage with Honda's design is that the crankcase consists of two separate halves that have to be machined first and the two pair have to stay together during production and is not a cost effective design. Honda's two patents disclose full crank engines while the engine disclosed herein is a half-crank engine. As illustrated in FIG. 10, the oil chamber 1048*a* can be molded such that the entire chamber is an integral part of the cylinder block 1000 as shown in FIG. 10. The casting, machining and assembly are much simpler. The bottom of the oil chamber is easily plugged with a cover 1089*a*.

Figure 11B:
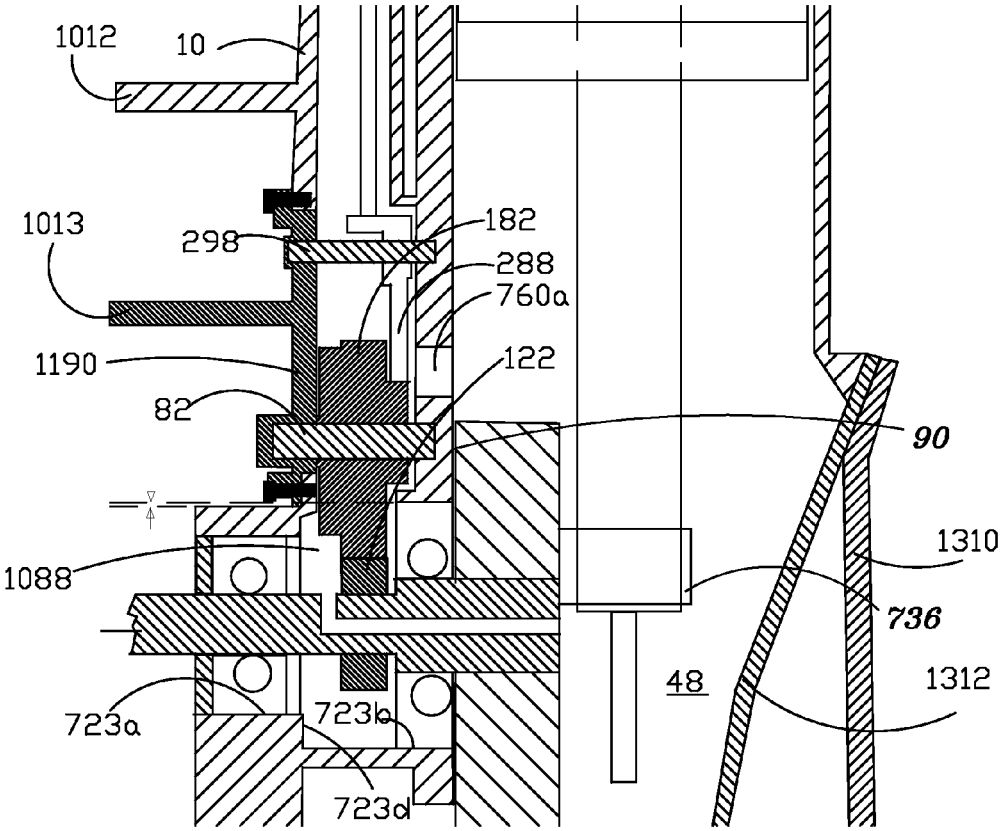
FIG. 11*b* is a cross-sectional view of mono-block four-stroke engine with cam cover and integral boss for mounting the ignition module.

FIGS. 11 and 11*b* illustrate the second bearing bore 723*b* (an inner bearing bore) as being bored all the way to the inside wall 723*d* of an outer bearing bore 723*e*. The leftover material 1011 is then machined out to form valve train chamber 1088. In this case, the lower end 1088*a* of the valve train chamber 1088 is closed and there is no need for any kind of plug. However, the front face 1189 of the valve train chamber 1088 has to be cored out from the front for inserting the cam shaft 82, cam gear 182 and followers 288 with the follower pin 298. This calls for a separate cam cover 1190 as illustrated in FIG. 11*b*. FIG. 11*b* illustrates how the front part of the valve train chamber 88 may be closed with separate cam cover 1190 and one of the bosses for the cam shaft 82 and follower pin 298 may be on the cam cover 1190. Inner and outer ignition bosses 1013 and 1012 are for mounting an ignition module (not shown) for providing voltage for the spark. The outer ignition boss 1012 is integral to the cylinder block 20.

Figure 12B:
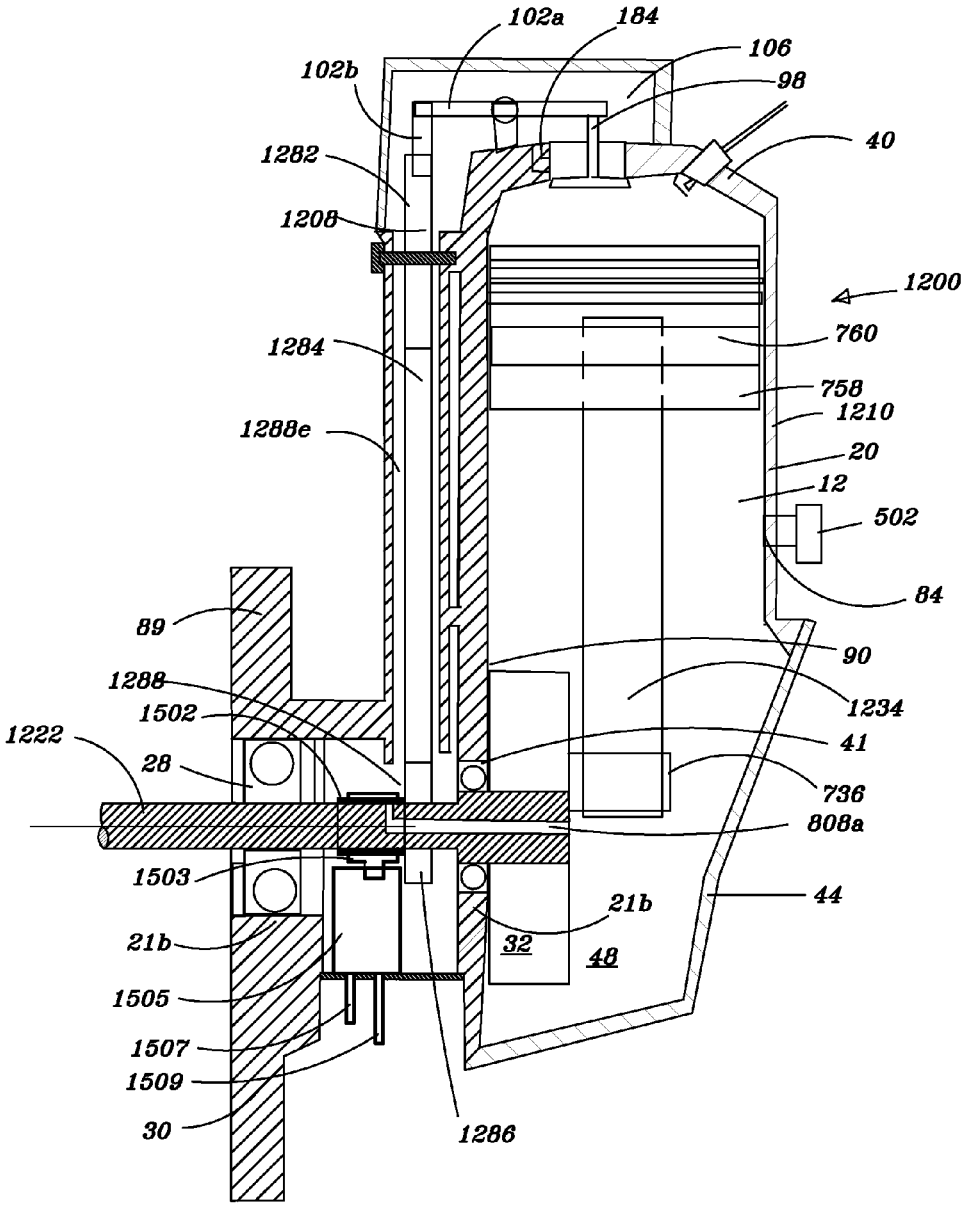
FIG. 12*b* is a cross-sectional side view illustration of another embodiment of the mono-block four-stroke engine with a belt driven overhead cam and an oil pump driven by the crankshaft.

FIGS. 12 and 12*b* illustrate another embodiment of the engine 1200 having a wet belt drive, similar to what is described in the Honda prior art. An overhead cam pulley 1282 running at half the engine speed is driven by a timing belt 1284 and a crank pulley 1286 on the crankshaft 1222. The crank pulley 1286 may be either in a separate chamber 1288 adjacent to the oil chamber 1248*b* with an oil seal between the two chambers or the valve train and oil chambers 1288 and 1248*b* may be commonly cored out from the bottom. The slingers 1234*b* are attached to the crankshaft 1222. There may be more than one pair of slingers. A belt drive passage 1288*e* is cored out from bottom as well as top of the cylinder block 1210. A follower 102*b* and a rocker 102*a* shown in FIG. 12 represents the valve train. It is well known how to operate the intake valve 98 and the exhaust valve 99 with the overhead cam 1208. FIG. 12*b* illustrates a lubricating oil injection pump 1505 attached to the cylinder block 20 and driven by the crankshaft 1222 through a worm gear 1502 and a gear 1503. The pump may also be driven off of a crank gear 122 such as the one illustrated in FIG. 5*b* through reduction gear in the oil pump. The pump 1505 has an inlet 1507 to receive oil from an oil reservoir and an outlet 1509 to deliver oil to the first intake passage 126*a* as shown in FIG. 14*d* or into the crankcase chamber 48. The oil injection pump may use a pressure sensor 1513 to kill the engine when oil pressure in the outlet 1509 falls below a predetermined value to prevent the engine from seizure. The air-fuel mixture may be supplied into the crankcase chamber 48 through a port 84 in the cylinder block 20 by a carburetor 500.

Figure 13:
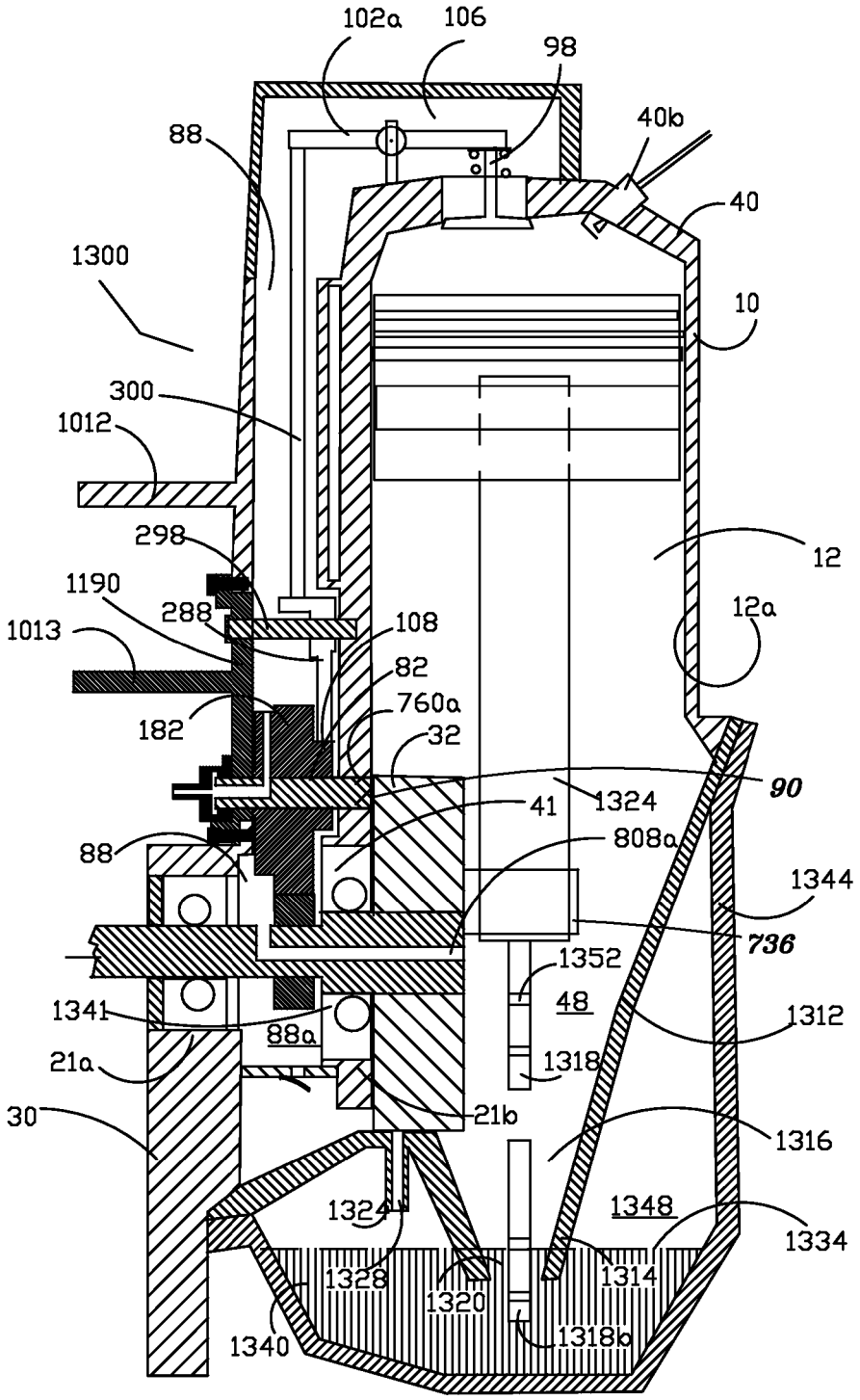
FIG. 13 is a cross-sectional side view illustration of a half-crank embodiment of the mono-block four-stroke engine illustrated in FIG. 9*b*.
Figure 13B:
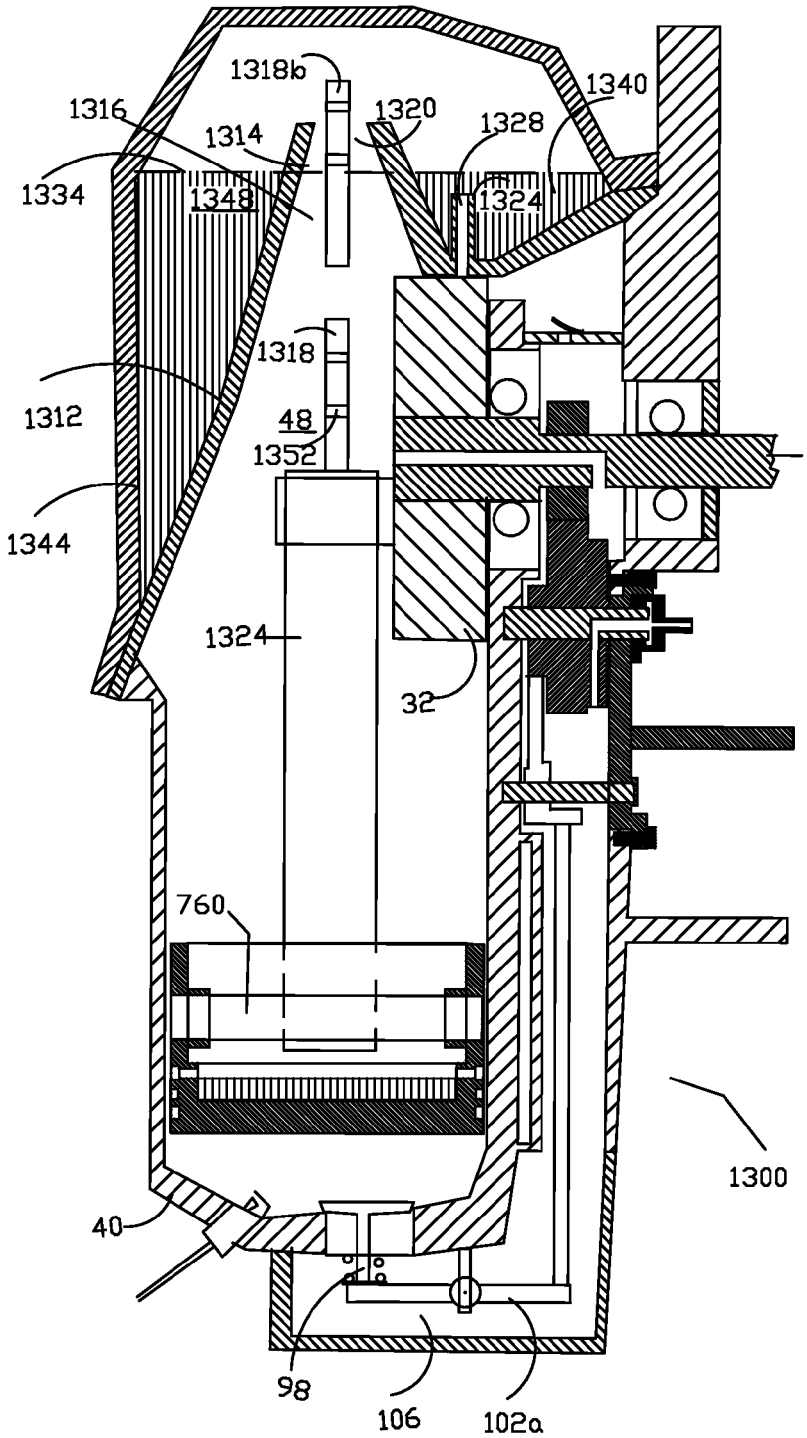
FIG. 13*b* is a cross-sectional side view illustration of the engine in FIG. 13 in an upside down attitude.
Figure 13C:
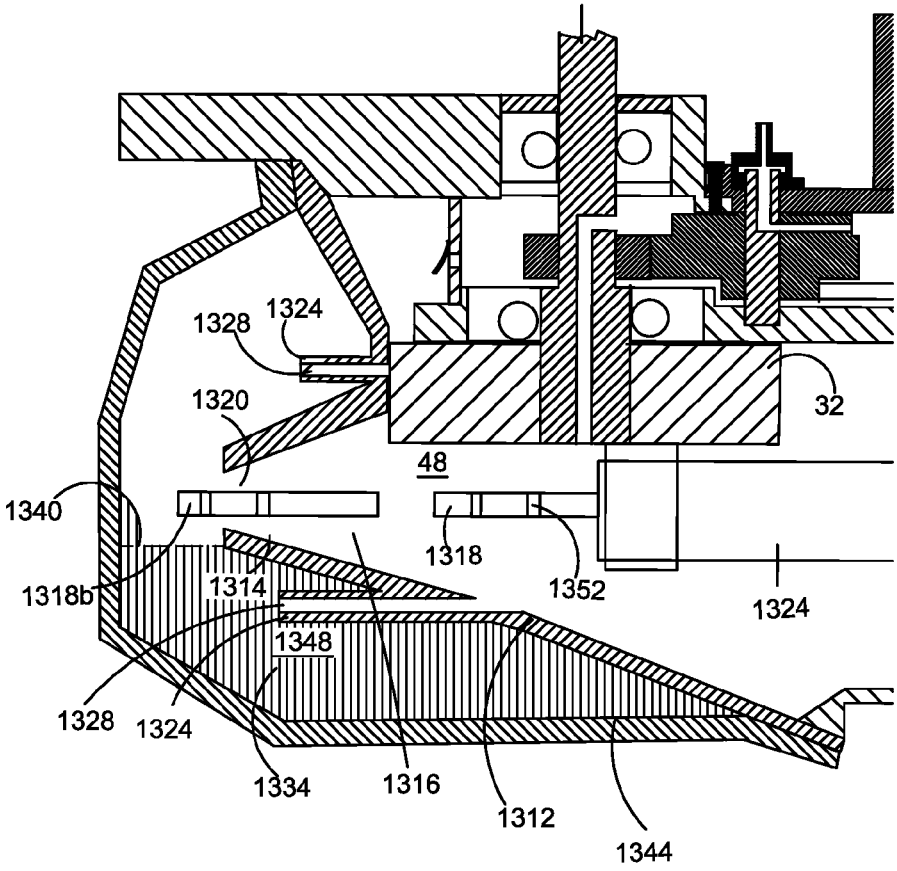
FIG. 13*c* is a cross-sectional side view illustration of the engine in FIG. 13 in a horizontal attitude.

FIGS. 13 and 13*b* illustrate an alternative embodiment of the half-crank engine illustrated in FIG. 9*b*, which prevents oil 1340 from getting into the cylinder head 40 when engine 1300 is upside down or sideways. A slinger 1318 reciprocates in and out of a sliger tube 1320 protruding from a crankcase cover 1312 into the oil sump 1348 disposed between the crankcase cover 1312 and a sump wall 1344 separating the crankcase chamber 48 and the oil sump 1348. A slinger innermost position 1318*b* further illustrates reciprocation in to the tube 1320. As the connecting rod slinger 1318 moves, the oil in the oil sump is splashed into the inside of the crankcase chamber 48 so that the oil hits a cylinder wall 12*a*, and moving parts such that they are all lubricated. The oil droplets (or mist) are also carried to lubricate the valve train, which includes a cam 108, a cam gear 182, followers 288 and other parts such as rockers, etc. The oil mist or droplets may be carried into the cam chamber 88 and the valve chamber 106 through a passage 808*a* in the crankshaft 1222 or alternatively through bearing passages 1341 in an inner bearing 41. An oil level 1334 is illustrated in FIG. 13 when the engine 1300 is in an upright position. When the engine is turned sideways or upside down, as illustrated in FIG. 13*b*, the oil in the oil sump does not spill into the cylinder bore or crankcase chamber, instead oil may drip into the crankcase chamber 48 through oil passage(s) 1328 in a standoff tube 1324 protruding from the crankcase cover 1312 into the oil sump 1348. There may be more than one such standoff tube, such that the engine is lubricated in all attitudes. Elements 1352 are serrations on the slinger or scoops or any similar devices to help splash oil into the crankcase chamber 48. The oil supply passages to the cylinder head and returns may be located in the crankcase chamber such that excessive oil does not get to the head. Alternatively, the slinger 1318 may be located inside a pocket 1316 protruding into the oil sump 1348 which is disposed between a crankcase cover 1312 and a pocket wall 1314 separating the crankcase chamber 48 and the oil sump 1348 as illustrated in FIG. 13. A front part of the valve train chamber 88 may be closed with separate cam cover 1190 and one of the bosses for the camshaft 82 and follower pin 298 may be on the cam cover 1190. Inner and outer ignition bosses 1013 and 1012 are for mounting an ignition module (not shown) for providing voltage for the spark. The outer ignition boss 1012 is integral to the cylinder block 10.

Figure 14:
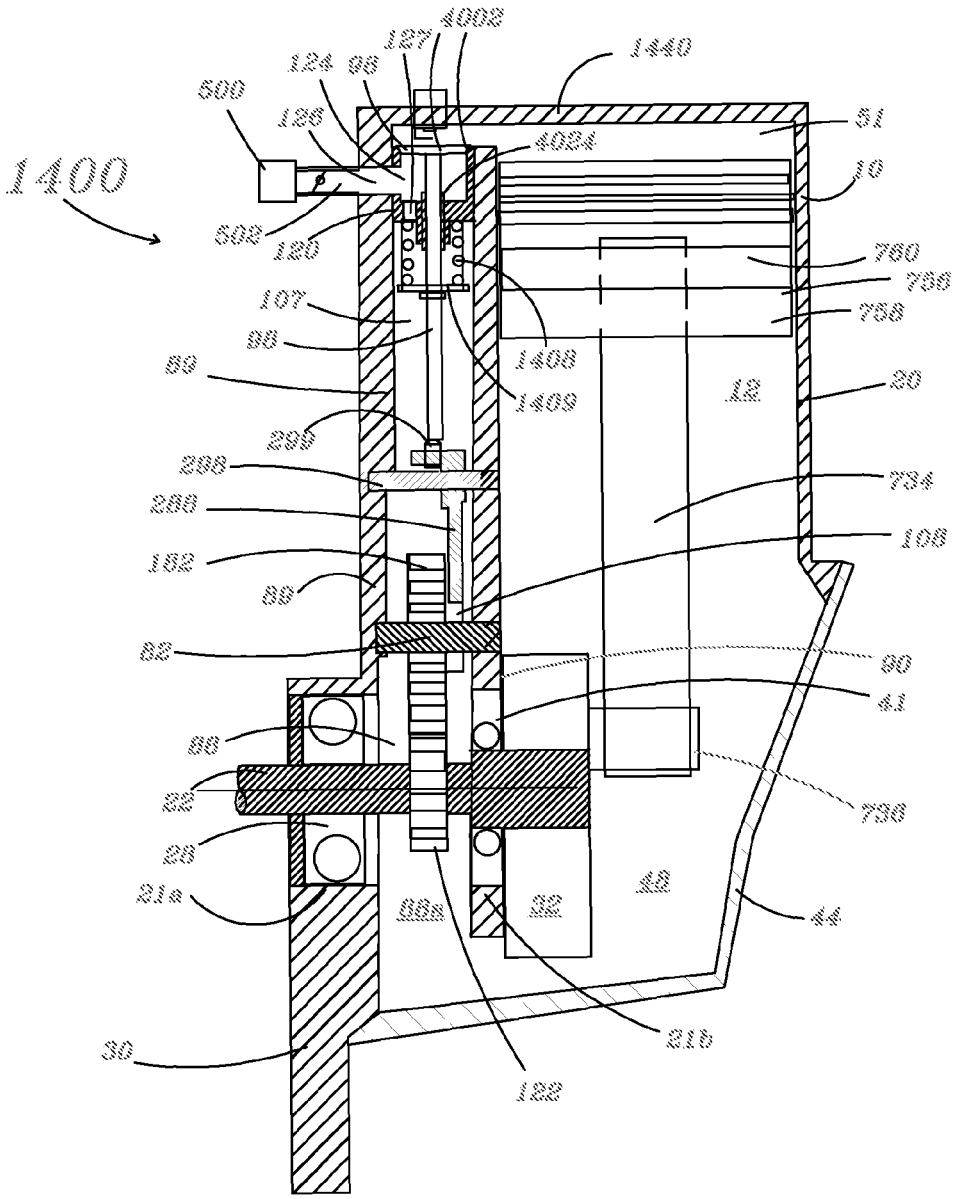
FIG. 14 is a cross-sectional side view illustration of an exemplary embodiment of a half-crank mono-block four-stroke engine with a L-head and a valve train.
Figure 14B:
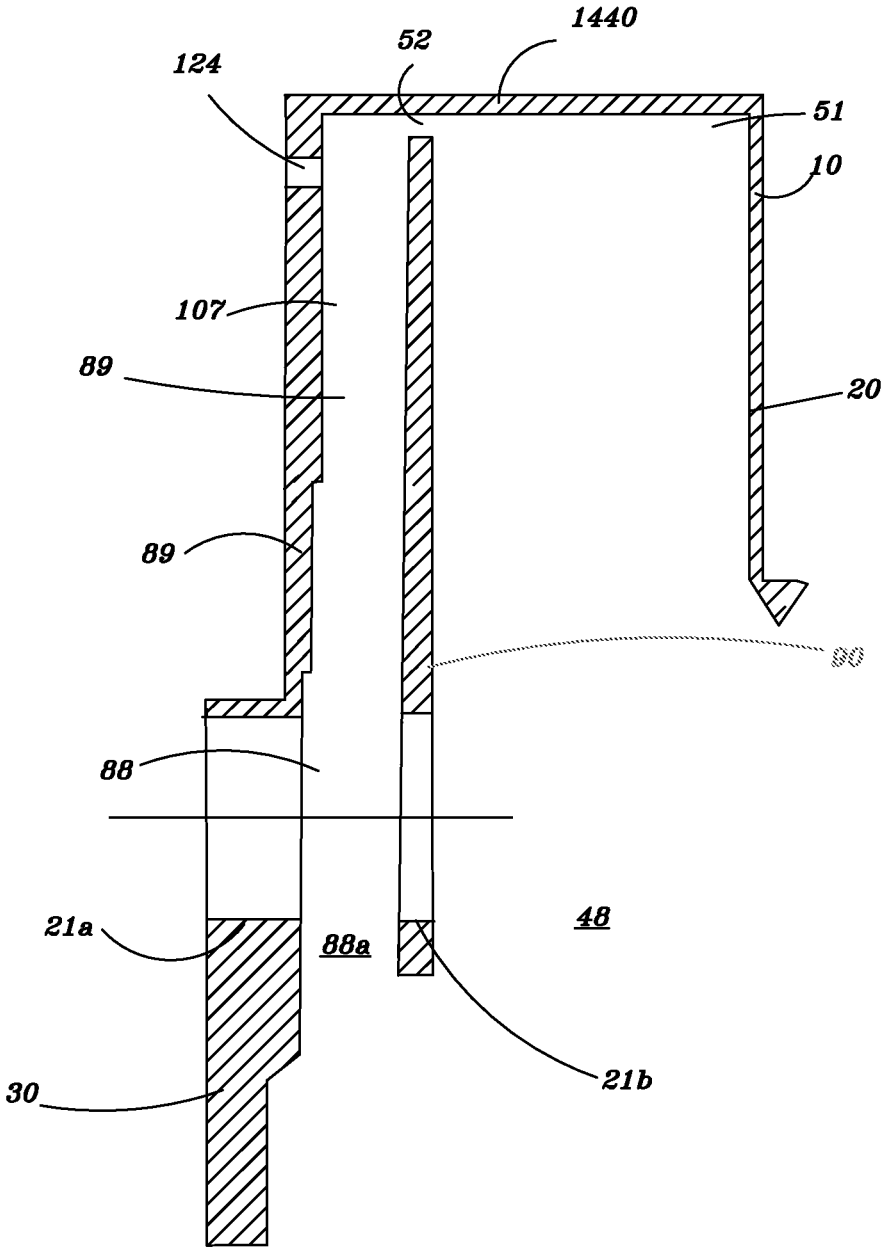
FIG. 14*b* is a cross-sectional side view illustration of a mono-block having integrally cast cylinder block, crankcase, cylinder head, outer and inner bearing bosses in the engine illustrated in FIG. 14.
Figure 14C:
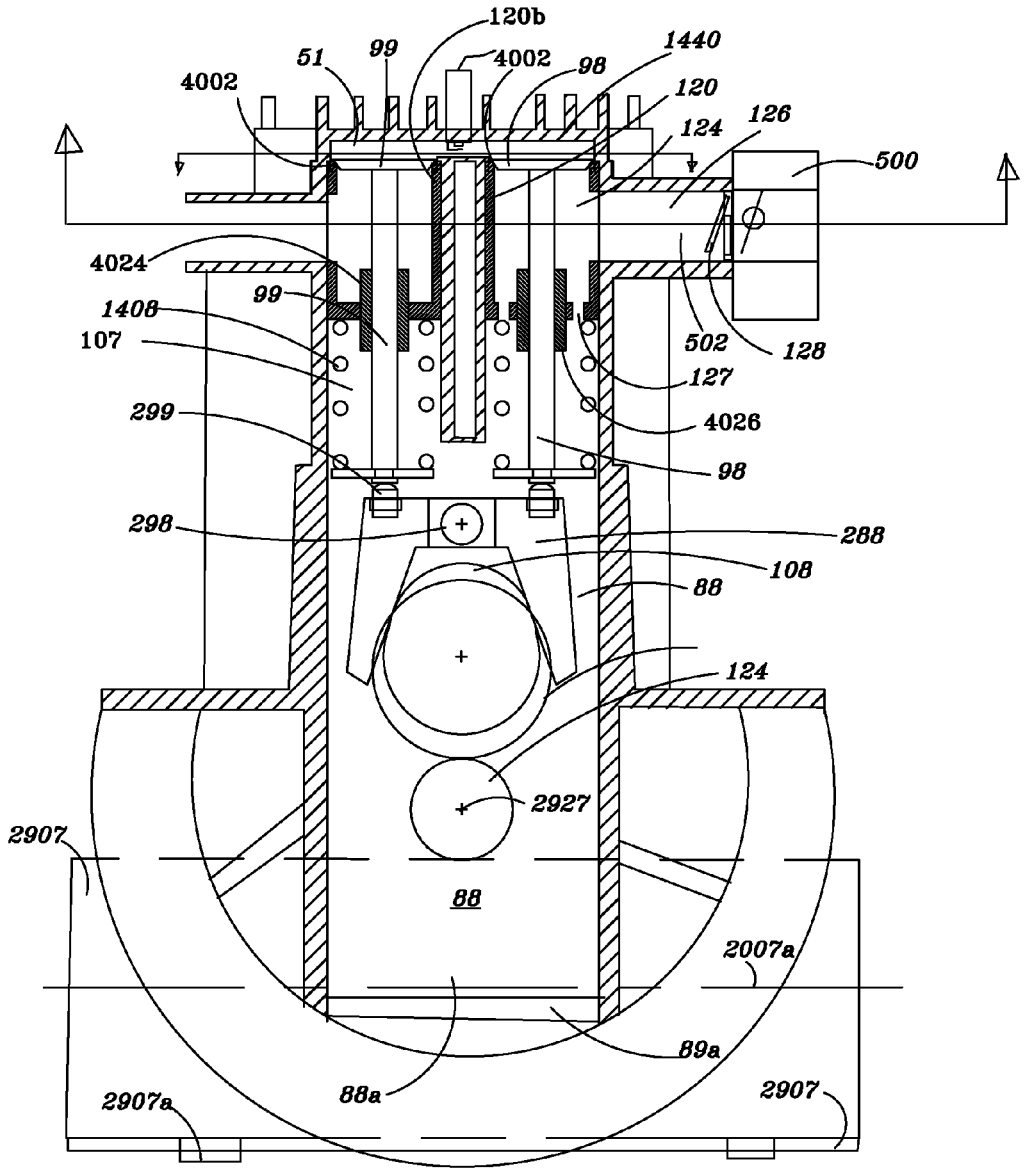
FIG. 14*c* is a cross-sectional front view illustration of another embodiment of a mono-block having integrally cast cylinder block, crankcase, cylinder head, outer and inner bearing bosses, valve assembly on the side of the cylinder block in the engine illustrated in FIG. 14, and an intake system with one way valve in the intake passage.
Figure 14D:
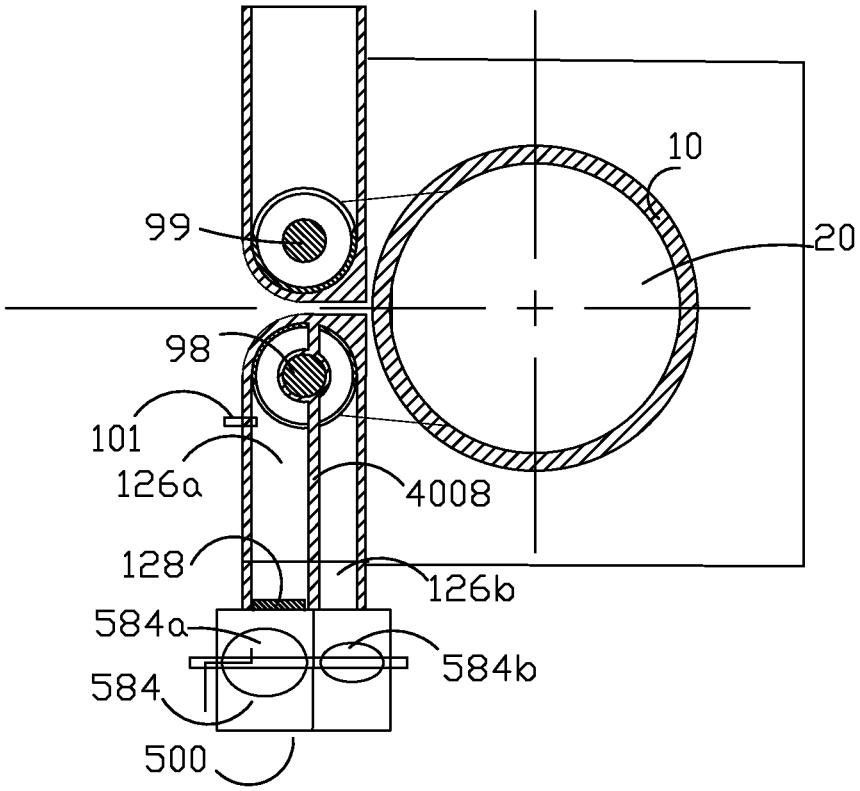
FIG. 14*d* is a cross-sectional top view illustration of another embodiment of an engine with a divided intake system with one way valve in one intake passage and oil injection into said passage.

FIGS. 14, 14*b*, 14*c*, 14*d*, 14*e*, and 14*f* illustrate another embodiment of the engine 1400 having an integral L head mono-block 10 including an integral (one piece) cylinder block 20, an L-head 1440, and crankcase 30. A cylinder bore 12 is disposed within the cylinder block 20 and a valve train chamber 88 is disposed between the cylinder block 20 and an outboard wall 89 integrally cast with the cylinder block 20 as part of the mono-block 10. The integral casting of the mono-block 10 is illustrated in FIG. 14*b*. The L-head 1440 covers the valve train chamber 88 and the cylinder bore 12 disposed within the cylinder block 20 and spaced apart from inboard wall 90. An L-head valve chamber 107 in the valve train chamber 88, the valve train chamber 88, and the crankcase chamber 48 are all interconnected through passages and disposed between the cylinder block 20 and at the bottom of the valve train chamber 88 and the passage 52 at the top adjacent to the combustion chamber 51. The chamber 88 and valve chamber 107 are substantially in line with each other. Valve chamber 107 is substantially inline with the axis of the cylinder. However, it may also be at an angle to the axis of the cylinder.

The L-head valve chamber 107 has an intake valve assembly 120 for intake and an exhaust valve assembly 120*b* for exhaust that includes an intake valve seat 4002 and an intake valve guide 4024 for intake and an exhaust valve guide 4026 for exhaust. The valve chamber 107 further includes a valve spring 1408, and valve retainer 1409 and is tightly attached to the mono-block 10 in the valve chamber 107 between the chamber 88 and the combustion chamber 51, to form a leak proof combustion chamber 51. The valve assembly may be a modular piece where valve seat 4002, valve guide 4024, valve spring 1408, and valve retainer 1409 are all assembled separately prior to attaching to the mono-block 10. Valve lash is adjusted with a nut 299 through a window 10*b* (shown in FIG. 29). The valve assembly 120 has an opening 124 to the ambient through an inlet port 126 connecting a carburetor 500 (fuel-air mixer). The valve assembly 120 can have an opening 124 connecting the carburetor 500 to the crankcase chamber 48 where the air-fuel mixture is mixed with lubricant oil. A passage 502 connecting the carburetor 500 and the crankcase chamber 48, through a connecting passage 127 in the intake valve assembly 120, may have a one-way valve 128 illustrated in FIG. 14*c* to prevent flow back through the carburetor 500 into ambient which prevents a charge from flowing back into the ambient when the piston is moving downward. By definition, charge means mixture of fuel and air and pre-mixed fuel or charge means fuel pre-mixed with oil.

Figure 14E:
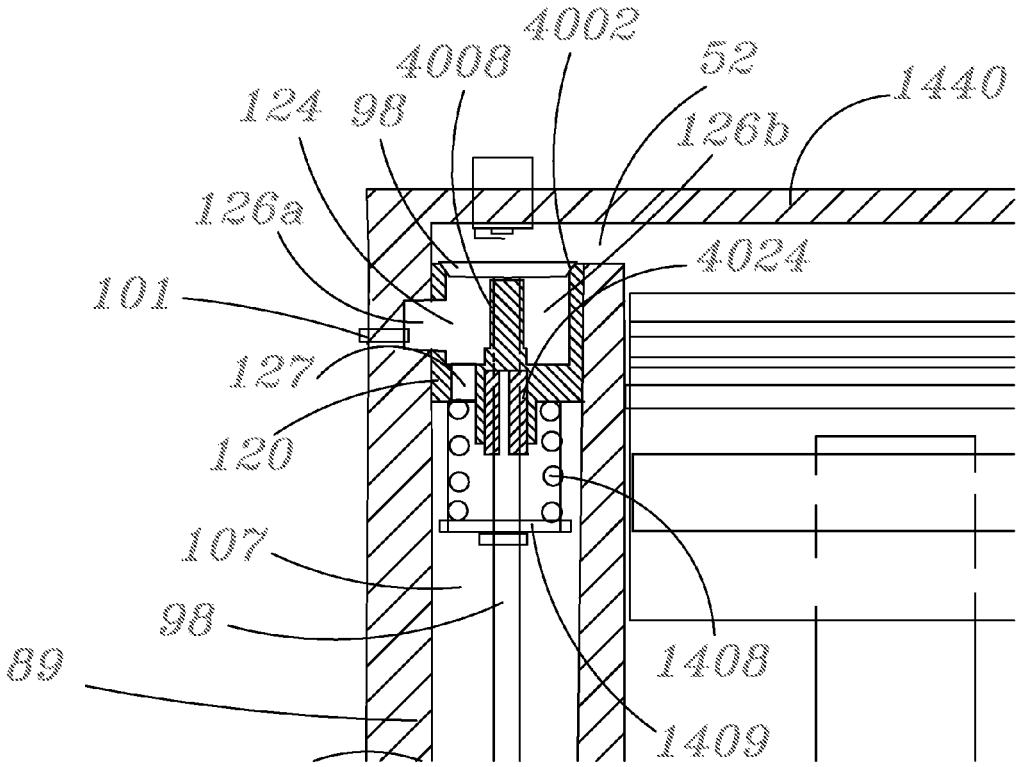
FIG. 14*e* is an enlarged cross-sectional view illustration of engine illustrated in FIG. 14*d* showing partition on intake system at the intake.

In another embodiment of the L-head engine 1400 having an integral L-head mono-block 10 illustrated in FIGS. 14*d* and 14*e*, the intake valve assembly 120 includes a dual intake passage 126 having first and second intake passages 126*a*, 126*b* that connects carburetor 500 directly to the cylinder bore 12 (combustion chamber 51) during the intake process and that connects the carburetor 500 to the crankcase chamber 48 through the connecting passage 127 through the intake valve assembly 120 during the exhaust or compression strokes which are both upward strokes. A partition wall 4008 runs all the way across the intake passage separating the flow all the way from the carburetor 500 to the intake valve 98 and across to minimize short circuit of the two mixtures until just before they enter the cylinder bore 12. A fraction of the charge 25% to 75% goes into the crankcase chamber 48 through the first intake passage 126*a* (or may have separate passage, not shown) when the piston is moving upward during compression and exhaust strokes and the piston is moving toward the combustion chamber 51. The dual intake passages 126*a*, 126*b* are connected from the carburetor 500 to the cylinder bore 12 when the intake valve 98 is open during intake stroke. The fraction of the pre-mixed charge goes into the crankcase chamber 48 to lubricate the engine parts, particularly, the valve train and parts in the crankcase chamber 48. It is also possible to inject lubricating oil separately into the first and second inlet passages 126*a* and 126*b* with an injector or injecting tube 101 when the fuel is not pre-mixed with oil. In which case, rich charge free of oil goes into the combustion chamber 51 and oil mixed charge (or oil mixed with just air) goes into the crankcase chamber 48. Amount of charge is controlled by the carburetor valve 584 and may have separate first and second valves 584*a*, 584*b* to regulate the mass flow into the first and second intake passages 126*a*, 126*b* respectively. When oil is injected into the passage 126*a*, only air may be inducted through the passage 126*a*.

Essentially, the divided inlet port 126 may have either only air going into crankcase chamber 48 through passage 126*a* when oil is injected into the air stream to lubricate the parts, or may have air-fuel mixture when oil is pre-mixed with the fuel, or may have lean air-fuel mixture free of oil when oil is injected into the lean mixture in passage 126*a*, while rich mixture flows through the passage 126*b* or the mixture may be of uniform air-fuel ratio going through both the passages 126*a*, 126*b*. Also, when only air passes through passage 126*a*, fuel supplied through passage 126*b* may be a propane fuel or any gaseous fuel, such as compressed natural gas, bio gas, etc. The advantage of injecting oil into air inducted into crankcase chamber is that the fuel either liquid form as in the case of gasoline or gaseous as in the case of propane can flow directly into the combustion chamber during the intake process, while oil injected into air lubricates the valve train (cam gear, crank gear, followers, valves, cam lobe, etc) and bearings in the crankcase chamber 48 when the engine is a dry sump type without oil in the crankcase chamber 48.

Another advantage is that the engine can be operated in many attitudes as there is no oil in the crankcase chamber that would flow into the cylinder when engine is operated upside down. The dual intake system where port inlet 126 is divided into two separate passages 126*a*, 126*b* may also be applied to overhead valve chamber 107 shown in FIG. 1, but with a passage 126*a* connecting the valve chamber 107 and only air entering the valve chamber 107 and crankcase chamber 48, with oil injected for lubricating the valve train and parts in the crankcase chamber 48.

During the compression stroke when the piston assembly 756 travels upward, the intake valve 98 is closed and the crankcase chamber 48 experiences negative pressure and the charge (oil mixed charge) is inducted into the crankcase chamber 48 from the carburetor 500 through the passage 126*a*, the port 126, the chamber 88. The one-way valve 128 opens due to differential pressure cross the one-way valve (typically a reed valve is used). When the piston moves downward during power stroke and expansion stroke, the crankcase pressure is built-up. During the intake stroke, the intake valve 98 opens and the charge from the crankcase chamber 48 enters the combustion chamber 51. At the same time, the rich charge enters the combustion chamber 51 directly from the carburetor 500 through the passage 126*b*. The concept of dual passage (lean charge going into crankcase chamber 48 and rich charge going directly into combustion chamber is applicable to all mono-block engines.

The oil pump may be driven by the crankshaft 22 as shown in FIG. 12*b* or by the cam shaft 82 as shown in FIG. 5*b*. The pump may also be driven by the crankshaft halves 722*b*, shown in FIG. 9*b* (and FIG. 9) where the pump is mounted outboard. Fuel used in the oil injected engine may be propane gas commonly known as LPG (liquefied petroleum gas or compressed gaseous fuel.

Figure 14F:
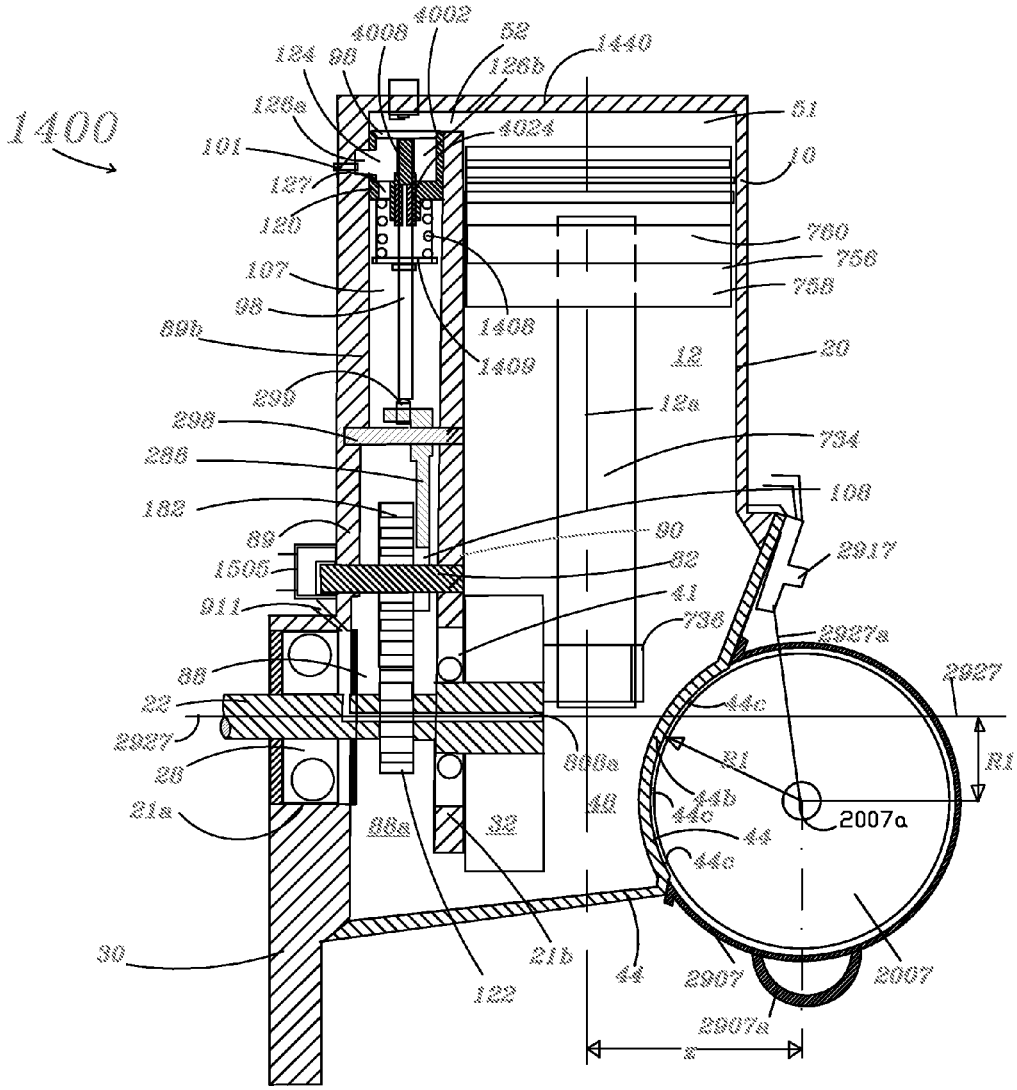
FIG. 14*f* is a cross-sectional side view illustration of an exemplary embodiment of a four-stroke engine with a L-head and a valve train with LPG fuel tank at the bottom.

FIG. 14*f* illustrates the location of an LPG fuel tank 2007 with a radius of curvature R1 near a crankcase cover 44 having a recess in a fractional section 44*b* of the crankcase cover 44. The recess has a radius of curvature R1 plus a few millimeter (example 2 to 20 mm) to closely match and conform to an outer wall of the LPG fuel tank 2007 at the fractional section 44*b* of the crankcase cover 44. The radius of curvature on the crankcase cover 44 at section 44*b* is such that it provides enough clearance for the connecting rod 734 and crank pin 736 to freely rotate without interference. Secondly, a center line 2007*a* of the fuel tank 2007 is below an axis 2927 of the crankshaft 22 and the center line 2007*a* is off-set from the axis of the cylinder bore 12 when the fuel tank 2007 is located at the bottom of the engine as shown in FIG. 14*f*. When the attitude of the cylinder block 20 is such that crankcase chamber 48 is above the center line 2007*a* of the crankshaft 22, the fuel tank 2007 is located on the top of the crankcase cover 44. The LPG tank may also be located vertically in line with the axis 2927 of the cylinder 12. The advantage is a smaller package. Also, an oil tank containing lubricating oil to lubricate the engine may be attached to the fuel tank and above the center line 2007*a* of the fuel tank. The fuel tank 2007 is fitted inside a frame 2907 which may be attached to the crankcase cover 44 or cylinder block 20 or element. When the fuel tank 2007 is at the bottom, the frame 2907 has a leg 2907*a* for the engine block to rest on the floor. In order to minimize heating of fuel tank 2007 and provide a softer cushion between the crankcase cover 44 and fuel tank 2007, a vibration absorbent and low heat conductive material 44*c* is used between the fuel tank 2007 and crankcase cover 44 at section 44*b* as illustrated in FIG. 14*f*.

Engine 1400 shown in FIG. 14*f* has an oil injection pump 1505 driven by the cam shaft 82. The oil injection pump 1505 may also be driven by the crankshaft 22 through gears. The oil injection pump injects oil into the engine to lubricate the internal parts of the engine. An LPG pressure regulator 2917 is attached to the lower side of the cylinder block 20. Fuel from LPG tank is supplied to the pressure regulator through a centrally located high pressure fuel line 2927*a*.

U.S. Pat. No. 6,199,532 discloses an engine in which an intake passage is not divided into separate passages and the fuel is pre-mixed with oil and the valve chamber is substantially spaced above the combustion chamber.

Figure 15:
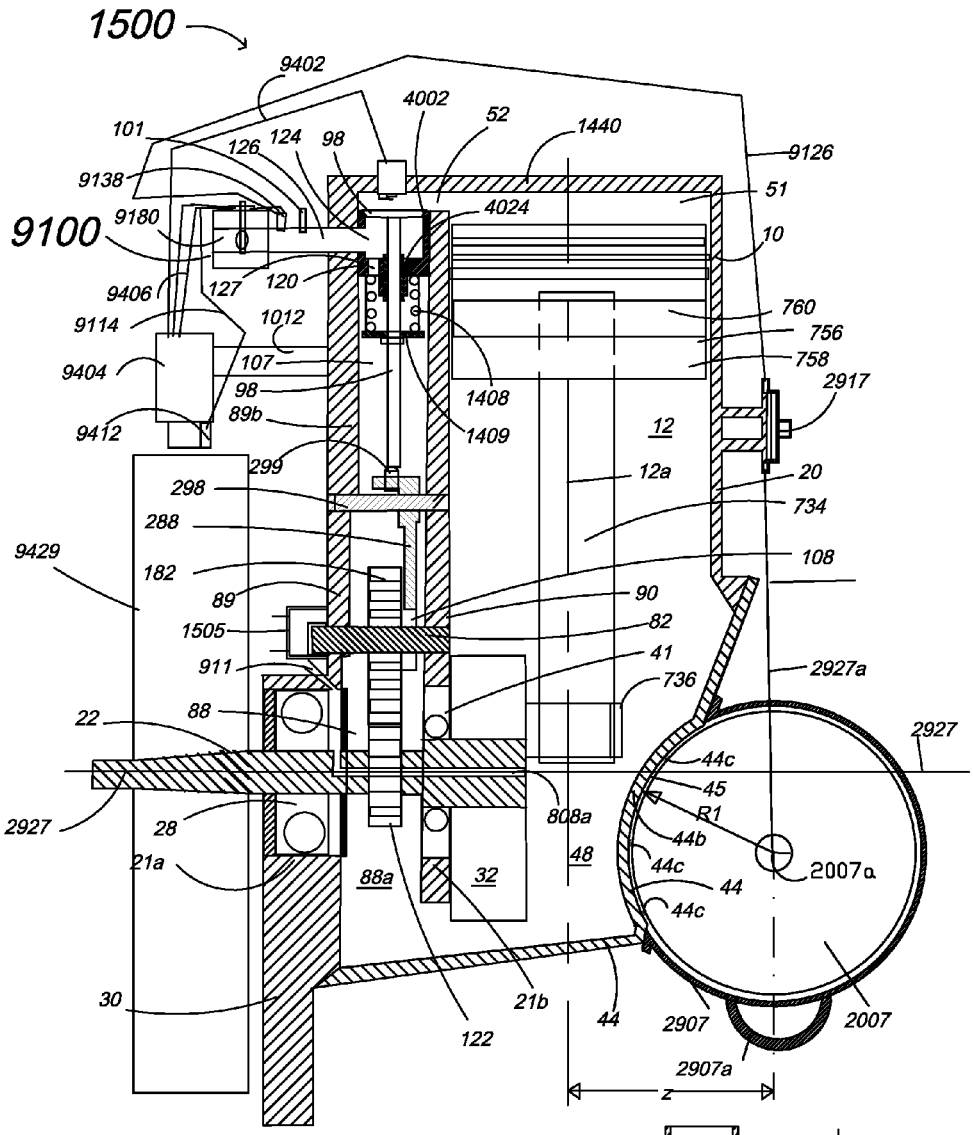
FIG. 15 is a cross-sectional side view illustration of an exemplary embodiment of a four-stroke engine with a L-head and a valve train with LPG Electronic Fuel Injection System.

FIG. 15 illustrates the engine 1500 which is similar to engine 1400 illustrated in FIG. 14*f*, but has an LPG electronic fuel injection (LPG EFI) system 9100 in place of the carburetor 500. The engine 1500 has the LPG EFI system 9100 to manage the fuel delivery to the engine. The amount and timing of the LPG fuel 9101 is controlled by an ECM 9142 mounted on the throttle body 9102. The LPG EFI manages the fuel delivery based on inputs that the ECM 9138 receives from many sensors; throttle position sensor 9142 that indicates if the throttle is closed or open or any position in between idle and fully open position, the engine speed or the RPM is measured by the number of pulses the ignition module 9404 receives from the magnet on the flywheel 9429, the air intake temperature as measured by the sensor 9146, and possibly engine block temperature. These are very commonly used parameters in an EFI system commonly used in automobiles. The LPG fuel 9101 is supplied from the LPG tank 2700, which is normally at about 110 inches of water. The high pressure fuel is typically reduced to about 10 to 15 inches of water and may be even higher. The pressure regulator 2917 reduces the pressure. The LPG pressure regulator may also be integral part of the throttle body 9102 as shown in FIG. 17 thru FIG. 22.

The Ignition module 9404 is mounted on boss 1012, and the magnets (not shown) are on the flywheel 9429, which energize coils in the ignition module. There may be additional power coil in the module to supply power to the ECM 9136. The flywheel 9429 is mounted on the crankshaft 22. The crankshaft 22 is used to drive many applications, such as trimmers, blowers, chainsaws, mopeds, lawn mowers, etc.

Figure 16:
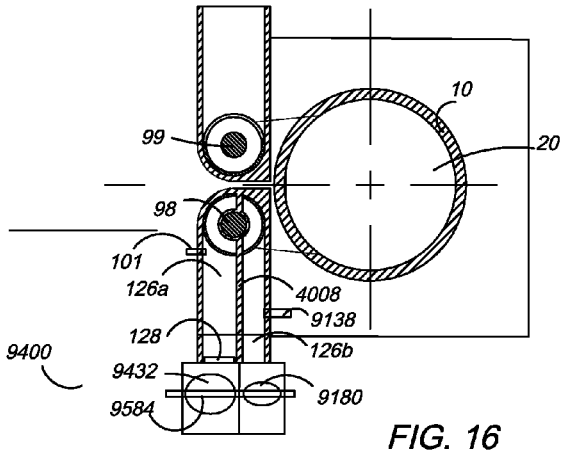
FIG. 16 is a cross-sectional top view illustration of another embodiment of an engine with a divided intake system with one way valve in one intake passage and oil injection into said passage and LPG fuel injection into other passage.
Figure 17:
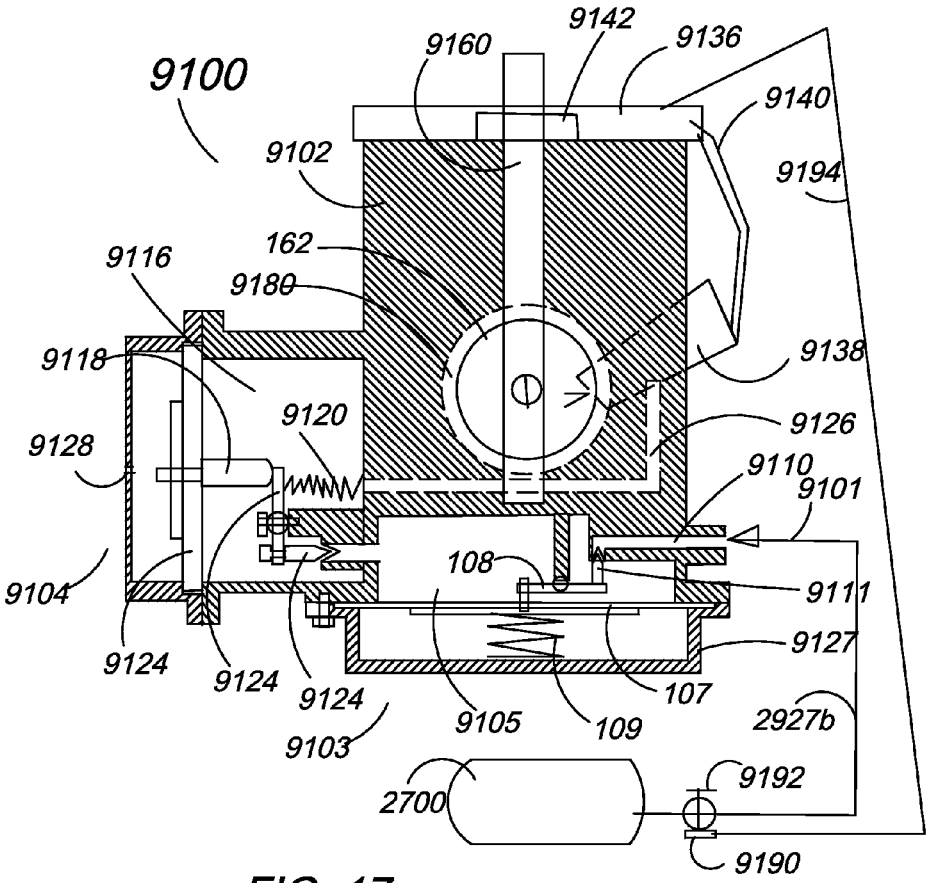
FIG. 17 is a cross sectional front view of an embodiment of an electronic LPG fuel injected throttle body with butterfly valve, fuel metering chamber, and fuel pressure regulator.
Figure 18:
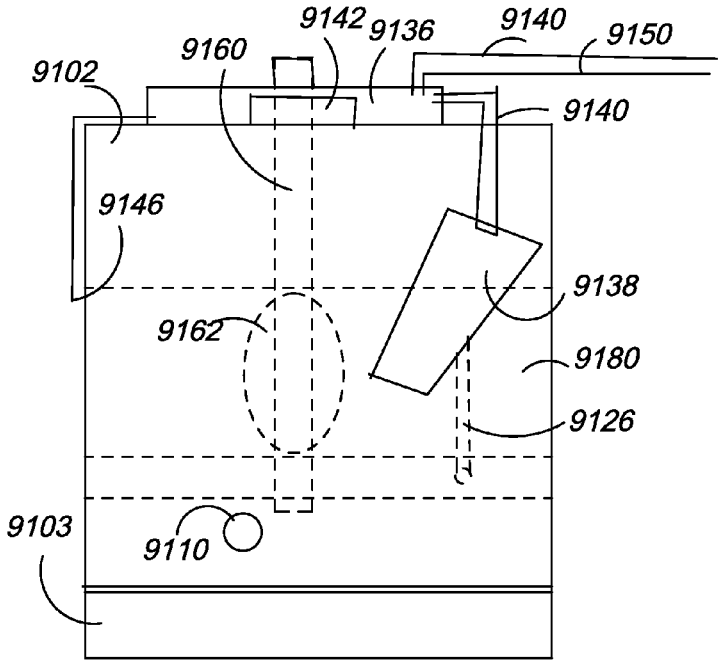
FIG. 18 is side view of the FIG. 17

The engine 1500 may have a wet lubrication system as in the case of the engine shown in FIG. 1 and FIG. 13, or may have oil injection as in the case of engine shown in 14*f*. The LPG EFI may also be used to inject the LPG fuel into the crankcase as in the case of engine shown in FIG. 5*b*. The divided intake passage shown in FIG. 16, has an LPG fuel injector in the intake passage 126*b*, while the oil is injected into passage 126*a*.

FIGS. 17 through 22 illustrate embodiments of electronically controlled LPG or compressed natural gas injected throttle body as applied to small engines. The pressure in an LPG tank typically is about 100 inches of water and the pressure is reduced in regulator to about 10 inches of water. The LPG EFI system 9100 consists of a throttle body 9102 that has one primary intake passage 9180 that connects the engine's intake passage 126 (126*b*) in a four-stroke engine for example shown in FIGS. 14, 14*d* and or in FIG. 1. The primary intake passage 9180 has a throttle valve 9162 which is a butterfly valve (or a slide valve 9462 shown in FIG. 19 to regulate the amount air going into the combustion chamber 51. The throttle valve 9162 is controlled by the throttle shaft 9160 (or 9468). The LPG EFI system 9100 has an electronic control unit 9136, commonly called as ECU or ECM mounted on the body 9102 such that the throttle shaft 9160 passes through the ECU 9136 which has a throttle position sensor 9142 to sense the position of the throttle, which can range from fully closed for low speed and load at idle, to fully open position at full speed or load. The ECU 9136 has inputs or sensors connected to it to measure engine speed 9148, engine temperature or exhaust temperature 9150, intake air temperature 9152 of air filter body temperature 9146. The ECU 9136 has already programmed fuel and timing maps to control the amount of LPG fuel 9101 injected through an injector 9138 and also it can control the spark timing, which is a common practice.

Throttle body 9102 has an integral pressure regulator 9103 consisting of an LPG fuel inlet 9110, pressure chamber 9105, diaphragm 9107, needle valve 9111, arm 9108, pressure spring 9109, vent hole 9129 in the pressure regulator cover 9127.

The pressure P1 is normally at about 50 to 100 inches of water in the LPG tank when the LPG fuel 9101 enters the pressure chamber 9105 where the flow is regulated by the needle valve 9111. The needle valve 9111 is connected to the diaphragm 9107 through a pin 9118 and an arm 9108. As the pressure increases in the chamber 9105 the needle valve closes the flow of LPG fuel because the pressure pushes the diaphragm 9107 outward against a pressure spring 9109. The pressure P2 in the pressure chamber 9105 is controlled by the spring 9109, which may be pre-set to any level equal to or below the inlet pressure P1, The fuel pressure chamber 9105 is connected to a fuel metering chamber 9104 through a passage 9176 between the pressure chamber 9105 and the fuel metering chamber 9116. The metering chamber 9116 is connected to the LPG fuel injector 9138 through a fuel passage 9126, which can also be an external hose outside the throttle body 9102. As the fuel flows into the fuel metering chamber 9116, the pressure P2 in the pressure chamber 9105 drops, thus opening the needle valve 9111 for the fuel to flow into the pressure chamber 9105, thus maintaining almost a constant pressure P2.

The fuel metering chamber 9116 also a diaphragm 9114, needle valve 9122, arm 9124, pin 9118, metering chamber cover 9130 and a vent hole 9128. Operation of the metering chamber 9116 is similar to the pressure chamber 9105, where the pressure P2 now at about 10 inches of water is maintained constant while the fuel is fed to the fuel injector 9138. LPG Fuel in the metering chamber 9116 is connected to the injector 9138 through a fuel passage 9126, as the fuel is depleted in the metering chamber 9116 due to LPG fuel injection into the passage 9180, the pressure P2 drops in the metering chamber. The needle 9122 opens and maintains a nearly constant pressure P2. The needle valve 9122 is activated by the diaphragm through the pin 118 and the arm 124. The needle valve tries to stay closed because of the spring 9120 in the metering chamber 9116. Typically this spring 9120 is a very small spring compared to the spring 9109. Pressure P2 in metering chamber 9116 is slightly lower than P2 due to pressure loss across the needle valve 9122.

The amount of LPG fuel 9101 injected depends on throttle position, intake temperature TI, engine block or exhaust gas temperature TB, engine speed RPM, and sometimes, intake manifold pressure MAP. In addition, an fuel inlet pressure or fuel pressure in the LPG supply line may be input to the ECM so adjust the fuel on time. Fuel supply pressure may be important when the fuel tank is almost empty and that a longer on time may be required to completely empty the fuel tank.

Figure 19:
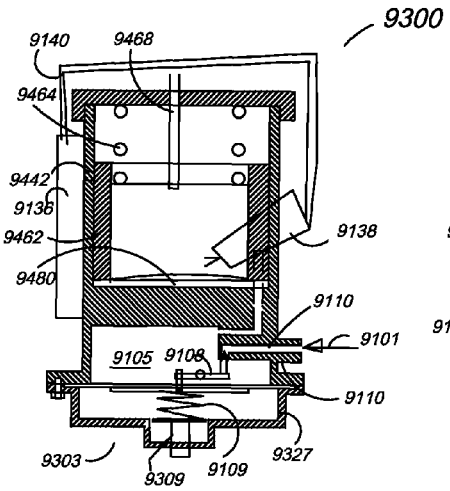
FIG. 19 is a cross sectional front view of an embodiment of electronic LPG fuel injected throttle body with slide valve with fuel pressure regulator.

FIG. 19 illustrates an LPG Electronic Fuel Injection system 9300 similar to 9100. However, the LPG EFI System 9300 has a sliding valve 9462 in place of butterfly valve and does not have fuel metering chamber. It only has pressure chamber 9105 which also acts as a metering chamber. The principle of operation is similar as explained above. However, the ECU 9136 has a linear position sensor 9442 in place of a rotary position sensor 9142.

Figure 20:
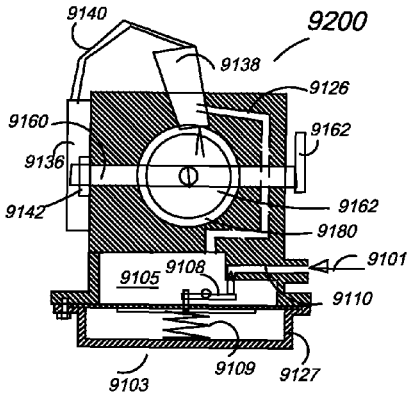
FIG. 20 is a cross sectional front view of another embodiment of throttle body with electronic LPG fuel injection system, butterfly valve, and fuel pressure regulator only.

FIG. 20 illustrates a throttle body similar to throttle body shown in FIG. 19, but has only pressure chamber 9105 (also acts as a fuel metering chamber). It is possible to have a throttle body where the pressure regulator is external to the throttle body, as shown in FIG. 15. And the commonly used pressure regulator as in cooking gas stove may be used.

Figure 21:
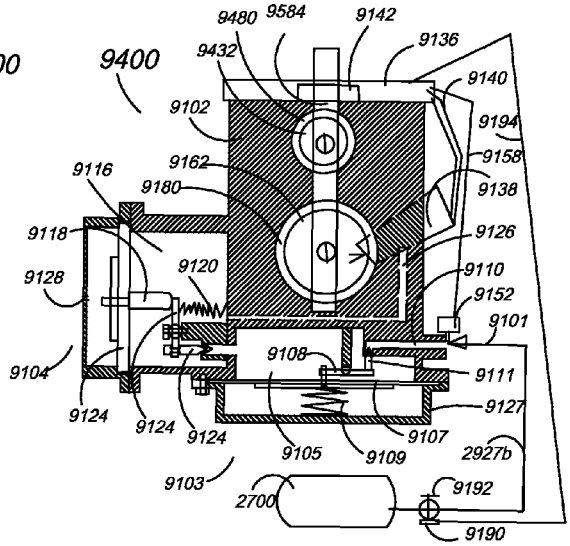
FIG. 21 is a cross sectional front view of an embodiment of an electronic LPG fuel injected throttle body with dual intake butterfly valves, fuel metering chamber, and fuel pressure regulator.
Figure 22:
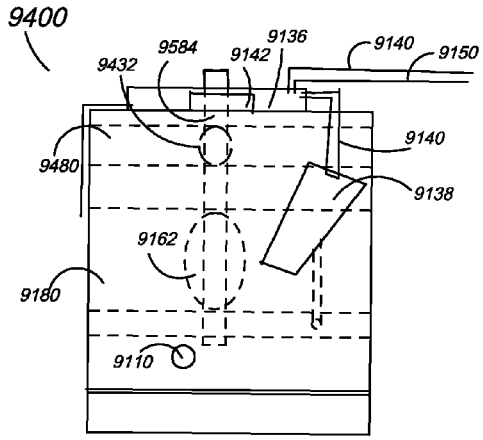
FIG. 22 is side view of FIG. 21.

FIGS. 21 and 22 illustrate a dual intake LPG Electronic Fuel Injection system, with a throttle body 9102 consisting of primary intake passage 9180 having a throttle valve 9162 to control the flow of charge (mixture of air and fuel) and a secondary passage 9480 for air only having a throttle valve 9432 to regulate only the air. The dual intake system may be used in place of the carburetor 500 explained earlier on an engine shown in FIGS. 14, 14*d*, and 15 or in a two-stroke stratified engines. Throttle valves 9162 and 9432 are on the same throttle shaft 9584 or it can be a rotary valve or a sliding valve disclosed in many prior arts. In FIG. 21, the fuel supply line 2927*b* (in FIG. 18 and 2927*a* in FIG. 15) from the LPG fuel tank 2700 has a fuel shut off valve 9192 that also is an electrical kill switch to kill the running engine. This is a safety measure, where the operator shuts off the fuel when he turns the switch to kill the engine. The kill wires 9194 turns off the circuit in the ECU to kill the engine. For certain type of applications, it is necessary to have the engine kill switch on the handle. FIG. 21 also shows a fuel pressure sensor 9152 to sense the fuel pressure and may be input to the ECM 9136 to appropriately adjust the fuel on time. Where the on time is longest at lower pressures. This normally occurs when the fuel is almost empty in the LPG fuel tank. Sensor may be necessary since there is no fuel pump in this case.

Typically, the EFI system requires a TDC or a crank angle sensor to determine when the injection should occur or spark should occur in a cycle. In a two-stroke engine, the spark occurs every rotation of the crankshaft and also fuel injection occurs every rotation of the crankshaft. However, in a four cycle engine, in most cases, the spark occurs only once every two rotations of the crankshaft. However, in a small engine without any electronic controls or crank angle sensor, the spark occurs every rotation; once in the compression stroke (slightly before TDC) and another time during exhaust stroke. Normally, the occurrence of second spark during exhaust stroke does no harm to performance of the engine, except it may reduce the life of the spark plug, as each spark may erode the electrode. However, the crank angle position is more critical for the fuel injection and typically it is preferable to inject fuel only during the intake stroke, which is most commonly done in an automobile type of engines, because they have a crank angle position sensor, most commonly a sensor to locate the position of the camshaft that rotates at half the engine speed. As such it adds cost to the EFI system, because this type requires a crank angle sensor and a special camshaft having a positioning feature.

However, it is possible to inject small quantities of fuel twice per cycle in a four-cycle engine. This means the fuel is injected once every rotation of the engine; once during intake and once during the expansion stroke. The total amount of fuel injected is a sum of the fuel injected every rotation. As such it is possible not use the crank angle position sensor in a four cycle engine. It is advantageous to inject at an appropriate time during intake process. For example, the fuel injection may occur during the intake stroke within a certain crank angle position. This may be determined by the spark timing and occurrence of fuel injection may be tied to spark timing. Injection during certain crank angles in the intake cycle may help stratification of charge. Because initial intake process may have lean air-fuel mixture, while the later part of intake may have slightly richer charge. Appropriate intake port design helps stratification near the spark plug, that gives lower NOx emission.

However, it is also possible to determine the firing TDC based on the spark timing or the spark pulse the ECM commands to the ignition coil. For example, when the engine is first cranked, the time interval between the sparks indicates the speed. In a small engine, the spark may occur twice per cycle or once every rotation, as explained earlier. When the engine does not fire, the spark interval may be more or less same, or may increase if the engine does not continue to rotate, as in the case of a hand cranked engine. However, when the engine fires, the RPM immediately following the spark increases, thus the time interval between the spark decreases. Therefore it is possible to determine the actual firing spark that occurs during the compression stroke, which can be used to inject the fuel only during the intake stroke. Thus the fuel need not be injected twice, possible a logic may be incorporated to inject fuel only once a cycle in a four cycle engine, without having a crank angle position sensor. Secondly, this logic may be used to spark once only once per cycle, and therefore extend the life of the spark plug.

Figure 23:
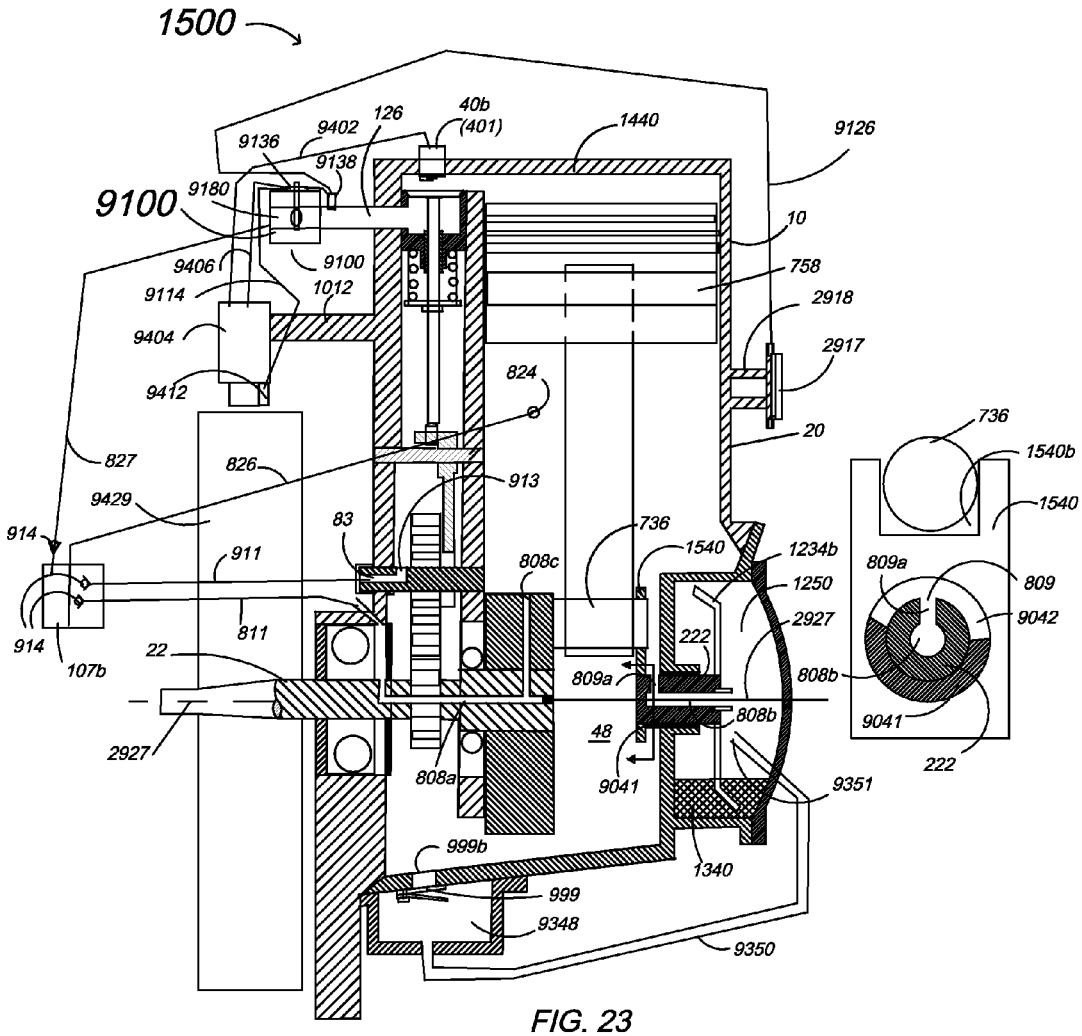
FIG. 23 is a cross-sectional side view illustration of an exemplary embodiment of a half crank four-stroke engine with an oil reservoir on outboard side.

FIG. 23 illustrates a half crank L head four-stroke engine 1500 having an outboard shaft 222, driving an oil slinger 1234*b*. The outboard shaft 222 is loosely connected to the crank pin 736 through an yoke 1450. The advantage of a loosely connected yoke is that the outboard shaft 222 may be assembled easily along with the crankcase cover 44. And that the outboard shaft 222 and the inboard shaft 22 may have a larger radial tolerance and the yoke and the outboard shaft may be easily disassembled without having to remove the rest of the engine parts. The outboard shaft 222 has at least one oil slinger 1234*b* to splash oil 1340 and generate mist of oil. The oil mist generated in the oil reservoir 1250 is inducted into the crank chamber 48 as the piston moves upward. As the piston moves upward the pressure in the crankcase chamber drops and the mist in the oil reservoir 1250 is inducted through an oil passage 808*b* and 809*a* in the outboard shaft 222. The cut out 809 in the bush bearing 9041 opens the radial passage 809*a* at a time when the piston begins to move upward and closes just before the oil return port 824 is opened by the piston. The oil mist in the crankcase chamber 48 lubricates the internal parts. The oil condensed is typically collected at the bottom of the crankcase chamber where a oil drain port 999*b* is provided. The oil drain port lets the condensed oil to return to the oil reservoir 1250 through the oil return passage 9350 and through a non-return valve 999. As the piston moves downward, the pressure in the crankcase chamber increases thus pushing the condensed oil into the intermediate chamber 9348 and some vapors with the blow by gas into the oil recovery chamber 107*b*. The blow by gas in the crankcase chamber is communicated to the oil recovery chamber 107*b* through oil passages (808*c* and 808*a*) in the crankshaft 22 or through passages 83 in the cam shaft 83. There is a check valve 914 at the end of the oil passage 811 and 911. The check valve allows the blow by gases to escape the crankcase chamber 48, but does not allow the ambient air to enter the crankcase chamber. The oil port 809 at the end of the radial passage 809*a* is closed when the piston is moving down ward, but the one way valve 999 is forced open due to pressure difference across the valve. Therefore by carefully selecting the size of the oil passage 808*c* and or 913, the pressure in the oil reservoir may be maintained to be slightly higher, particularly when the piston is moving upward, which now ensures flow of oil mist into the crankcase chamber while emptying the crankcase chamber of the blow by gases. The oil condensed in the oil recovery chamber 107*b* is returned to the crankcase chamber 48 through an oil return port 824 in the cylinder bore 12, which is intermittently opened and closed by the piston. As the piston moves upward, the pressure in the crankcase chamber 48 drops below atmospheric, thus drawing the condensed oil back into the crankcase chamber. As the piston moves down ward, the oil return port 824 is closed by the piston. The vapor or dry blow by gas escape into the engine/intake passage through a breather tube 827 during the intake process. Thus a mist type of lubrication system affectively lubricates the engine parts in a four stroke engine. The cylindrical shape of the oil reservoir 1250 an dad me shaped reservoir cover 9310 allows the engine to be rotated/tilted at any attitude. The location of the axial passage in the oil reservoir is at the center of the oil reservoir, such that the oil 1340 never enters the crankcase chamber at any attitude. The tip 9351 of the oil return passage 9350 in the oil reservoir is at the center such that is always above the oil 1340 at all attitudes of the engine.

Figure 24:
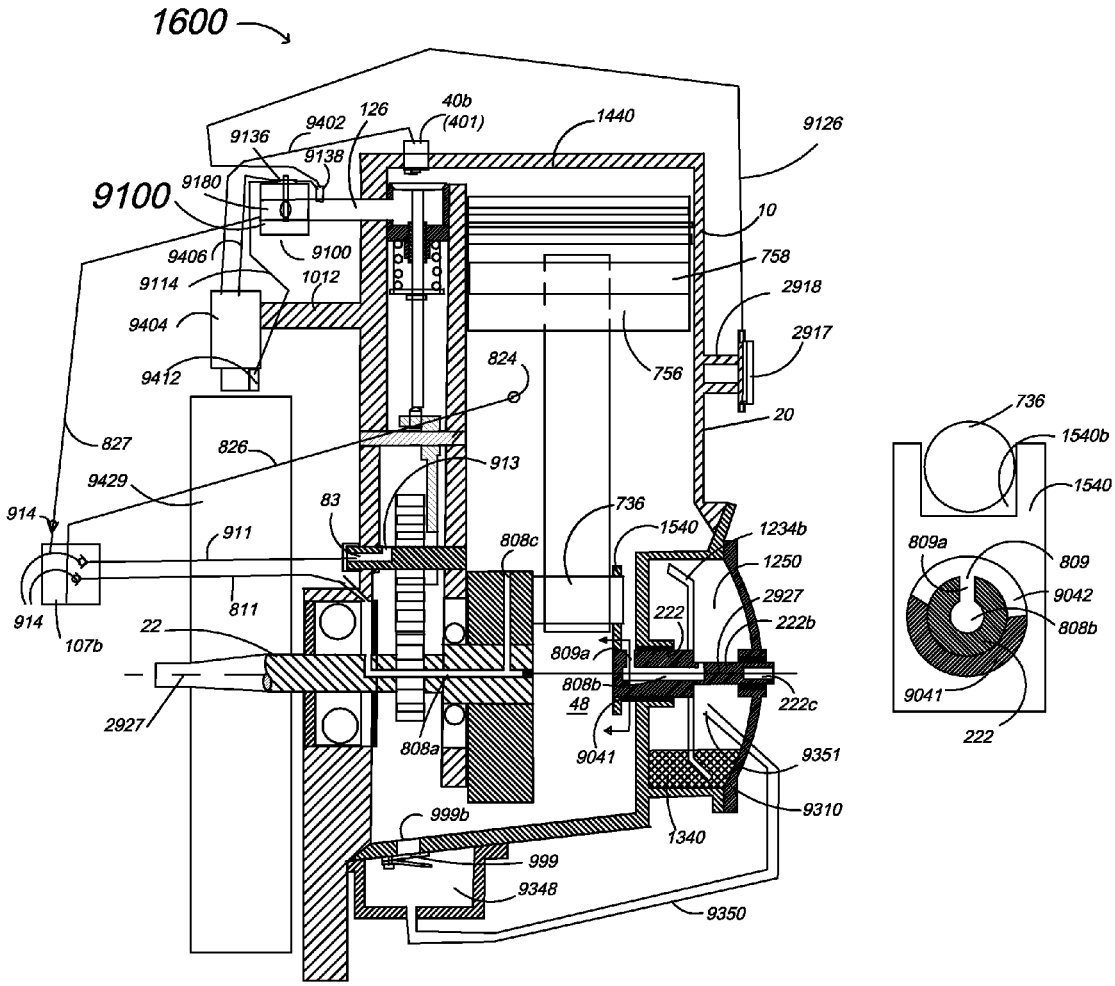
FIG. 24 is a cross-sectional side view illustration of an exemplary embodiment of a half crank four-stroke engine with an oil reservoir and starter shaft on outboard side

Further, another engine 1600 shown in FIG. 24 illustrates where the outboard shaft 222 is extended beyond the oil reservoir chamber 1250, where the outer end of the outboard shaft has a slot 222*d* to engage an external starter motor. The starter motor can be similar to the one sold by MTD company. A manual rope pulley may also be attached to the shaft 222*b* outside the oil reservoir.

Figure 25:
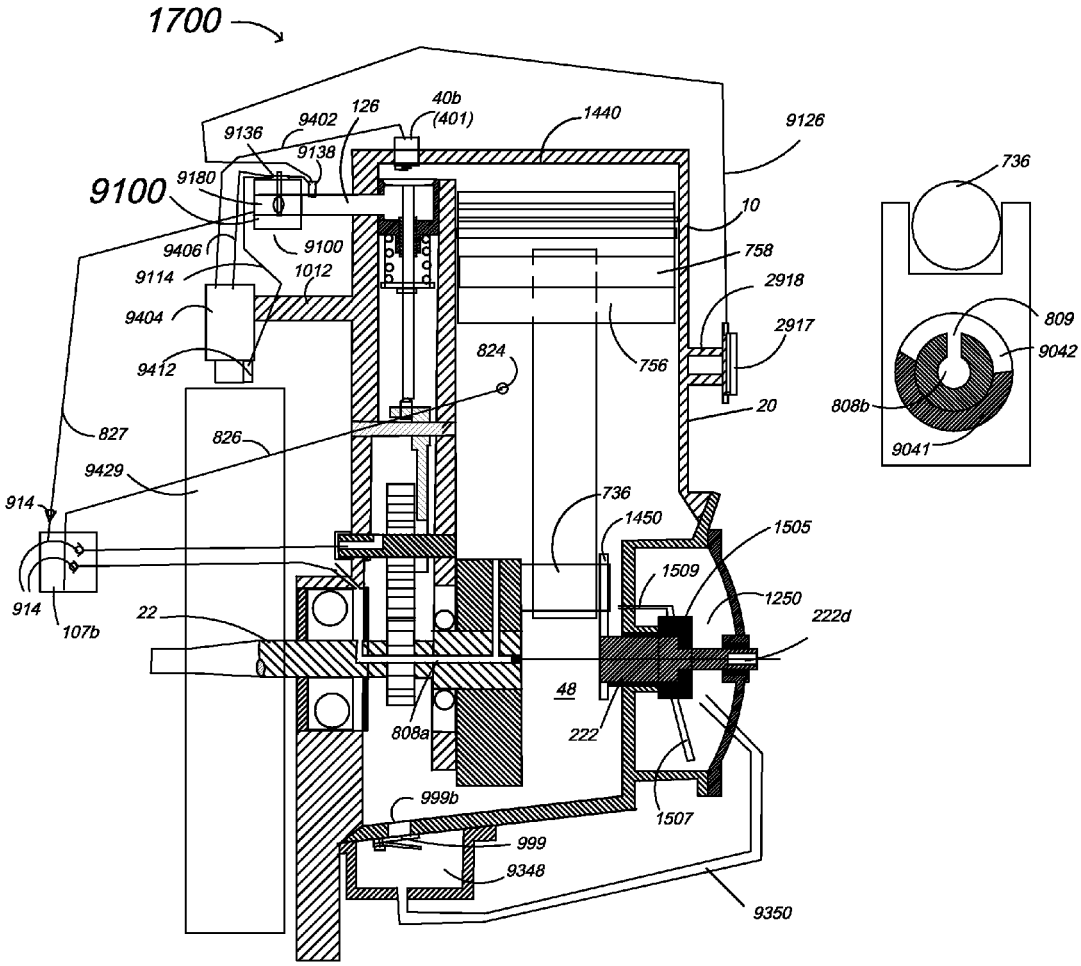
FIG. 25 is a cross-sectional side view illustration of an exemplary embodiment of a four-stroke engine with an oil reservoir and a oil pump and starter shaft on outboard side.

In another engine 1700 shown in FIG. 25, the outboard shaft 222 drives an oil pump 1505 to pump oil from the oil reservoir 1250. The oil pump has an inlet tube 1507 always submerged in the oil and has an outlet pipe 1509 injected oil into the crankcase chamber 48. The oil lubricates the internal parts and the oil collected at the bottom of the crankcase chamber is returned to the oil reservoir 1250 through the return passage 9350.

Further, the outlet from the LPG fuel tank may be from the very center of the LPG fuel tank, such that the liquefied fuel never gets out the outlet and the tip is always above the level of the fuel at all attitudes.

Further, it may be possible to have lubricant already mixed into the liquefied fuel such that in the case of crankcase charged design, such as shown in FIGS. 5 and 14*c*, the internal parts get lubricated and no spate lubricating oil is necessary.

Further, since the LPG fuel is at a higher pressure and the volume of fuel in gaseous form is substantially higher, the fuel pressure may be utilized to pressure an oil reservoir, where the oil is injected into the crankcase.

Further, a special lubricant already mixed into the liquefied petroleum gas (LPG) helps lubricate the gaseous fuel injector.

Further, an oil reservoir may already be built into the LPG fuel tank, which like in a two-stroke engine is used to lubricate the four-stroke engine as shown in FIG. 5 and FIG. 14*c*, for example. Therefore the customer does not have to carry oil separately.

Figure 26:
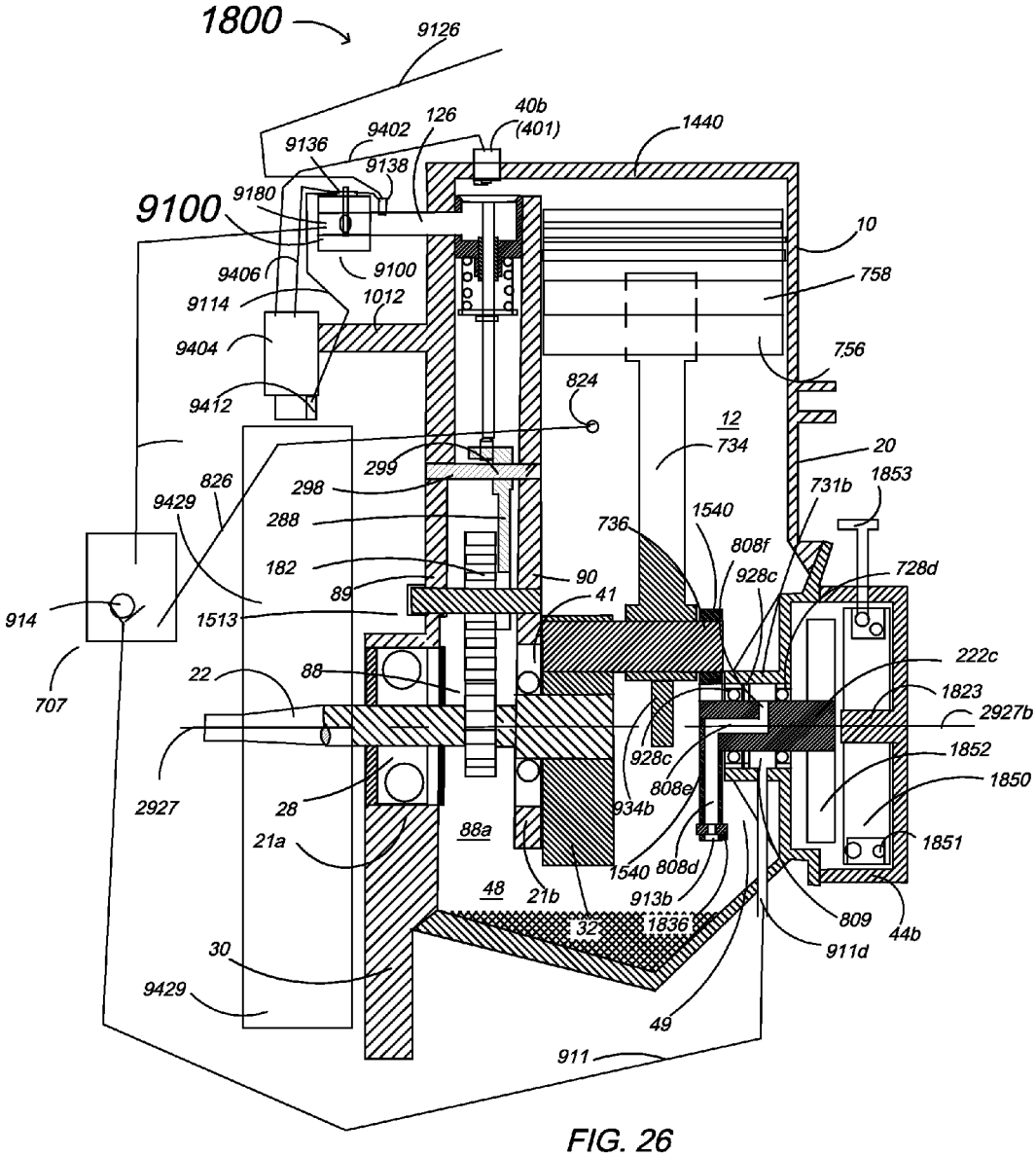
FIG. 26 is a cross-sectional side view illustration of an exemplary embodiment of a four-stroke engine with an outboard starter and breather passage in the starter shaft having a yoke.
Figure 27:
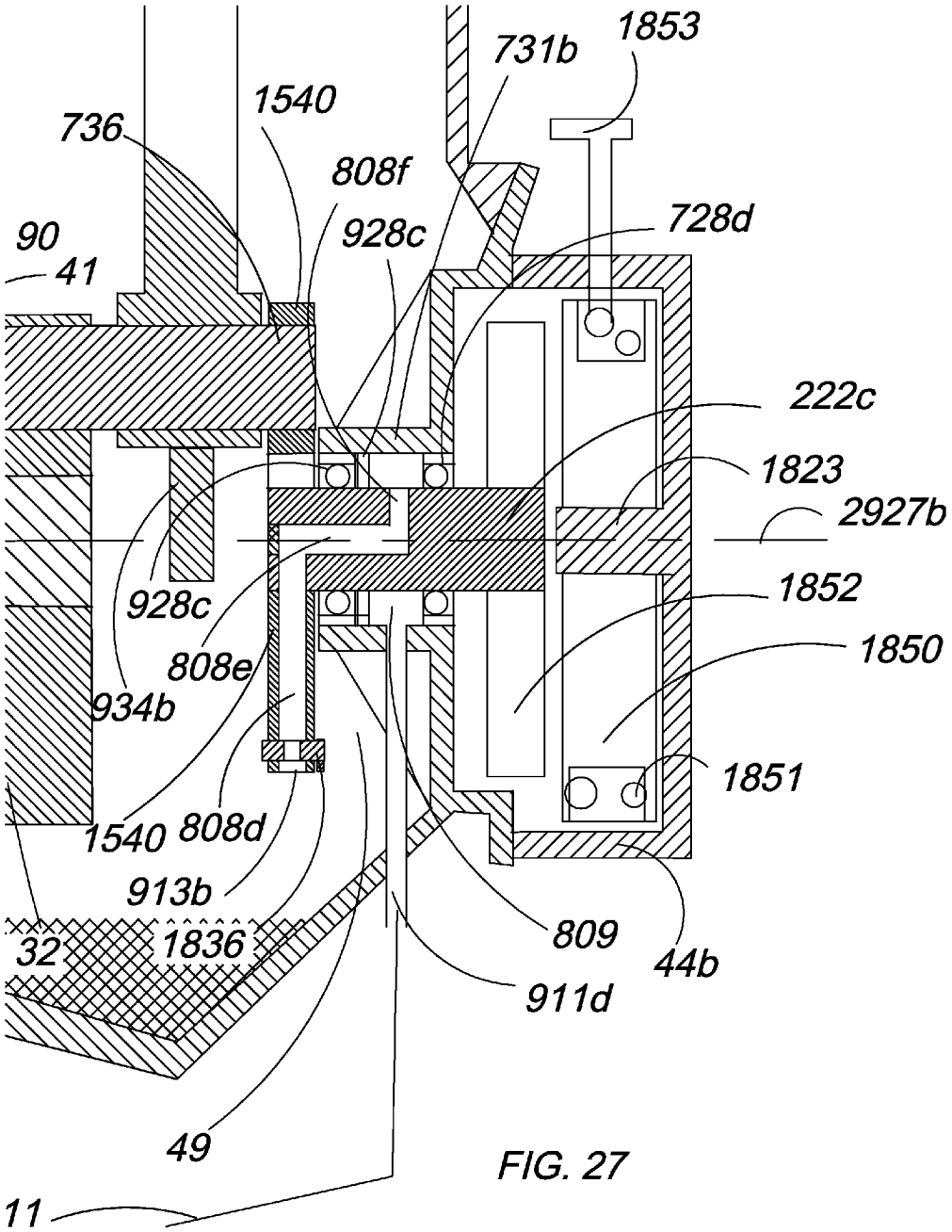
FIG. 27 is a cross-sectional side view illustration of an exemplary embodiment of a four-stroke engine with an outboard starter and breather passage and a valve in the starter shaft having a yoke.

FIG. 26 illustrates a crankcase chamber breather system. The engine 1800 is a half crank engine having an outboard manual starter 1820 consisting of a starter shaft 222*c* having a yoke with a 'U' slot 1541 which loosely engages the crankpin 736. Therefore, the outboard shaft does not bear any load coming from the piston 756 due to combustion of fuel-air mixture. The centerline 2927*b* of the countershaft 222*c* need not be in line with the center line 2827 of the crankshaft 22. The yoke 1540 is rigidly fixed inside of the crankcase chamber 48 to one of the end of the starter shaft 222*c*, while the other outboard end has the starter cup 1852. The starter shaft 222*c* is straddle mounted by a bearing 728*b* on the inboard side and a sealed bearing 928*d* closer to the starter cup 1852. An oil seal 928*c* is installed on outboard side of the bearing 728*b* and has space 809 between the oil seal 928*b* and the outboard bearing 928*d*. the space 809 may have a rotary valve similar to the one described with engine 1600 to time the opening and closing of the passage. The opposite end of the 'U' slot 1541 in the yoke 1450 has a radial passage or a separate tube (not shown) 808*d* that communicates with the axial passage 808*e*. The radial passage 808*f* is between the oil seal 928*c* and the outboard sealed bearing 928*d*. The space 809 has communication with the oil separator chamber 707 through a passage 911*d*, preferably a tube or cast into the crankcase cover 44. The passage 911*d* is connected to the oil separation chamber (preferably in an air filter assembly, through a tube 911. The condensed oil in the separation chamber 707 is then fed into the combustion chamber during the intake process. The condensed oil in the separation chamber 707 is returned to the crankcase chamber 48 when the piston 756 opens the oil return port 824. The outboard starter 1870 functions in a commonly known manner. The bearings 728*b* and the outboard bearing 728*d* are supported on a boss 731*b* in the crankcase cover 44. The boss 731*b* is projected inboard into the crankcase chamber 48 providing a cavity 49 around the boss. The cavity 49 is necessary to keep the oil from entering the radial passage 808*d* in the yoke 1540 when the engine is stored with outboard starter 1870 downward position. The radial passage 808*d* may have any one of the type of on-off valves (900) (902) (904) that is normal shut off when the engine 1800 is not running. The valve 900 for example opens when the engine starts to run. In other words, when the outboard starter shaft 222*c* starts to rotate above 100 RPM. The Valve 900 is shut closed when the engine is shut off. Therefore the oil in the crankcase chamber 48 prevents the oil from leaking from the crankcase chamber 48 when the engine is stored in any attitude. Different types of valve, for example (900), (902), or (904) and many other equivalent types operate by the principle of centrifugal force, where the centrifugal force, as the engine runs, forces the weight away from the center, thus opening the radial passage 808*d* at the port 913*b*. When the engine 1800 is running the combusted gas tend to leak into the crankcase chamber and as the piston moves downward the crankcase chamber need to be ventilated to reduce the crankcase pressure. However, the oil is in mist form and therefore tend to escape with the gases in the crankcase chamber through the breather passage that communicates between the crankcase chamber 48 and the intake system through an oil separate chamber 707.

Figure 28:
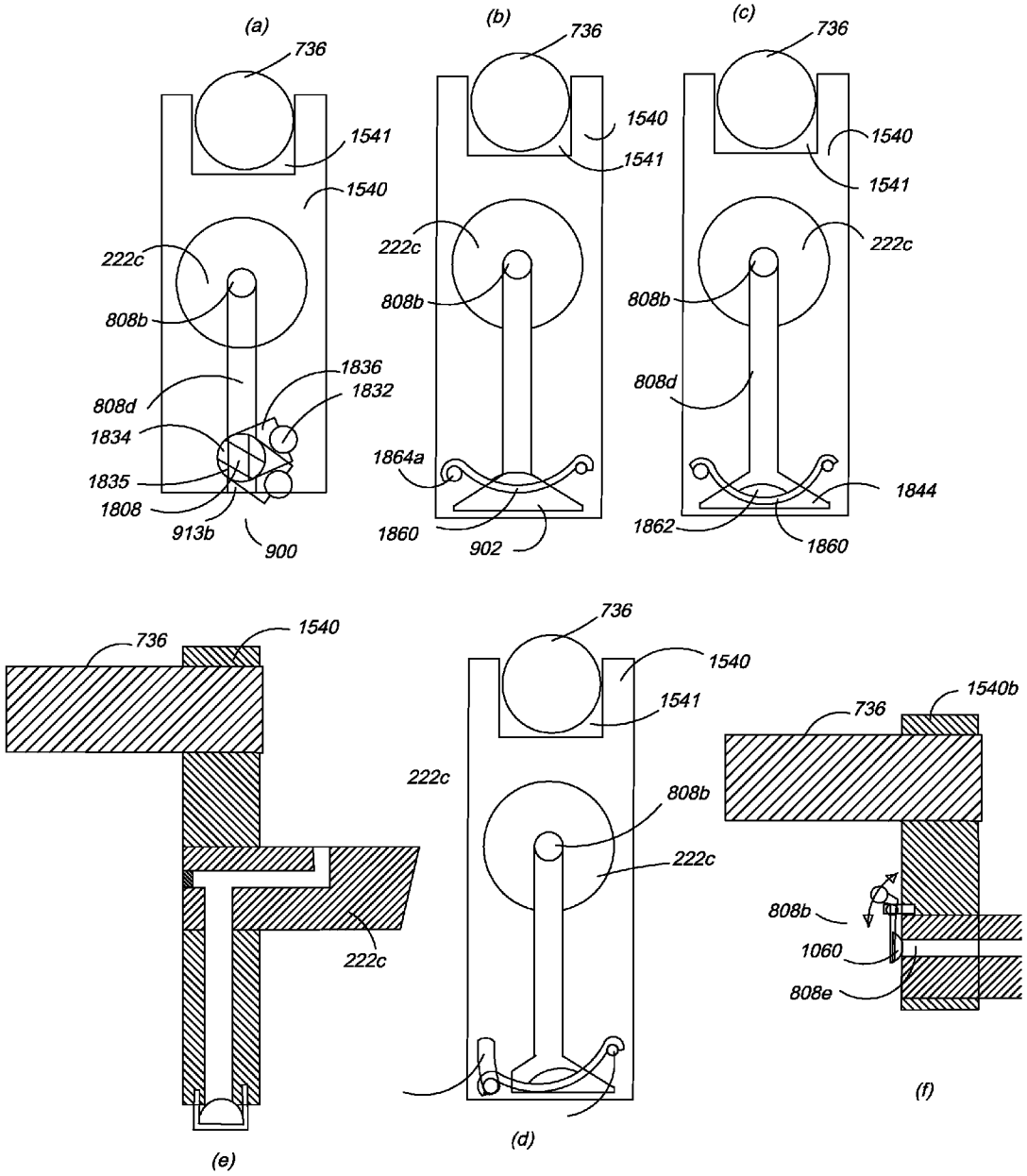
FIG. 28 (*a* thru *f*) showing on-off valves in the breather passage in the yoke on starter shaft for the engine shown in FIG. 26.

Further the valve 900, shown in FIG. 28 (*a*) consists of an arm 1836 that has a weight 1832. The arm 1836 is attached to a shaft 1835, which runs through the yoke 1540 intersecting the radial passage 808*d*. The shaft 1835 has a passage 1834 that aligns with the radial passage 808*d* when the arm is in one position, which is normally in closed position when the engine is not running. A spring, not shown, keeps valve 900 in closed position. When the starter shaft rotates above 100 RPM, the weight 1832 swings away, against the spring, from the center of the shaft 222*c* and the passage 1834 now is in line with the radial passage 808*d*.

In another version of the valve shown in FIG. 28 (*b*), the valve 902 has a metal strip 1860 having a softer valve 1862 that shuts the passage 808*d* at the port 913*b*. The ends of strip 1860 is wound around the pins 1864*a* and 1864*b*. The strip 1860 is under tension and thus keeps the valve in closed position when the shaft 222*c* is not rotating. Once the engine starts to run above 100 RPM, the centrifugal force on the strips, pulls the valve 1862 away from the port 913*b*, as shown in FIG. 28 (*c*).

FIG. 28 (*e*) shows a valve 904 similar to valve 902, except the metal strip 1860*b* can swing open guided in a slot 1548 and a spring 1866 keeps the valve closed. FIG. 28 (*e*) shows cross sectional view of the valve in FIG. 28 (*a*).

Figure 29:
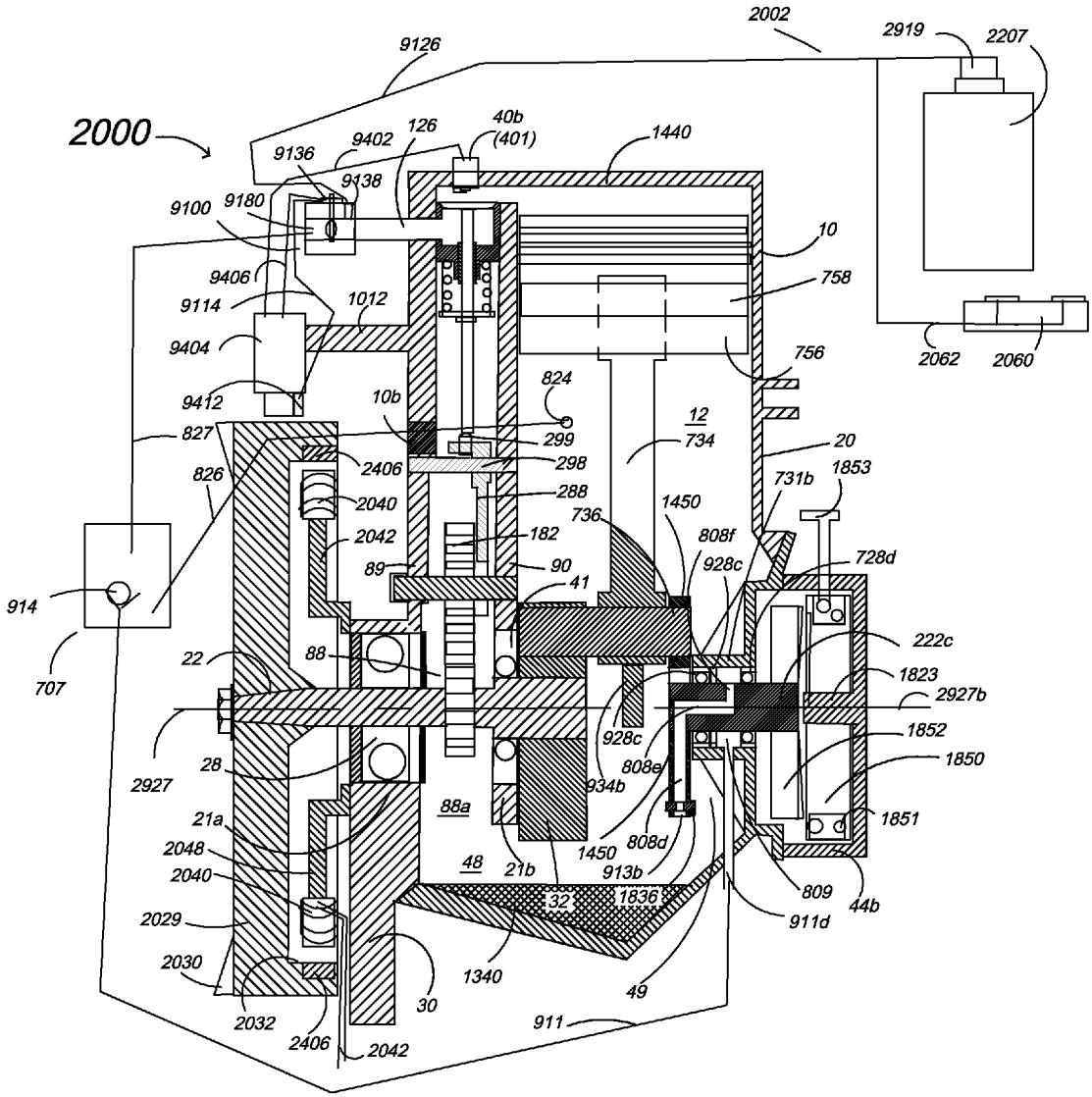
FIG. 29 is a cross-sectional side of view illustration of an exemplary embodiment of an LPG fuel injected generator.

FIG. 29 illustrates an engine 2000 having a generator magneto wheel 2029 on the crankshaft 22. The magneto wheel 2029 is different from previously illustrated flywheel 9429 in FIG. 26, in a way that the magneto wheel has many magnets 2406 on inner circumference of the magneto wheel 2029 as illustrated in FIG. 29. The magnets 2406 are spatially spaced around the inner circumference 2032. The power generating coils 2040 mounted on a commonly known plate called stator is mounted on to the crankcase block 30. The power generating coil system are well known to the skilled persons and therefore not explained in detail here. The power generated by the magneto-stator system may a DC type or an AC type of either 110 to 120 Volts or 220 to 240 Volts. The power supply is drawn from the coils through a pair of wires 2042 for utility, including charging a battery or powering the bulb or tv, etc.

The gaseous fuel injected engine operates in the same manner described earlier. However, the fuel supply system 2002 consists of an LPG fuel tank 2207 (or compressed natural gas tank), which also supplies fuel to the cooking stove 2060 in a residence. The fuel supply line may also be from a utility company that supplies through a network of pipelines supplying fuel to individual residence. The LPG fuel line 9126 has a pressure regulator 2919 that reduces fuel pressure from about 45 to 50 psi to 10 to 15 psi or less. The fuel supply line 9126 has a T junction to supply fuel to the stove 2062.

The engine may started remotely by means of an electric starter couples to the shaft 222*c*. The engine cooling fans 2030 are integral to the magneto wheel 2029, similar to many small air-cooled engines.

Various embodiments have been described in an illustrative manner. It is to be understood that the terminology which has been used is intended to be in the nature of words of description rather than of limitation. While certain embodiments have been described herein, modifications shall be apparent to those skilled in the art from the teachings herein and, it is, therefore, desired to be secured in the appended claims all such modifications as fall within the true spirit and scope of the contemplated embodiments.

We claim:

1. An internal combustion engine comprising:

an engine block forming an enclosure defining an engine cylinder and a crankcase chamber;

a piston;

a crankshaft;

a crank web rigidly attached to the crankshaft at a periphery of the crankshaft;

a rod connecting the piston to the crank web for transfering linear motion of the piston into a circular motion of the crank web and crankshaft;

an intake valve for receiving a mixture of fuel and air into the engine cylinder;

an exhaust valve for expelling waste gasses from the engine;

a carburetor or a throttle body for providing the mixture of fuel and air;

a crankpin linking the rod to the crank web;

an outboard starter having a starter shaft loosely attached to the crankpin by a yoke, a portion of the outboard starter disposed outside of the engine block, the yoke including a 'U' slot surrounding the crankpin on three sides with sufficient tolerance for the yoke to slide perpendicularly to the axis of the crankpin, in which the starter shaft has axially spaced apart first and second radial passages, an axial passage connecting and axially extending between the first and second radial passages, the second radial passage in fluid communication with an oil separator chamber, and wherein the piston, crankshaft, crank web, rod, and crankpin, being located inside the engine block.

2. The engine of claim 1 in which the starter shaft is not concentric to the crankshaft.

3. The engine of claim 2 in which the starter shaft is not rigidly mounted to the crankshaft.

4. The engine of claim 2 in which an axis of crankshaft and a centerline of starter shaft are parallel and not in line.

5. An internal combustion engine comprising:

an engine block forming an enclosure defining an engine cylinder and a crankcase chamber;

a piston;

a crankshaft;

a crank web rigidly attached to the crankshaft at the periphery of the crankshaft;

the crankshaft being a half crankshaft extending in only one direction from the crank web;

a rod connecting the piston to the crank web for transfering linear motion of the piston into a circular motion of the crank web and crankshaft;

a crankpin linking the rod to the crank web;

an outboard shaft parallel to and spaced apart from the crankshaft and extending axially away from the crank web;

a yoke loosely connecting the outboard shaft to the crankpin;

the yoke including a 'U' slot surrounding the crankpin on three sides;

an intake valve for receiving a mixture of fuel and air into the engine cylinder;

an exhaust valve for expelling waste gasses from the engine;

a carburetor or a throttle body for providing the mixture of fuel and air;

a flywheel;

a generator integral with the flywheel; and wherein the piston, crankshaft, crank web, and rod, being located inside the engine block.

6. An internal combustion engine comprising:

an engine block forming an enclosure defining an engine cylinder and a crankcase chamber;

a piston;

a crankshaft;

a crank web rigidly attached to the crankshaft at a periphery of the crankshaft;

a rod connecting the piston to the crank web for transfering linear motion of the piston into a circular motion of the crank web and crankshaft;

a crankpin linking the rod to the crank web;

an intake valve for receiving a mixture of fuel and air into the engine cylinder;

an exhaust valve for expelling waste gasses from the engine;

a carburetor or a throttle body for providing the mixture of fuel and air;

an outboard shaft;

a yoke loosely connecting the outboard shaft to the crankpin;

the yoke including a 'U' slot surrounding the crankpin on three sides;

an oil pump drivenly connected to the outboard shaft and disposed in an oil reservoir outboard of the crankcase chamber, and wherein the piston, crankshaft, crank web, rod, being located inside the engine block.

7. An internal combustion engine comprising:

an engine block forming an enclosure defining an engine cylinder and a crankcase chamber;

a piston;

a crankshaft;

a crank web rigidly attached to the crankshaft at a periphery of the crankshaft;

a connecting rod connecting the piston to the crankshaft via the crank web;

a crankpin linking the rod to the crank web;

a crankcase chamber containing the crank web and the crankcase chamber;

an intake valve for receiving a mixture of fuel and air into the engine cylinder;

an exhaust valve for expelling waste gasses from the engine;

a carburetor or a throttle body for providing the mixture of fuel and air;

an outboard shaft having a passage;

a yoke loosely connecting the outboard shaft to the crankpin;

the yoke including a 'U' slot surrounding the crankpin on three sides;

an oil reservoir external to the crankcase chamber; and an oil slinger mounted on the outboard shaft outside the crankcase chamber in the oil reservoir for lubricating the engine by creating oil mist and circulating the mist into the crankcase chamber through the passage; and wherein the piston, crankshaft, crank web, connecting rod, and crankpin, being located inside the engine block.

8. An internal combustion engine comprising:

an engine block forming an enclosure defining an engine cylinder and a crankcase chamber;

a piston;

a crankshaft;

a crank web rigidly attached to the crankshaft at the periphery of the crankshaft;

a rod connecting the piston to the crank web to transfer linear motion of the piston into a circular motion of the crank web and crankshaft;

a crankpin linking the rod to the crank web;

an intake port for receiving a mixture of fuel and air into the engine cylinder;

a carburetor or a throttle body for providing the mixture of fuel and air;

an outboard shaft having a passage;

a yoke loosely connecting the outboard shaft to the crankpin;

the yoke including a 'U' slot surrounding the crankpin on three sides;

an oil reservoir external to the crankcase chamber;

an oil slinger in the oil reservoir for lubricating the engine by creating oil mist in the oil reservoir and inducting the mist through the passage into the crankcase chamber; and wherein the piston, crankshaft, crank web, and rod, being located inside the engine block.

9. An internal combustion engine comprising:

an engine block forming an enclosure defining an engine cylinder and a crankcase chamber;

a piston;

a crankshaft;

a crank web rigidly attached to the crankshaft at a periphery of the crankshaft;

a rod connecting the piston to the crank web to transfer linear motion of the piston into a circular motion of the crank web and crankshaft;

a crankpin linking the rod to the crank web;

an intake port for receiving a mixture of fuel and air into the engine cylinder;

a carburetor or a throttle body for providing the mixture of fuel and air;

an oil reservoir;

an oil slinger for lubricating the engine by creating oil mist and inducting the mist into the crankcase chamber;

an outboard shaft running through the oil reservoir and extending away from the crankshaft, the outboard shaft substantially in line with the crankshaft, and the outboard shaft operable to run at the same speed as the crankshaft;

a yoke loosely connecting the outboard shaft to the crankpin;

the yoke including a 'U' slot surrounding the crankpin on three sides;

the outboard shaft including the oil slinger; and wherein the piston, crankshaft, crank web, and rod, being located inside the engine block.

10. The internal combustion engine as claimed in claim 9 wherein the fuel is significantly free of oil.

11. The internal combustion engine as claimed in claim 9 wherein the fuel is gaseous fuel.

12. The internal combustion engine as claimed in claim 9 wherein the fuel is liquefied petroleum gas.

13. An internal combustion engine comprising:

an engine block forming an enclosure that defines a crankcase chamber;

an engine block forming an enclosure defining an engine cylinder and a crankcase chamber;

a piston;

a crankshaft;

a crank web rigidly attached to the crankshaft at a periphery of the crankshaft;

a rod connecting the piston to the crank web for transfering linear motion of the piston into a circular motion of the crank web and crankshaft;

a crankpin linking the rod to the crank web;

an oil reservoir;

an outboard shaft disposed inside the oil reservoir;

a yoke loosely connecting the outboard shaft to the crankpin;

the yoke including a 'U' slot surrounding the crankpin on three sides;

at least one slinger driven by the outboard shaft, in which the at least one slinger is operable to generate oil mist or oil droplets; and at least one passage in the outboard shaft, wherein the passage is operable for being intermittently connected to the crankcase chamber.

14. The engine of claim 13, in which the engine is a two stroke engine.

15. The engine of claim 13 in which the oil reservoir is adjacent to the crankcase chamber.

16. The engine of claim 13 in which the slinger is off-set from the crankshaft.

17. The engine of claim 13, in which the engine is a piston ported two-stroke engine.

18. The engine of claim 13, in which the engine is a stratified two-stroke engine.

19. The engine of claim 13, in which the engine uses fuel that is substantially free of oil.

20. The engine of claim 19 in which the fuel is a gaseous fuel.

21. The engine of claim 19 in which the fuel is LPG.

22. The engine of claim 19 in which the fuel is natural gas.

23. The engine of claim 19 in which the fuel is hydrogen.

24. The engine of claim 19 in which the fuel is gasoline.

25. The engine of claim 19 in which the fuel is liquid fuel.

26. An internal combustion engine comprising:

a piston operable to move upwards and downwards;

a combustion chamber intermittently connected to a crankcase chamber as the piston moves upwards and downwards;

a crankshaft;

a crank web rigidly attached to the crankshaft at a periphery of the crankshaft;

a rod connecting the piston to the crank web for transfering linear motion of the piston into a circular motion of the crank web and crankshaft;

a crankpin linking the rod to the crank web;

an intake port for receiving a mixture of fuel and air into the engine;

a carburetor or a throttle body for providing the mixture of fuel and air;

an outboard shaft;

a yoke loosely connecting the outboard shaft to the crankpin;

the yoke including a 'U' slot surrounding the crankpin on three sides;

an oil pump for injecting oil into the crankcase chamber;

the oil pump drivenly connected to the outboard shaft, and including an oil pump outlet;

an axial oil passage in the outboard shaft connected to a radial oil passage in the outboard shaft;

the radial passage and the axial passage in fluid communication with the oil pump outlet; and an on-off valve to shut off the radial oil passage when the engine is running below one hundred RPM.

27. The engine of claim 26 further comprising the on-off valve being a cylindrical/rotary valve or a popping valve or a L valve.

28. The engine of claim 26 wherein the engine is a two-stroke engine.

29. The engine of claim 26 wherein the engine is a four-stroke engine.

30. The engine of claim 26 wherein the crankcase chamber is enclosed by a crankcase wall, and the oil pump is mounted to the side of the crankcase wall and driven off the outboard shaft.

31. The engine of claim 26 wherein the radial passage and the axial passage are operably located for injecting oil directly into the crankcase chamber.

32. The engine of claim 31 further comprising an oil sump next to the crankcase chamber.

33. The engine of claim 32 further comprising the oil sump operable for supplying oil to the oil pump at all attitudes of the engine.

34. The engine of claim 26 further comprising the oil pump including an inlet operable for supplying oil to the oil pump at all attitudes of the engine.

35. The engine of claim 34 further comprising an oil sump next to the crankcase chamber, in which the inlet to the oil pump is always in the oil at all attitudes when the oil is at minimum level in the oil sump.

36. An internal combustion engine comprising:

an engine block forming an enclosure that defines an engine cylinder, a combustion chamber, and a crankcase chamber;

a piston, operable to move upwards and downwards within the cylinder;

a crankshaft;

a crank web that is rigidly attached to the crankshaft at the periphery of the crankshaft;

a rod that connects the piston to the crank web so as to transfer linear motion of the piston into a circular motion of the crank web and crankshaft;

a crankpin linking the rod to the crank web;

an intake port for receiving a mixture of fuel and air into the engine cylinder;

a carburetor or a throttle body for providing the mixture of fuel and air;

an outboard shaft;

a yoke loosely connecting the outboard shaft to the crankpin;

the yoke including a 'U' slot surrounding the crankpin on three sides;

an oil slinger attached to the outboard shaft;

an axial oil passage in the outboard shaft;

a radial oil passage in the outboard shaft;

the crankcase chamber and combustion chamber operable to be intermittently connected as the piston moves upwards and downwards;

the radial passage and the axial passage connected to the crankcase chamber and an oil sump and operable for inducing oil into the crankcase chamber intermittently as the piston moves upward; and the piston, crankshaft, crank web, and rod being located inside the engine block.

37. The engine of claim 36 in which the axial oil passage includes an on-off valve to shut off the axial oil passage when the engine is running below one hundred RPM.

38. The engine of claim 36 in which the radial oil passage includes an on-off valve to shut off the radial oil passage when the engine is running below one hundred RPM.

* * * * *